US008784153B2

(12) United States Patent
Sugimoto et al.

(10) Patent No.: US 8,784,153 B2
(45) Date of Patent: Jul. 22, 2014

(54) TRANSFORMABLE TOY

(75) Inventors: Michitoshi Sugimoto, Tokyo (JP); Nobuhiro Arai, Tokyo (JP); Wataru Sato, Tokyo (JP); Fujio Nobata, Tokyo (JP)

(73) Assignee: Sega Toys Co., Ltd, Tokyo (JP)

( * ) Notice: Subject to any disclaimer, the term of this patent is extended or adjusted under 35 U.S.C. 154(b) by 536 days.

(21) Appl. No.: 13/127,309

(22) PCT Filed: Oct. 28, 2009

(86) PCT No.: PCT/JP2009/068856

§ 371 (c)(1),
(2), (4) Date: Jul. 19, 2011

(87) PCT Pub. No.: WO2010/053104

PCT Pub. Date: May 14, 2010

(65) Prior Publication Data

US 2011/0269366 A1 Nov. 3, 2011

(30) Foreign Application Priority Data

Nov. 4, 2008 (JP) ..... 2008-283752
Sep. 29, 2009 (JP) ..... 2009-223577

(51) Int. Cl.
*A63H 3/00* (2006.01)
*A63H 33/00* (2006.01)

(52) U.S. Cl.
CPC ..... *A63H 33/003* (2013.01)
USPC ..... 446/72; 446/376; 446/487; 273/142 R

(58) Field of Classification Search
USPC ..... 446/72, 376, 487; 273/142 R
See application file for complete search history.

(56) References Cited

U.S. PATENT DOCUMENTS 3,715,124 A * 2/1973 Swartz ..... 273/244.1
4,010,956 A * 3/1977 Zyla et al. ..... 273/246

(Continued)

FOREIGN PATENT DOCUMENTS

| | | |
|---|---|---|
| JP | 59-96090 | 6/1984 |
| JP | 62-2984 | 1/1987 |
| JP | 2007-215898 | 8/2007 |

OTHER PUBLICATIONS

International Search Report issued in PCT Application PCT/JP2009/068856, mailed on Dec. 28, 2009.

*Primary Examiner* — Gene Kim
*Assistant Examiner* — Joseph B Baldori
(74) *Attorney, Agent, or Firm* — The Marbury Law Group, PLLC

(57) ABSTRACT

A transformable toy (100) which is instantaneously changeable from a flat plate-like shape to the shape of a character figure and which is used to play a game by rotating a roulette wheel (189) to compete for the score of attack or defense. A transformable toy comprises character-figure constituting members (111, 122, 131, 141) foldable to a state of a generally flat plate and rotatably connected to each other, elastic members each provided between each of the character-figure constituting members, a roulette wheel (108) attached to any of the character-figure constituting members, a rotation imparting mechanism for imparting rotation to the roulette wheel, and an engaging means (157) for maintaining and releasing the folded state of the character-figure constituting members. When the character-figure constituting members are folded against the elastic forces of the elastic members to operate an engaging member, the character-figure constituting members are rotated and caused to protrude. This makes the outline of a character figure protrude and appear and, at the same time, makes the roulette wheel to rotate.

10 Claims, 33 Drawing Sheets

(56) References Cited

U.S. PATENT DOCUMENTS

| | | | | | |
|---|---|---|---|---|---|
| 4,240,632 | A | * | 12/1980 | Watanabe | 463/52 |
| 4,358,114 | A | * | 11/1982 | Burnside | 273/143 R |
| 4,391,060 | A | * | 7/1983 | Nakane | 446/94 |
| 4,516,948 | A | * | 5/1985 | Obara | 446/95 |
| 4,543,073 | A | * | 9/1985 | Matsuda | 446/230 |
| 4,578,046 | A | * | 3/1986 | Ohno | 446/376 |
| 4,605,381 | A | * | 8/1986 | MacBain et al. | 446/321 |
| 4,605,383 | A | * | 8/1986 | Horiuchi | 446/376 |
| 4,750,895 | A | * | 6/1988 | Shinohara et al. | 446/230 |
| 5,310,378 | A | * | 5/1994 | Shannon | 446/268 |
| 5,332,227 | A | * | 7/1994 | Passero | 273/243 |
| 5,382,023 | A | * | 1/1995 | Roberts et al. | 273/142 H |
| 5,382,188 | A | * | 1/1995 | Tomellini | 446/397 |
| 5,462,285 | A | * | 10/1995 | O'Patka et al. | 273/459 |
| 6,017,260 | A | * | 1/2000 | Dolan | 446/298 |
| 6,077,144 | A | * | 6/2000 | Fishman | 446/236 |
| 6,322,072 | B1 | * | 11/2001 | Mair et al. | 273/141 R |
| 6,502,657 | B2 | * | 1/2003 | Kerrebrock et al. | 180/218 |
| 7,780,167 | B2 | * | 8/2010 | Norman et al. | 273/146 |
| 7,927,174 | B2 | * | 4/2011 | Kim et al. | 446/470 |
| 8,011,992 | B2 | * | 9/2011 | Ejima | 446/93 |
| 8,066,542 | B2 | * | 11/2011 | Ejima | 446/93 |
| 2002/0108961 | A1 | * | 8/2002 | Nakamoto et al. | 221/24 |
| 2008/0067741 | A1 | * | 3/2008 | Eckhardt | 273/143 R |
| 2009/0233519 | A1 | * | 9/2009 | Ejima | 446/376 |

* cited by examiner

TRANSFORMABLE TOY

TECHNICAL FIELD

The present invention relates to a toy and more particularly to a transformable toy which enables a player not only to enjoy the transformation of the toy but also to play a game with other players who possess similar transformable toys.

BACKGROUND ART

In these days, there are provided various types of transformable toys which enable a player to enjoy making a change in the form or appearance of the toys. For example, there is provided a transformable toy which is a spherical toy which is played with by being thrown to roll on a flat horizontal surface and in which when the spherical toy is caused to reach a magnetic portion which is disposed at a predetermined location on the flat surface, the spherical toy can be transformed into the form of a character from the spherical shape to stop rolling (for example, Patent Document 1).

RELATED ART DOCUMENT

Patent Document

Patent Document 1: Japanese Unexamined Patent Publication No. 2007-215898

DISCLOSURE OF THE INVENTION

Problem that the Invention is to Solve

With the transformable toy described above, although the player can play a shooting game of whether or not to reach the target by causing the toy to roll towards the target point, the toy can provide only a limited number of ways of playing, and hence, transformable toys have been desired with which players can enjoy playing for more fun.

Means for Solving the Problem

According to the invention of this patent application, there is provided a transformable toy which is transformable from a first form which represents a folded state to a second form in which the form of a character appears from the first form, the transformable toy being characterized by comprising a plurality of character constituting members which are connected rotatably to each other, elastic members which are disposed individually between the character constituting members, a roulette wheel of which a roulette pan is detachably attached to any of the character constituting members, a rotating mechanism which rotates the roulette pan, a locking means for maintaining a state in which the plurality of character constituting members are folded, and a release control portion which releases the locking by the locking means, and characterized in that the plurality of character constituting members are configured so as to be folded into the first form when folding operations are performed in accordance with a folding procedure, in that the folding operations performed on the plurality of character constituting members are performed against elastic forces of the corresponding elastic members and compressed states of the elastic members are maintained by the locking means, in that the rotating mechanism comprises an elastic member which is compressed in any of steps of the folding procedure and a means for transmitting rotational motion generated by an elastic force generated when the elastic member is released from a compressed state to the roulette pan, in that when the release control portion is operated, the locking by the locking means is released so that the plurality of character constituting members are allowed to rotate to pop up altogether by elastic forces of the elastic members which are released then so as to be transformed into the second form, whereby the form of the character appears suddenly as if it popped up by the action of a spring, and that the roulette pan is driven to rotate by the elastic force of the elastic member which is released from the compressed state in accordance with the timing at which the form of the character so appears and an indication on the roulette pan when the roulette pan comes to stay still is compared with an indication on a roulette pan of another transformable toy to win or lose a game.

The transformable toy is configured so that when the folding operations are performed in accordance with the folding procedure, the plurality of character constituting members and the rotating mechanism are folded into a substantially flat plate-like form with the elastic members individually kept in a compressed state, and the substantially flat plate-like form into which the plurality of character constituting members are folded is maintained by the locking means.

In addition, according to the invention of this patent application, there is provided a transformable toy as set forth above, characterized in that the character appearing in the second form takes a form imitating a four-legged animal standing on four limbs, in that the plurality of character constituting members include a trunk portion, forelimbs which are attached rotatably to a front of the trunk portion, hind limbs which are attached rotatably to a rear of the trunk portion, and a head portion attached to the front of the trunk portion so as to rotate to the front of the trunk portion, in that the head portion, the forelimbs and the hind limbs are individually disposed in a foldable fashion so that the head portion can be folded onto an upper surface side and a lower surface side of the trunk portion against the elastic force of the elastic member which is disposed to correspond to the head portion and the forelimbs and the hind limes can be folded onto sides of the trunk portion against the elastic forces of the elastic members which are disposed to correspond individually thereto, whereby when so folded, the head portion, the forelimbs and the hind limbs are transformed into the flat plate-like first form, in that the roulette wheel is disposed at a rear portion on an upper surface of the trunk portion and the rotating mechanism is disposed within the trunk portion, and in that when the release control portion is operated, the forelimbs, the hind limbs and the head portion rotate relative to the trunk portion so that an external appearance of the four-legged animal pops up as if by the action of a spring with the forelimbs and the hind limbs stretched downwards and the roulette pan starts to rotate.

Additionally, according to the invention of this patent application, there is provided a transformable toy as set forth above, characterized in that the character appearing in the second form takes a form imitating a winged animal such as a bird, in that the plurality of character constituting members include a trunk portion, a pair of foot portions which are attached rotatably to a lower position of the trunk portion, a pair of wing portions which are attached rotatably to side portions of the trunk portion, and a head portion attached rotatably to an upper portion of the trunk portion, in that the head portion, the trunk portion and the pair of wing portions are individually disposed in a foldable fashion so that the head portion can be folded onto an extension of the trunk portion against the elastic force of the elastic member which is disposed to correspond to the head portion, the trunk portion can be folded in between the pair of foot portions against the elastic forces of the elastic members which are disposed individually between the pair of foot portions and the trunk portion and the pair of wing portions can be folded onto corresponding side portions of the trunk portion against the elastic forces of the elastic members which are disposed to correspond individually to the wing portions, whereby when so folded, the head portion, the trunk portion and the pair of wing portions are transformed into the flat plate-like first form, in that the rotating mechanism is disposed within the trunk portion, in that a rod-like member is disposed on the trunk portion which is disposed thereon so as to move in a vertical direction and of which one end is exposed from the trunk portion so as to support the wing portion and the roulette wheel is disposed at a belly portion of the trunk portion, so that the elastic member which drives to rotate the roulette pan is compressed by pushing the rod-like portion downwards from above, and in that when the release control portion is operated, the trunk portion rotates upwards so as to rise from the pair of foot portions and the wing portions and the head portion rotate individually relative to the trunk portion, so that the form of the winged animal pops up as if by the action of a spring and the roulette pan of the roulette wheel starts to rotate.

In addition, according to the invention of this patent application, there is provided a transformable toy as set forth above, characterized in that the character appearing in the second form takes a form imitating a two-legged animal standing on two hind limbs, in that the plurality of character constituting members include a trunk portion, arm portions which are attached rotatably to a front of the trunk portion, leg portions which are attached rotatably to a rear of the trunk portion and are folded against the elastic forces of the elastic members, foot portions which are attached rotatably to distal ends of the leg portions and are superposed on the leg portions against the elastic forces of the elastic members and a head portion rotatably attached to the front of the trunk portion so as to move towards and be detached from the front of the trunk portion from and towards a distal end of the trunk portion, in that the character constituting members are disposed in a foldable fashion so that the head portion is locked in a position lying close to the trunk portion against the elastic force of the locking releasing elastic member and the arm portions are held by ear flap portions on both sides of the head portion and the foot portions therebetween, whereby when so folded, the character constituting members are transformed into the flat plate-like first form, in that the roulette wheel is disposed at the head portion and the rotating mechanism is disposed within the head portion, and in that when the release control portion is operated, the arm portions, the leg portions and the head portion individually rotate relative to the trunk portion so that an external appearance of the two-legged animal pops up as if by the action of a spring with the folded leg portions stretched so as to allow the two-legged animal to rise by the foot portions and the roulette pan of the roulette wheel starts to rotate.

Additionally, according to the invention of this patent application, there is provided a transformable toy as set forth above, characterized in that the character appearing in the second form takes a form imitating a multi-legged animal, in that the plurality of character constituting members include a trunk portion, a plurality of leg portions which are attached rotatably to the trunk portion and a head portion which is attached to a front of the trunk portion so as to be situated on a front side of the trunk portion, in that the plurality of leg portions are disposed so as to be folded individually onto a lower surface side of the trunk portion against the elastic forces of the elastic members which are disposed between the head portion and themselves, whereby when folded, the leg portions are transformed into the flat plate-like first form, in that the roulette wheel is disposed on an upper surface of the head portion or the trunk portion, the rotating mechanism is disposed within the head portion or the trunk portion where the roulette wheel is disposed and the elastic member of the rotating mechanism is compressed in the folded state, and in that when the release control portion is operated, the plurality of leg portions rotate relative to the trunk portion so that an external appearance of the multi-legged animal pops up as if by the action of a spring and the roulette pan of the roulette wheel starts to rotate.

The compression of the elastic member of the rotating mechanism can be performed while being linked with the folding operation of any of the plurality of character constituting members.

In addition, the rotating mechanism comprises a pinion which transmits rotational motion to the roulette pan, a rack which meshes with the pinion and a sliding member which translates the rack in a straight line, and the elastic member of the rotating mechanism can be compressed by the rack which translates in a straight line while being linked with the translation of the sliding member in any of steps of the folding procedure. In addition, the straight-line translated motion of the sliding member is performed while being linked with the folding operation of any of the plurality of character constituting member.

Further, the transformable toy may comprise further a control member which is disposed so as to slide the sliding member independently of the folding operation, whereby the control member is operated in the second form in which the form of the character appears so as to compress the elastic member of the rotating mechanism, and thereafter, the releasing operation is performed so as to rotate the roulette pan of the roulette wheel.

The rotating mechanism may comprise further a control member for rotating the roulette pan in such a state that the form of the character appears.

Further, according to another aspect of the invention, there is provided a transformable toy characterized by comprising a plurality of character constituting members which are connected rotatably to each other, elastic members which are disposed individually between the character constituting members, a roulette wheel of which a roulette pan is detachably attached to any of the character constituting members, a rotating mechanism which rotates the roulette pan, a locking means for maintaining a state in which the plurality of character constituting members are folded, and a release control portion which releases the locking by the locking means, and characterized in that the plurality of character constituting members are configured so as to be folded into the first form when folding operations are performed in accordance with a folding procedure, in that the folding operations performed on the plurality of character constituting members are performed against elastic forces of the corresponding elastic members and compressed states of the elastic members are maintained by the locking means, in that when the release control portion is operated, the locking by the locking means is released so that the plurality of character constituting members are allowed to rotate to pop up altogether by elastic forces of the elastic members which are released then so as to be transformed into the second form, whereby the form of the character appears suddenly as if it popped up by the action of a spring, and in that the roulette wheel is driven to rotate by operating the rotating mechanism and an indication on the roulette wheel when the roulette wheel comes to stay still is compared with an indication on a roulette wheel of another transformable toy to win or lose a game.

The transformable toy preferably comprises as the roulette wheel a plurality of roulette pans which are prepared so that the roulette pans can detachably be installed on the rotating mechanism.

In addition, the transformable toy can do without the roulette pan and the rotating mechanism by causing the folding operations of the character constituting members on a plurality of rotating shafts against the elastic forces of the elastic members to be a combination of folding operations which are performed in at least two directions of a front-to-rear direction, a left-to-right direction and a vertical direction.

In addition, the transformable toy can do without the roulette pan and the rotating mechanism by causing the folding operations of the character constituting members on a plurality of rotating shafts against the elastic forces of the elastic members to be combination of folding operations which performed in at least one direction of a front-to-rear direction, a left-to-right direction and a vertical direction and a pushing operation.

Additionally, the folding operation in the left-to-right direction is preferably performed laterally symmetrically.

Advantage of the Invention

Since the transformable toy of the invention is momentarily transformed into the form in which the form of the character appears from the first form and the roulette pan is rotated, the players can play by competing against each other to win or lose a game based on indications on the roulette pans or scores obtained, in addition to enjoying the transformation of the toy.

In addition, in the event that the state in which the plurality of character constituting members are folded with the elastic members compressed is made to be maintained by the locking means, the form of the transformable toy can easily and momentarily be transformed and the roulette wheel can be actuated by causing the character constituting members to be deployed by the elastic forces of the elastic members when the locking by the locking means is released.

Additionally, by causing the second form to imitate the four-legged animal, the transformable toy can be transformed into the second form in which the toy can stand stably, in addition to enjoying the transformation of the toy.

Further, by causing the second form to imitate the winged animal, the dramatic change can be given in which the wings of the winged animal are wide opened.

In addition, by causing the second form to imitate the two-legged animal, many transformable toys having forms of different animals can be produced so that players can enjoy battling against transformable toys of different forms of the other players.

Furthermore, by causing the second form to imitate the multi-legged animal, transformable toys having forms of various kinds of animals can be produced so that players can enjoy battling against transformable toys of different forms of the other players.

In the event that the compression of the elastic member of the rotating mechanism is linked with the folding operation of the character constituting member, the elastic member of the rotating mechanism can be compressed in an ensured fashion when the transformable toy is folded into the first form from the second form, and the roulette pan can be rotated at all times when the transformable toy is transformed into the second form from the first form.

In addition, the rotating mechanism employing the rack and the pinion can easily be incorporated in the character constituting member.

Additionally, in the transformable toy which comprises further the control member for sliding the sliding member of the rotating mechanism or the control member for enabling the rotation of the roulette pan, the player can play by rotating the roulette pan in the second form.

Further, in the event that the transformable toy includes the plurality of roulette pans which are prepared as the roulette wheel and are adapted to be installed on the rotating mechanism, the player can enjoy a play which can be modified further.

Additionally, in the event that the folding operations of the character constituting members is caused to be the combination of folding operations which are performed in at least two directions of the front-to-rear direction, the left-to-right direction and the vertical direction, the folding operations become complex, and hence, the players can enjoy a play in which they compete against each other for folding time.

In addition, in the event that the folding operations of the character constituting members is also caused to be a combination of the folding operation which is performed in at least one direction of the front-to-rear direction, the left-to-right direction and the vertical direction and a pushing operation, the folding operations become complex similarly, and hence, the players can enjoy a play in which they compete against each other for folding time.

Additionally, in the event that the folding operation in the left-to-right direction is preferably performed laterally symmetrically, the transformable toy can be transformed largely laterally even with the simple folding operation.

DESCRIPTION OF REFERENCE NUMERALS

Figure 1:
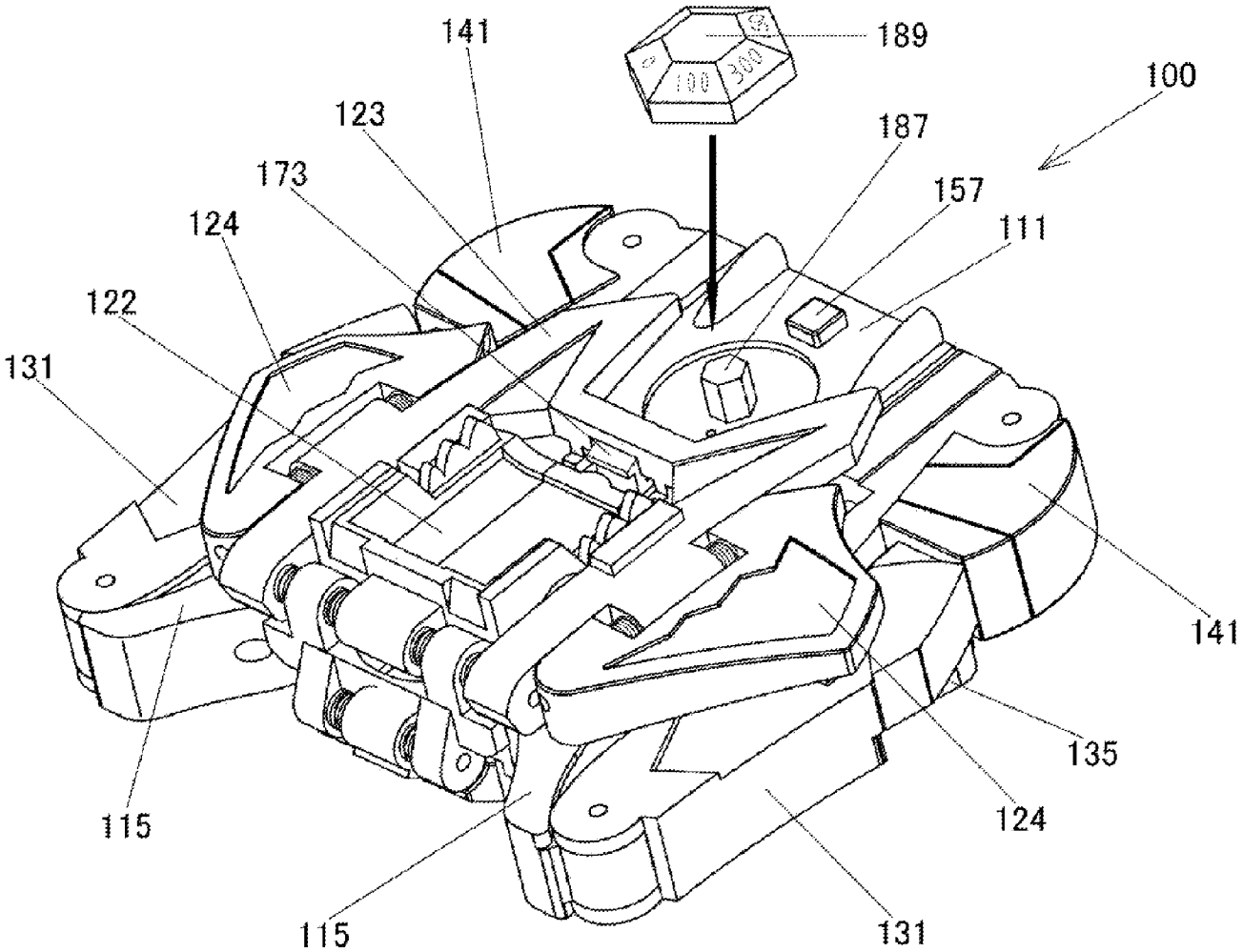
FIG. 1 is a perspective view showing a first form of a first embodiment of a transformable toy according to the invention.

100, 200, 300, 400, 500 transformable toy; 113 trunk side supporting portion; 115 side trunk portion; 116 engagement recess portion; 117 opening portion; 122 upper jaw portion; 123 mane portion; 124 ear flap portion; 125 lower jaw portion; 129 limb fixing projection; 131 forelimb portion; 133 engagement recess; 135 fore claw portion; 141 hind limb portion; 151 tail portion; 155 locking member; 157 release control portion; 159 locking elastic member; 161 sliding member; 162 side wall portion; 163 locking control projection; 164 spring bearing projection; 165 first locking releasing elastic member; 171 movable engagement member; 172 lower jaw fixing projection; 173 upper jaw fixing projection; 174 projecting portion; 175 second locking releasing elastic member; 179 side trunk portion fixing member; 181 rack; 183 acceleration gearwheel; 185 pinion; 187 roulette wheel spindle; 189 roulette pan; 211 trunk portion; 215 recess portion; 217 through groove; 221 head portion; 227 beak portion; 231 wing portion; 233 head portion fixing projection; 235 opening preventive projection; 237 flight feather portion; 241 foot main body portion; 243 toe portion; 245 claw portion; 247 wing tip fixing projection; 251 rump portion; 253 tail feather portion; 255 locking member; 257 release control portion; 259 locking elastic member; 261 sliding member; 263 control member; 265 locking releasing elastic member; 266 wing support arm; 267 trunk portion fixing projection; 269 engagement piece; 281 rack; 283 acceleration gearwheel; 285 pinion; 287 roulette wheel spindle; 289 roulette pan; 291 arm fixing member; 311 trunk portion; 321 head portion; 324 ear flap portion; 325 lower jaw portion; 331 upper arm portion; 333 forearm portion; 335 finger nail; 341 upper leg portion; 343 lower leg portion; 345 foot portion; 346 engagement projecting piece; 351 tail portion; 353 tail end portion; 355 locking member; 357 release control portion; 361 sliding member; 362 side wall portion; 364 spring bearing projection; 365 locking releasing elastic member; 376 head portion locking piece; 377 neck member; 378 foot fixing piece; 381 rack; 383 acceleration gearwheel; 385 pinion; 387 roulette wheel spindle; 389 roulette pan; 411 trunk portion; 421 head portion; 431 upper arm portion; 435 forearm portion; 441 leg portion; 445 foot portion; 489 roulette pan; 495 shoulder armor portion; 496 inner armor portion; 497 outer armor portion; 511 trunk portion; 521 head portion; 523 lower jaw portion; 531 back portion; 533 main movable wing; 535 wing locking projection; 537 auxiliary movable wing; 539 wing rotating shaft; 541 leg portion; 543 leg proximal portion; 551 foot portion; 553 locking projection; 555 fixing projection; 557 accommodation recess portion; 561 release control portion; 562 control button; 563 release projection; 565 locking releasing elastic member; 567 releasing member; 571 locking member; 573 main body portion; 575 locking control portion; 577 fixing and locking portion; 578 locking groove; 581 large gearwheel; 583 acceleration gearwheel; 585 pinion; 587 roulette wheel spindle; 589 roulette pan

MODE FOR CARRYING OUT THE INVENTION

A best mode of a transformable toy according to the invention is a transformable toy 100 which is transformed from a first form in which the transformable toy 100 is folded up into a second form in which a character appears, and the character takes a form imitating a four-legged animal standing on four limbs.

The transformable toy 100 has, as a plurality of character constituting members which are connected rotatably to each other, a trunk portion 111, an upper jaw portion 122 and a lower jaw portion 125 which form a head portion, forelimb portions 131 which constitute forelimbs, hind limb portions 141 which constitute hind limbs, a tail portion 151, and so on. The transformable toy 100 includes rotating elastic members which are disposed individually between the character constituting members, a detachable roulette pan 189 which is mounted rotatably on the trunk portion 111, which is one of the character constituting members, a rotating mechanism which rotates the roulette pan 189 and a locking means for maintaining and releasing a state in which the plurality of character constituting members are folded.

In addition, the rotating mechanism includes a pinion 185 which rotates a roulette wheel spindle 187, a rack 181 which is brought into engagement with the pinion 185 via an acceleration gearwheel 183, a sliding member 161 which translates the rack 181 in a straight line and a locking releasing elastic member 165 which is compressed and stretched while being linked with the straight-line translated motion of the sliding member 161 and is incorporated in the trunk portion 111.

Further, in the character constituting members, the forelimb portions 131 are attached rotatably to a front of the trunk portion 111 via side trunk portions 115. The hind limb portions 141 are attached rotatably to a rear of the trunk portion 111 via the side trunk portions 115. The upper jaw portion 122 and a mane portion 123 are attached to an upper side of the front of the trunk portion 111 and the lower jaw portion 125 is attached rotatably to a lower side of the front of the trunk portion 11. These character constituting members can be folded so that the upper jaw portion 122 and the lower jaw portion 125 which constitute the head portion can be folded onto an upper surface side and a lower surface side of the trunk portion 111 against the elastic forces of the rotating elastic members which are disposed between the character constituting members and that the forelimb portions 131 and the hind limb portions 141 can also be folded onto sides of the trunk portion 111 against the elastic forces of the rotating elastic members which are disposed between the character constituting members. The folding of the character constituting members is performed against the elastic forces of the rotating elastic members, and the first form representing the folded state is a substantially flat plate-like state.

In this first form, the rotating elastic members and the locking releasing elastic member 165 are maintained in compressed states by the locking means. In performing the folding operation, the rack 181 of the rotating mechanism is translated against the elastic force of the locking releasing elastic member 165 when the pushing operation of the sliding member 161 is performed in association with the folding operation of the character constituting members, and the rotating mechanism is locked so that the locking releasing member 165 is maintained in the compressed state in the folded state. When the transformable toy 100 is in the folded state, the release control portion 157 of a locking member 155, which acts as the locking means, protrudes to the outside of the folded transformable toy 100 at the rear of the trunk portion 111, and when the lock releasing button, which is the release control portion 157 protruding to the outside, is operated, the locking by the locking means is released.

Further, the character constituting members which are stretched or opened as a result of the locking by the locking means being released rotate to pop up by virtue of the elastic forces of the rotating elastic members, whereby the forelimb portions 131, the hind limb portions 141 and the head portion rotate individually relative to the trunk portion 111, and an external appearance of the four-legged animal appears suddenly as if it popped up by the action of a spring with the forelimb portions 131 and the hind limb portion 141 stretched downwards, and the transformable toy 100 is transformed into the second form. In addition, the rack 181, which is driven by the elastic force of the locking releasing elastic member 165 which is released from the compressed state at the same time as the external appearance of the character appears as if it popped up by the action of a spring, is translated abruptly, and the pinion fixed to the roulette wheel spindle 187 rotates by the abrupt translated motion of the rack 181, the roulette pan 189 being thereby rotated by the rotation of the pinion.

In addition, a cam projection is provided at an end portion of the tail portion 151 which lies in an interior of the trunk portion 111 so that in the second form which represents the state in which the external appearance of the character appears, the sliding member 161 is slid in such a way that the sliding member 161 is pushed forwards in response to the tail portion 151 being lowered so as to compress the elastic member 165. Then, when the lowering operation of the tail portion 151 is released, the roulette pan 189 rotates.

Embodiments

According to embodiments of the invention, transformable toys are provided which each have a plurality of character constituting members which are connected to each other so as to be transformed from a first form which has a rectangular thick flat plate-like shape having a plurality of projections and recesses as is shown in FIGS. 1 to 4 into a second form which have shapes imitating a four-legged animal standing on four limbs, a bird and two-legged animals standing on two hind limbs as is shown in FIGS. 5 to 8 and which each include a roulette wheel having a roulette pan which is detachably installed on one of the character constituting members of the transformable toy.

As is shown in FIGS. 1 to 9, the transformable toy 100 shown in FIG. 1 which is transformed into a four-legged animal standing on four limbs has a flat hexagonal roulette pan 189 as a roulette wheel at a rear (a right-hand side in the figure) of an upper surface of a trunk portion 111 which has a shape resembling a thick quadrangular shape so as to be detachably installed on a roulette wheel spindle 187. At the rear of this roulette pan 189, a lock releasing button, which is a release control portion 157 for a locking member 155 (refer to FIGS. 11 and 12) which is accommodated in the trunk portion 111 as a locking means, is provided on the upper surface of the trunk portion 11 so as to project therefrom.

Figure 5:
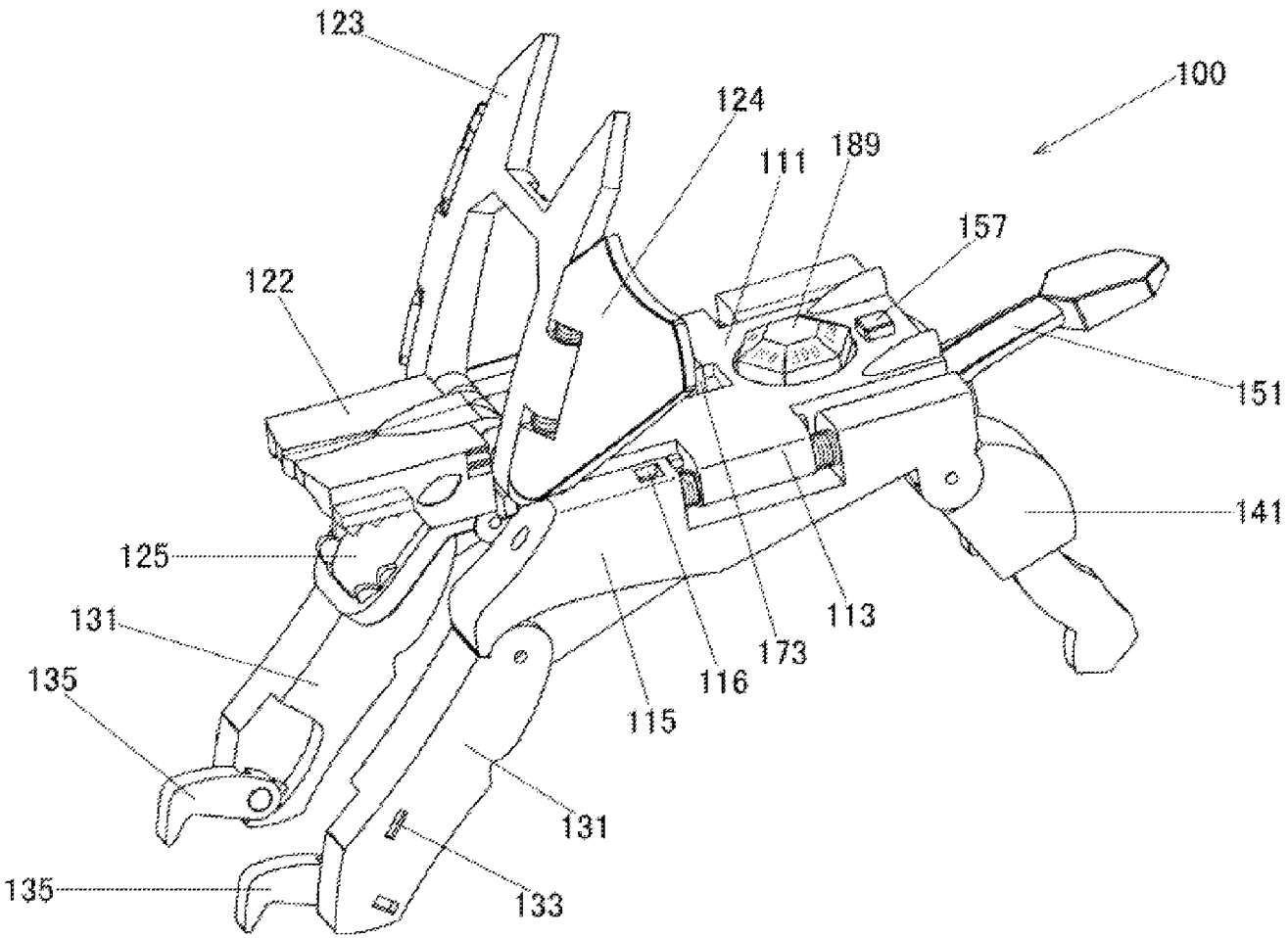
FIG. 5 is a perspective view showing a second form of the first embodiment of the transformable toy according to the invention.

Further, the transformable toy 100 has an upper jaw portion 122, a lower jaw portion 125 and a mane portion 123 which are character constituting members which form a head portion as is shown in FIG. 5 at a front (a left-hand side in the figure) of the trunk portion 111 which is the character constituting member. The upper jaw portion 122, which is substantially rectangular and is attached rotatably to a position lying above the front of the trunk portion 111 via a rotational shaft including a rotating elastic member, and the mane portion 123, which is formed so as to surround the upper jaw portion 122, are superposed onto an upper side of the front of the trunk portion 111 against an elastic force of the rotating elastic member in a folded state shown in FIG. 1. Ear flap portions 124 are attached to the mane portion 123 on left- and right-hand sides (upper and lower sides in the figure) of the mane portion 123 via rotational shafts including rotating elastic members.

Figure 9:
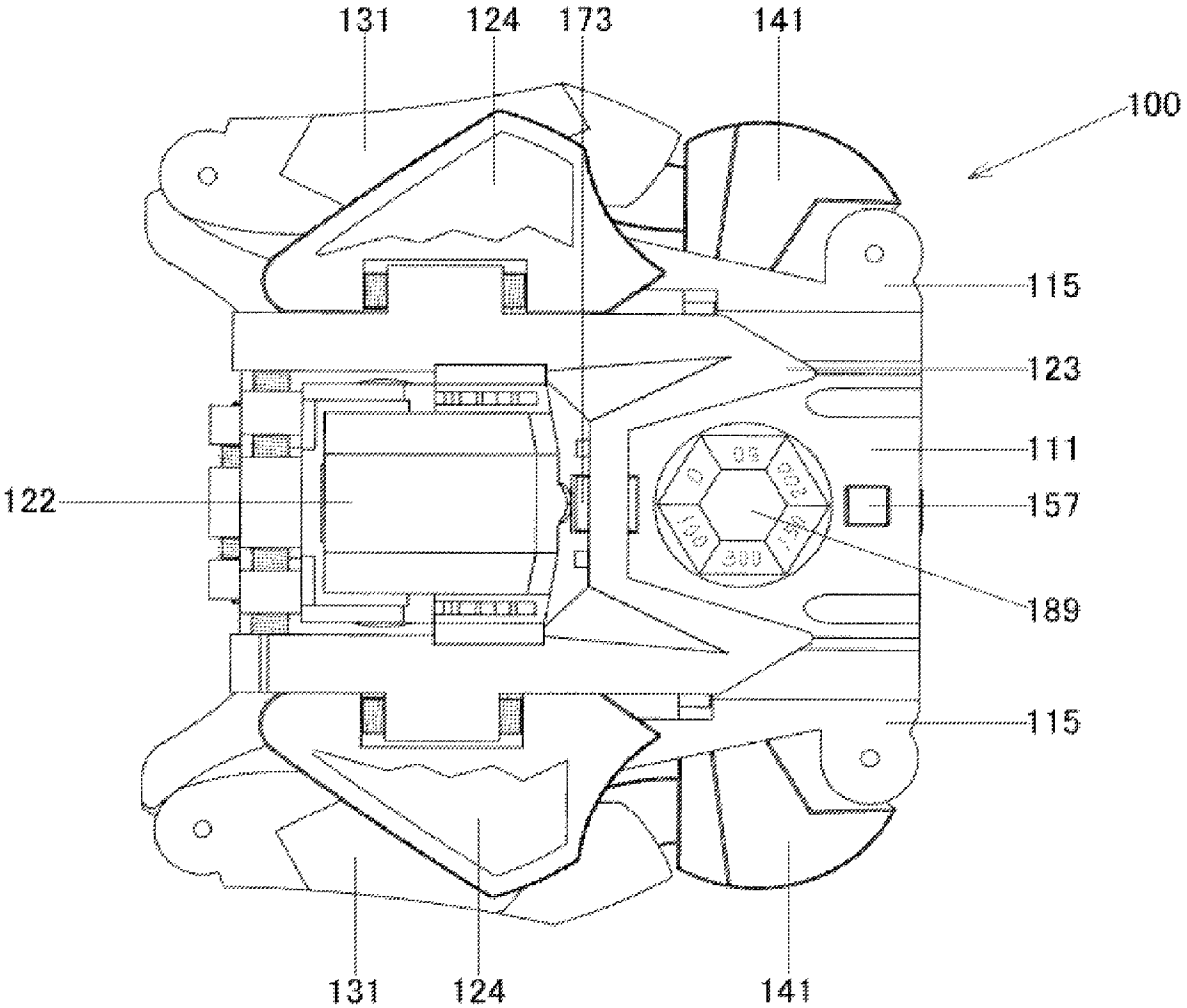
FIG. 9 is a top view showing the first form of the first embodiment of the transformable toy according to the invention.

Namely, as is shown in FIGS. 1 and 9, this upper jaw portion 122 is attached to the vicinity of an upper end of the front of the trunk portion 111 by the rotational shaft, and the upper jaw portion 122 is biased by the rotating elastic member so as to be rotated to the front of the trunk portion 111. The mane portion 123 is also attached to the vicinity of the upper end of the front of the trunk portion 111 by the rotational shaft and is biased by the rotating elastic member which is wound round the rotational shaft so as to rotate the upper jaw portion 122 to the front of the trunk portion 111. The ear lap portions 124 are biased so as to be rotated rearwards of the mane portion 123 (in the direction of the trunk portion 111 in the figure) by the rotating elastic members which are wound round the rotational shafts via which the ear lap portions 124 are attached to the mane portion 123.

Side trunk portions 115, forelimb portions 131 and hind limb portions 141, which are character constituting members, are provided on left- and right-hand sides of the trunk portion 111 below the ear flap portions 124 on both sides of the trunk portion 111. As is shown in a bottom view in FIG. 10, the side trunk portions 115 are attached to corresponding trunk side supporting members 113 which are provided at central portions on both sides of the trunk portion 111 via rotational shafts which include rotating elastic members. Further, the hind limb portions 141 are attached to the vicinity of rear ends (a right-hand side of the figure) of the side trunk portions 115 via rotational shafts which include rotating elastic members and are folded onto outer sides of the side trunk portions 115. In addition, the forelimb portions 131 which are folded onto outer sides of the corresponding hind limb portions 141 are attached to the vicinity of front ends of the side trunk portions 115 via rotational shafts including rotating elastic members. Thus, the forelimb portions 131 which form the forelimbs and the hind limb portions 141 which form the hind limbs are attached to the trunk portion 111 via the side trunk portions 115 in the way described above.

This side trunk portion 115 is formed into a substantially rod shape which is equal in length to the trunk portion 111 and is biased by the rotating elastic member which is wound round the rotational shaft so as to rotate the forelimb portion 131 and the hind limb portion 141 downwards around the rotational shaft relative to the trunk side supporting portion 113 which is provided at the central portion on one side of the trunk portion 111. In the second form in which the four legged animal stands on the four limbs shown in FIG. 5, the side trunk portions 115 have engagement recess portions 116 formed in upper surfaces thereof which maintain the first portion the forelimb portions 131 and the hind limb portions 141 are oriented leftwards and rightwards.

In addition, the forelimb portion 131 is attached rotatably to the vicinity of the front end of the side trunk portion 115 by the rotational shaft and is biased by the rotating elastic member which is wound round the rotational shaft at a proximal side thereof so as to rotate a distal end of the forelimb portion 131 to an outer side of the side trunk portion 115. Further, the forelimb portion 131 has a fore claw portion 135 at a distal end thereof via a rotational shaft including a rotating elastic member. The hind limb portion 141 is also attached rotatably to the vicinity of the rear end of the side trunk portion 115 at a proximal portion thereof by the rotational shaft and is biased by the rotating elastic member which is wound round the rotational shaft so that a distal end of the hind limb portion 141 is rotated to an outer side thereof.

Figure 10:
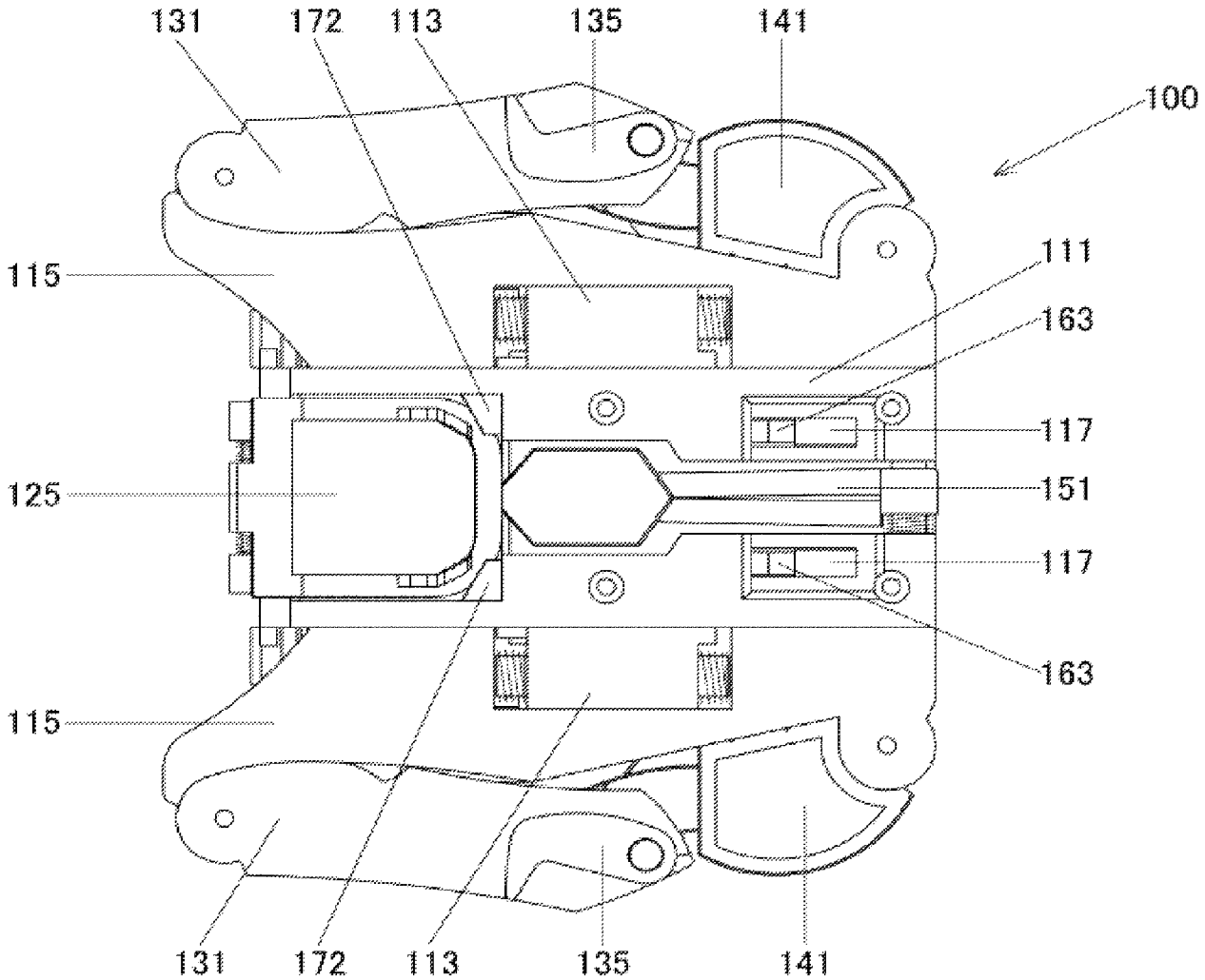
FIG. 10 is a bottom view showing the first form of the first embodiment of the transformable toy according to the invention.

Further, as is shown in FIG. 10, a tail portion 151 is superposed on a lower surface of the trunk portion 111. This tail portion 151 is a character constituting member which is attached to a central position of a rear end of the trunk portion 111 via a rotational shaft including a rotating elastic member. The lower jaw portion 125, which is attached to a front end of the trunk portion 111 via the rotational shaft including the rotating elastic member, is folded onto the lower surface of the trunk portion 111 so as to be superposed on a distal end of the tail portion 151 at a distal end (a right-hand side in the figure) thereof.

This tail portion 151 has a substantially cylindrical rod shape and is attached rotatably to a lower side of the rear end of the trunk portion at a proximal portion thereof by the rotational shaft. The tail portion 151 is biased so as to be rotated to the rear of the trunk portion 111 by the rotating elastic member which is wound round the rotational shaft. The tail portion 151 is folded to the lower side of the trunk portion 111 with a distal end thereof inserted into underneath the lower jaw portion 125. The lower jaw portion 125 is attached to the front of the trunk portion 111 at a proximal portion thereof by the rotational shaft so as to be rotated to the lower side of the front of the trunk portion 111 and is biased by the rotating elastic member which is wound round the rotational shaft so that a distal end thereof is rotated to the front. The lower jaw portion 125 is thus folded into a lower jaw recess for accommodation therein.

Then, distal ends of lower jaw fixing projections 172 which are provided below a front of a movable engagement member 171 (refer to FIGS. 11 and 13) which is provided within the trunk portion 111 project into the lower jaw recess, whereby both side portions of the distal end of the lower jaw portion 125 which is accommodated in the lower jaw recess are locked, and the state is maintained in which the lower jaw portion 125 is folded onto the lower surface of the trunk portion 111.

In addition, as is shown in FIG. 10, locking control projections 163, which can slide back and forth along corresponding opening portions 117, project slightly at both sides of the rear of the trunk portion 111. The locking control projections 163 are formed on a sliding member 161, which will be described later, (refer to FIGS. 11 and 12). When positioned at the front (a left-hand side in the figures), the locking control projections 163 can lock the character constituting members in the first form against the elastic forces of the rotating elastic members.

Figure 11:
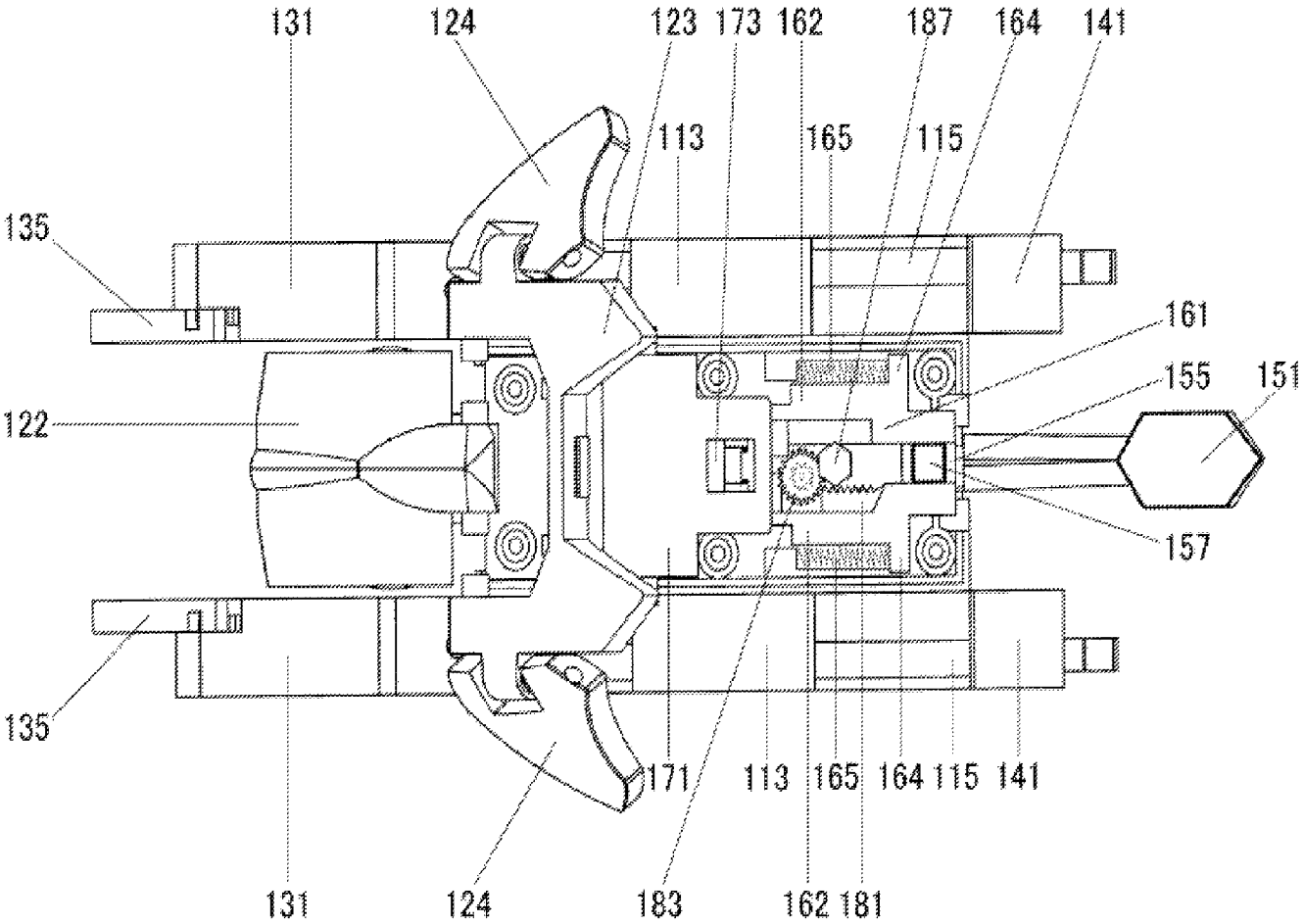
FIG. 11 is a top view showing an interior of a trunk portion of the first embodiment of the transformable toy according to the invention.

As is shown in FIG. 11, the movable engagement member 171 and the sliding member 161 are incorporated in an interior of the trunk portion 111 so as to move in a front-to-rear direction of the trunk portion 111.

Figure 12:
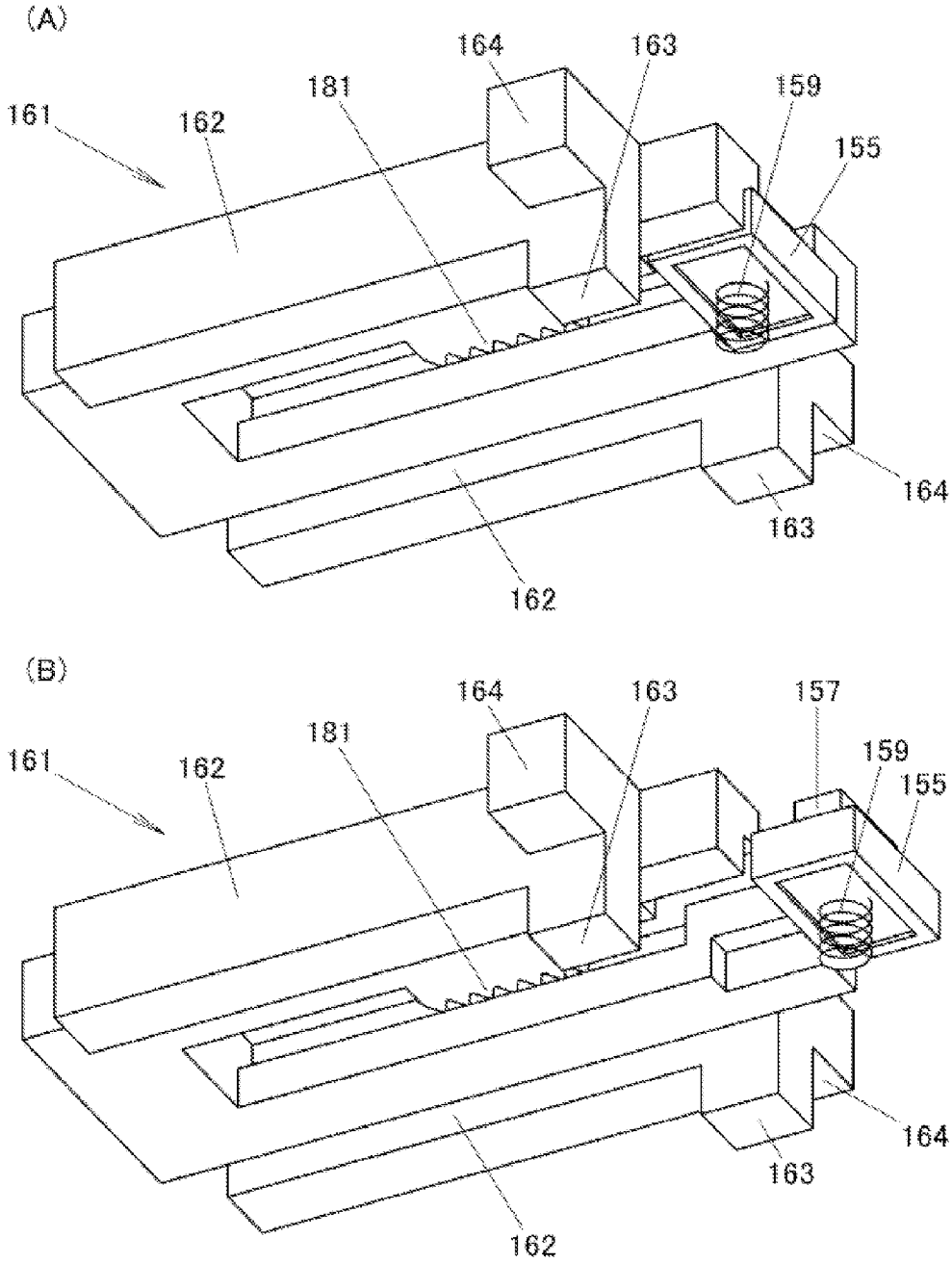
FIG. 12 shows lower side views showing a sliding member which is accommodated in the interior of the trunk portion of the first embodiment of the transformable toy according to the invention.

This sliding member 161 constitutes the rotating mechanism together with first locking releasing elastic members 165, which will be described later, and a rack 181 and a pinion 185. As is shown in FIGS. 11 and 12, the sliding member 161 has left and right parallel thick plate-like side wall portions 162 which extend in the front-to-rear direction while holding therebetween a locking member 155 which functions as a locking means which includes a lock releasing button which is a release control portion 157 at a rear thereof. The sliding member 161 also has a thick plate-like connecting wall portion which connects together front ends of both the side wall portions 162.

Further, the sliding member 161 has the locking control projections 163 on lower sides of rear ends of the side wall portions 162, and distal ends of the locking control projections 163 are caused to project slightly further outwards and downwards than a lower surface of the trunk portion 111 from the corresponding opening portions 117 which are provided in the lower surface of the trunk portion 111, as is shown in FIG. 10.

In addition, the sliding member 161 has spring bearing projections 164 on outer sides of the side wall portions 162 so as to project from the corresponding side wall portions 162. As is shown in FIG. 11, the sliding member 161 is biased to the rear relative to the trunk portion 111 by the first locking releasing elastic members 165.

Further, the rectangular plate-like locking member 155 acting as the locking means is disposed at the rear of the sliding member 161, and this locking member 155 has the lock releasing button as the release control portion 157 which projects from an upper surface thereof. In such a state that the sliding member 161 is positioned rearwards as is shown in FIG. 11, the locking member 155 is inserted into locking member supporting grooves formed in lower surfaces of rear portions of the side wall portions 162 at a main body portion thereof as is shown in FIG. 12(A), and the lock releasing button which is the release control portion 157 is positioned between the side wall portions 162 of the sliding member 161, whereby the locking member 155 itself is pushed upwards from the lower side of the trunk portion 111 by a locking elastic member 159.

A rear end face of the locking member 155 is brought into abutment with a rear wall of an inner cavity in the trunk portion 111, and as is shown in FIG. 12(B), when the sliding member 161 is translated to the front, the locking member 155 comes out of the locking member supporting grooves to rise and is then held between the rear of the sliding member 161 and the rear wall of the inner cavity in the trunk portion 111, whereby an upper end of the release control portion 157 provided on the upper surface of the locking member 155 is caused to slightly project from the upper surface of the trunk portion 111.

Consequently, when the sliding member 161 is translated to a front position by using he locking control projections 163 which project from the lower surface of the trunk portion 111, the locking member 155 rises to be positioned at the rear of the sliding member 161, and rear ends of the side wall portions 162 of the sliding member 161 are brought into contact with a front surface of the locking member 155 so as to bring the first locking releasing elastic members 165 into the compressed state. Then, the locking member 155 is held between the sliding member 161 and the rear wall of the inner cavity in the trunk portion 111 with the upper surface thereof kept in contact with an upper surface of the inner cavity in the trunk portion 111 by the locking elastic member 159 which is disposed underneath the locking member 155.

In addition, this sliding member 161 has the rack 181 on an inner side of one of the side wall portions 162. Further, as is shown in FIG. 11, the sliding member 161 has an acceleration gearwheel 183 between the side wall portions 162 thereof, and this acceleration gearwheel 183 is mounted on the trunk portion 111 so as to be disposed inside the sliding member 161. Then, as is shown in FIG. 11, when the siding member 161 is positioned rearwards, the rack 181 is positioned rearwards of the acceleration gearwheel 183 and is spaced apart from a small gearwheel of the acceleration gearwheel 183. However, as is shown in a lower side view of FIG. 13 which shows an interior construction of the trunk portion 111, when the sliding member 161 is positioned forwards, the small gearwheel and the rack 181 mesh with each other, and a large gearwheel of the acceleration gearwheel 183 meshes with the pinion 185 which is fixed to the roulette wheel spindle 187 which is mounted in the trunk portion 111.

The invention is not limited to the case where the rack 181 and the pinion 185 mesh with each other via the acceleration gearwheel 183, and hence, there may be adopted a case where the rack 181 is brought into direct mesh engagement with the pinion 185 of the roulette wheel spindle 187 with the acceleration gearwheel 183 omitted and the mesh engagement between the rack 181 and the pinion 185 is disengaged when the sliding member 161 is translated to the rear or a case where the rack 181 and the pinion 185 are brought into mesh engagement with each other while adjusting the positions of the rack 181 and the pinion 185 by using one or two normal spur gears as intermediate gearwheels without using the acceleration gearwheel 183 which has the large diameter portion and the small diameter portion.

The movable engagement member 171 which is disposed at the front of the sliding member 161 has a rectangular thick plate-like shape which extends over substantially an overall width of the inner cavity in the trunk portion 111 and is biased to the rear by second locking releasing elastic members 175 which are disposed on a lower side of a front portion thereof. The movable engagement member 171 includes a sliding member contact portion which is brought into contact with a front end of the sliding member 161.

Consequently, when the sliding member 161 is positioned forwards, the movable engagement member 171 is translated forwards as a result of the sliding member contact portion which is provided on a lower surface of the movable engagement member 171 being pushed by a front end of a connecting wall of the sliding member 161. When the sliding member 161 is positioned rearwards, the movable engagement member 171 is translated rearwards by the second locking releasing elastic members 175.

Figure 13:
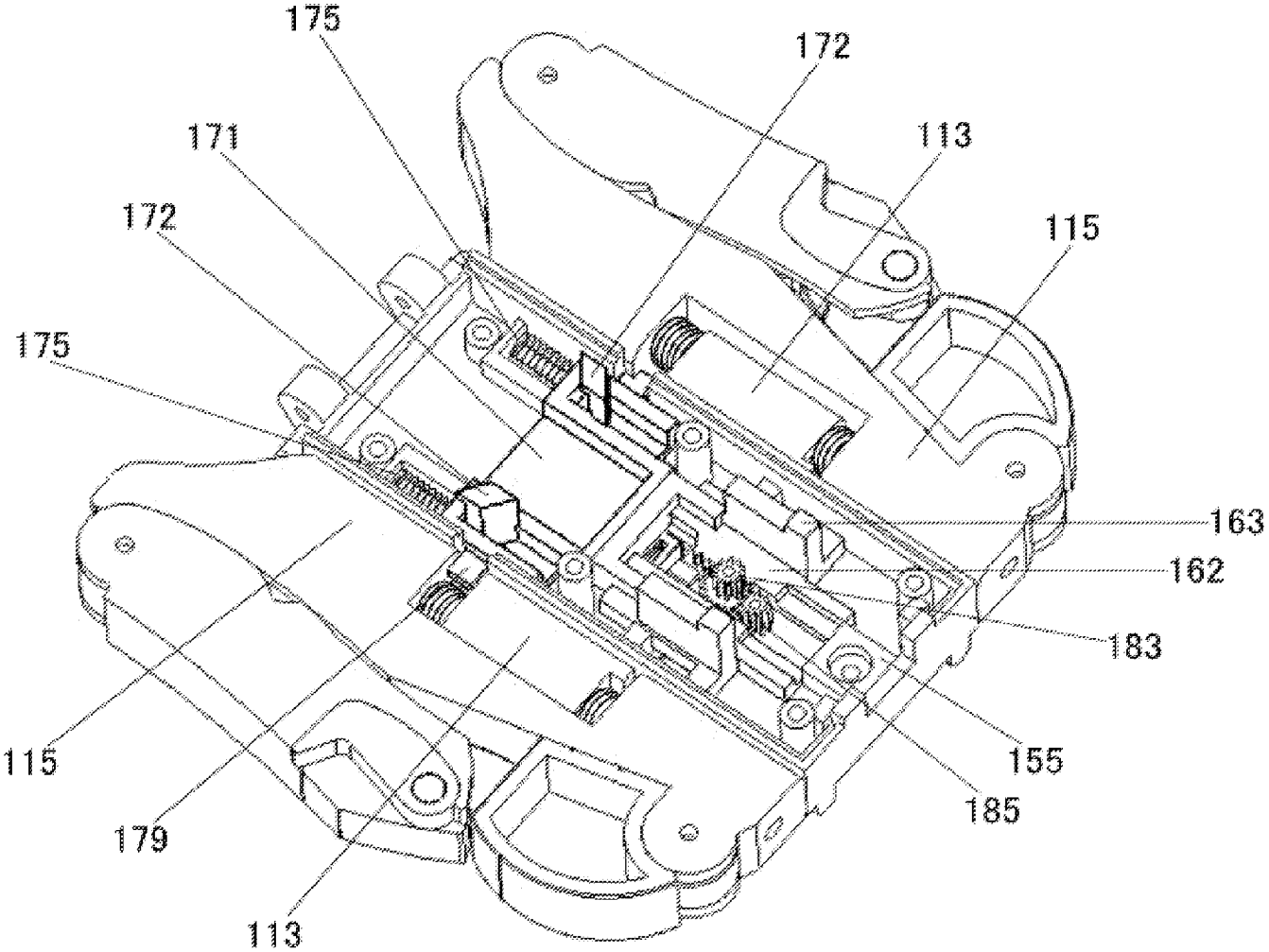
FIG. 13 is a lower side view showing the interior of the trunk portion of the first embodiment of the transformable toy according to the invention.

In addition, as is shown in the lower surface view of FIG. 13, the movable engagement member 171 has the lower jaw fixing projections 172 on left- and right-hand sides of a lower surface of a front portion thereof, and the lower jaw fixing projections 172 has projecting portions which project to the front at distal ends thereof. When the movable engagement member 171 is positioned forwards, front portions of the projecting portions project into the lower jaw recess in the lower surface of the trunk portion 111 as is shown in FIG. 10 so as to lock the distal end of the lower jaw portion 125.

Further, this movable engagement member 171 has side trunk portion fixing members 179 which can project to sides of the trunk portion 111 at distal ends thereof and which are accommodated in left- and right-hand side positions in an interior thereof. These side trunk portion fixing members 179 can slide in a left-to-right direction relative to the trunk portion 111. The side trunk portion fixing members 179 change their moving direction laterally by inclined grooves or the like in association with a translation of the movable engagement member 171 in the front-to-rear direction to slide in the left-to-right direction with respect to the trunk portion 111. Then, by a forward translation of the sliding member 161, the distal ends of the side trunk fixing members 179 are caused to project to the left and right of the trunk portion 111 so as to be brought into engagement with engagement recess portions 116 formed in the side trunk portions 115. In contrast, the side trunk portion fixing member 179 is translated inwards of the movable engagement member 171 in association with a withdrawal of the sliding member 161 and is then accommodated in a position where the distal ends thereof do not so project.

Figure 14:
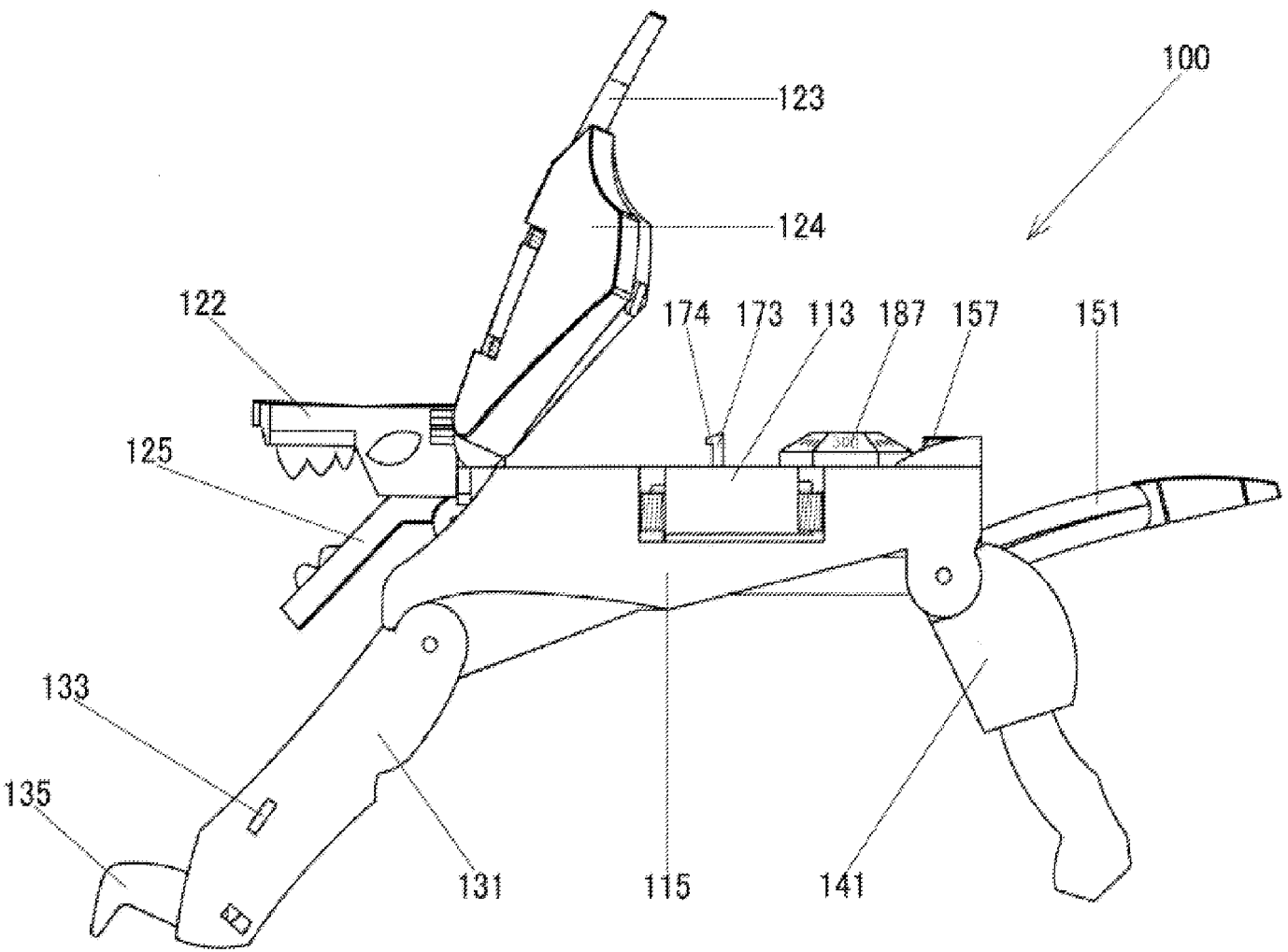
FIG. 14 is a side view showing the second form of the first embodiment of the transformable toy according to the invention.

As is shown in FIGS. 11 and 14, the movable engagement member 171 has an upper jaw fixing member 173 in an upper surface thereof which projects from the upper surface of the trunk portion 111. This upper jaw fixing member 173 can swing on a lower end as a rotational axis to the rear at an upper end thereof so as to be fixed to the movable engagement member 171 and is biased to the front by a locking elastic member to be attached to the movable engagement member 171 so as to be maintained substantially normal.

As is shown in FIG. 14, this upper jaw fixing member 173 has a projecting portion 174 which projects to the front at a distal end thereof, and a front upper surface at the distal end is made into an inclined surface. When the inclined surface is pressed from thereabove, the distal end of the upper jaw fixing member 173 can be rotated to the rear. In addition, when the upper jaw fixing member 173 is biased by the locking elastic member to be kept in the normal state, the projecting portion 174 which projects to the front is superposed on the upper jaw portion 122 so as to lock the upper jaw portion 122.

Then, in the first form shown in FIG. 1 and the like, the sliding member 161 and the movable engagement member 171 are positioned forwards in the interior of the trunk portion 111 and their forward position is maintained by the locking member 155. The lower jaw fixing projections 172 of the movable engagement member 171 project from the lower surface of the trunk portion 111 and prevent the rotation of the lower jaw portion 125. In addition, the lower jaw portion 125 fastens the distal end of the tail portion 151 and prevents the rotation of the tail portion 151. The distal ends of the side trunk portion fixing members 179 which project from the sides of the trunk portion 111 are inserted into the engagement recess portions 116 in the side trunk portions 115 and prevent the rotation of the side trunk portions 115.

In addition, the upper jaw fixing member 173 which is provided in the upper surface of the movable engagement member 171 is also positioned forwards and is brought into engagement with the upper jaw portion 122 so as to prevent the rotation of the upper jaw portion 122. The engagement of the upper jaw fixing member 173 with the upper jaw portion 122 also fastens the mane portion 123 by side portions of the upper jaw portion 122 to prevent the rotation of the mane portion 123. Then, limb fixing projections 129 which are provided on lower surfaces of the ear flap portions 124, which will be described later, are brought into engagement with engagement recesses 133 in the forelimb portions 131 which are positioned below the ear lap portions 124 and prevent the forelimb portions 131 from rotating to open. Then, the forelimb portions 131 prevent, in turn, the hind limb portions 141 which are folded into the inside of the forelimb portions 131 from rotating to open.

The transformable toy 100 is placed on a flat surface such as a base table or a desk with the roulette pan 189 provided on the upper surface of the trunk portion 111 oriented upwards in such a state that the character constituting members such as the upper jaw portion 122 and the lower jaw portion 125 and the mane portion 123 which form the head portion at the front of the trunk portion 111 and the tail portion 151, the forelimb portions 131 and the hind limb portions 141 are folded in the way described above. Then, when the lock releasing button is pressed downwards by the finger tip or the like, the locking member 155 is lowered, and the locking member 155 is inserted into the locking member supporting grooves in the sliding member 161. Then, the sliding member 161 is withdrawn by the stretching of the first locking releasing elastic members 165 so that the rears of the side wall portions 162 of the sliding member 161 are inserted between the locking member 155 and the upper surface of the inner cavity in the trunk portion 111, and as is shown in FIG. 11, the rear end of the sliding member 161 is brought into abutment with the rear end of the inner cavity in the trunk portion 111.

Then, the roulette wheel spindle 187 on which the pinion 185 is mounted is rotated via the acceleration gearwheel 183 via the rack 181 provided on the sliding member 161 by the withdrawal of the sliding member 161, whereby the roulette pan 189 can be rotated.

Further, when the sliding member 161 is positioned at the rear of the trunk portion 111 by the first locking releasing elastic members 165, the engagement of the rack 181 with the acceleration gearwheel 183 is disengaged, and the roulette pan 189 continues rotating. The rotation speed of the roulette pan 189 decreases by the rotational friction of the roulette wheel spindle 187, whereby the roulette pan 189 stops rotating in a position which is not determined.

In addition, the movable engagement member 171 is withdrawn by the second locking releasing members 175 as a result of the withdrawal of the sliding member 161, and the engagement of the lower jaw fixing members 172 with the lower jaw portion 125 is disengaged. Additionally, the upper jaw fixing member 173 mounted in the upper surface of the movable engagement member 171 is shifted to the rear of the trunk portion 111, whereby the engagement with the upper jaw portion 122 is disengaged, and the side trunk portion fixing members 179 are also withdrawn so as to be accommodated inside the trunk portion 111, the engagement with the side trunk portions 115 being thereby disengaged.

Then, since the upper jaw portion 122 is attached to the front end of the trunk portion 111 via the rotational shaft which includes the rotating elastic member, when the upper jaw portion 122 is released from the upper jaw fixing member 173, the upper jaw portion 122 is rotated to the front by the rotating elastic member so as to be positioned at the front of the trunk portion 111. In addition, the mane portion 123 which is fastened by the upper jaw portion 122 is also rotated so as to rise at a rear end thereof to thereby rise as is shown in FIGS. 14 and 15 by the rotation of the upper jaw portion 122, whereby the ear flap portions 124 which are provided at the left- and right-hand sides of the mane portion 123 are rotated slightly to the rear relative to the mane portion 123.

Figure 15:
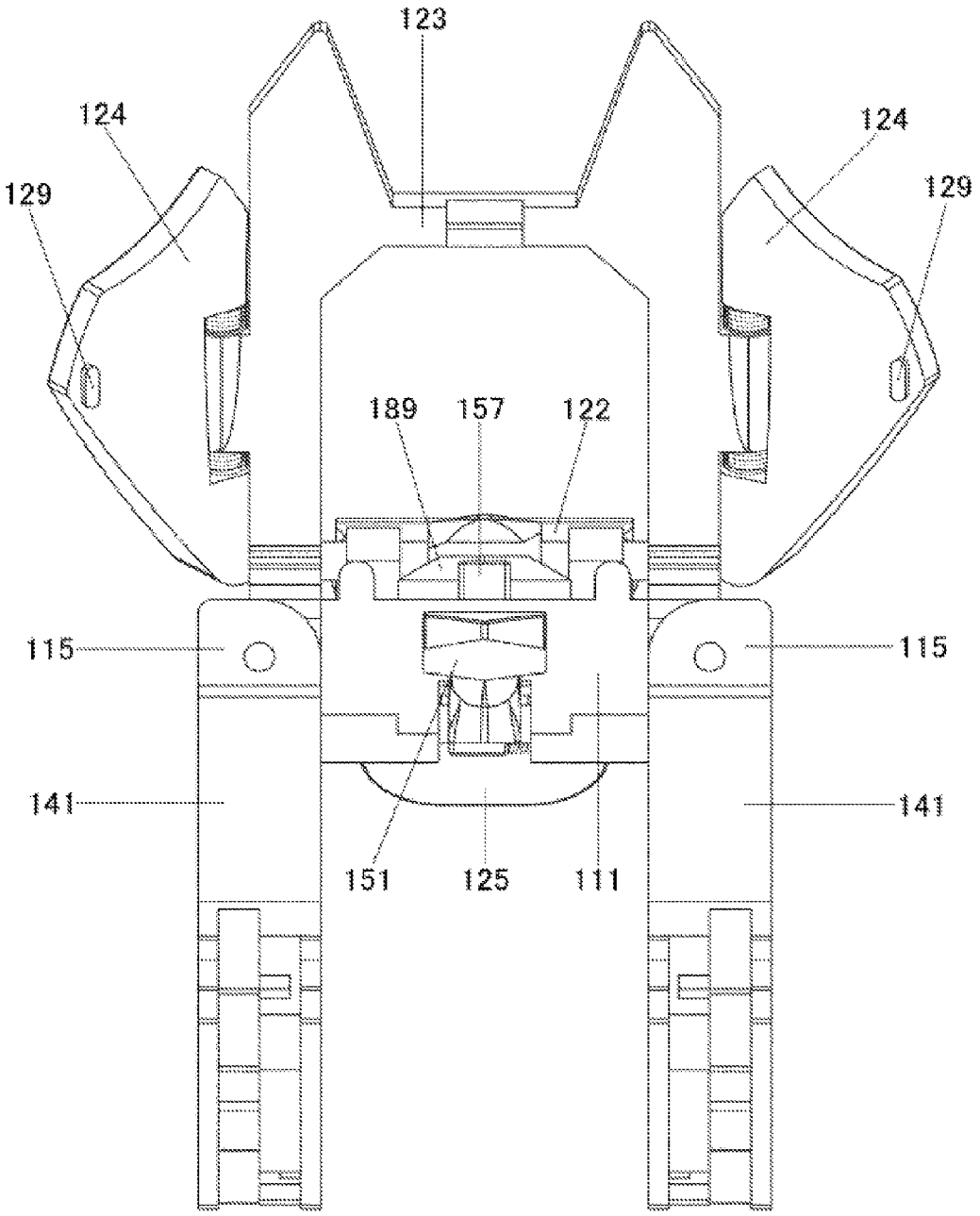
FIG. 15 is a rear view showing the second form of the first embodiment of the transformable toy according to the invention.

Further, as is shown in FIG. 15, the limb fixing projections 129 are provided on the back sides of the ear flap portions 124, and the limb fixing projections 129 come out of the engagement recesses 133 in the forelimb portions 131 shown in FIG. 14 as a result of the mane portion 123 so rising, whereby the forelimb portions 131 rotate outwards on front ends of the side trunk portions 115 as rotation centers, and the hind limb portions 141 which are fastened by the forelimb portions 131 also rotate outwards on rear ends of the side trunk portions 115 by the rotation of the forelimb portions 131.

Then, when the upper jaw portion 122, the mane portion 123, the forelimb portions 131 and the hind limb portions 141 start to rotate, the side trunk portions 115 which are now disengaged from the side trunk portion fixing members 179 rotate about the corresponding trunk side supporting portions 113 so that the forelimb portions 131 and the hind limb portions 141 are oriented downwards. Then, the trunk portion 111 is lifted up in association with the movements of the forelimb portions 131 and the hind limb portions 141 which are opened. The lower jaw portion 125 which is now disengaged rotates to the front of the trunk portion 111, and the tail portion 151 which is fastened at the distal end thereof by the lower jaw portion 125 is rotated to the rear, whereby the transformable toy 100 is transformed into the second form shown in FIG. 5 and the like.

When attempting to transform the transformable toy 100 from the second form to the first form, the transformable toy 100 is turned bottom side up, and the right-hand side trunk portion 115 is rotated so as to open the right-hand fore and hind limb portions 131, 141 to the right, while the left-hand side trunk portion 115 is rotated so as to open the left-hand fore and hind limb portions 131, 141 to the left, so that the four limbs are stretched horizontally. With the four limbs so stretched, the tail portion 151 is folded to the front so as to be superposed on the trunk portion 111. Thereafter, the lower jaw portion 125 is also folded to the rear so as to be superposed on the trunk portion 111 and thereby the distal end of the tail portion 151 is fastened by the distal end of the lower jaw portion 125. Then, the locking control projections 163 are shifted to the front so as to push the sliding member 161 and the movable engagement portion 171 to the front while compressing the first locking releasing elastic members 165 and the second locking releasing elastic members 175 to thereby lock the side trunk portions 115 and the lower jaw portion 125.

Thereafter, the transformable toy 100 is turned bottom side down, and the left- and right-hand hind limb portions 141 are folded onto the outer sides of the side trunk portions 115. Then, the left- and right-hand forelimb portions 131 are folded onto the outer sides of the hind limb portions 141. Thus, the hind limb portions 141 and the forelimb portions 131 are folded from the left and right so that the hind limb portions 141 are fastened by the forelimb portions 131. Then, the limb fixing projections 129 formed on the rear surfaces of the ear flap portions 124 which are provided at the left- and right-hand sides of the mane portion 123 are brought into engagement with the engagement recesses 133 formed in the forelimb portions 131 so that the mane portion 123 is pressed against the upper surface of the trunk portion 111 to thereby lock the forelimb portions 131, and the upper jaw portion 122 is rotated so as to be superposed on the upper surface of the trunk portion 111 and is pressed against the upper surface of the trunk portion 111. Then, the distal end of the upper jaw portion 122 is brought into engagement with a lower side of the projecting portion 174 of the upper jaw fixing member 173 so as to swing the upper end of the upper jaw fixing member 173 to the rear, whereby the transformable toy 100 can be transformed into the first form shown in FIG. 1 and the like.

In this way, the transformable toy 100 standing on the four limbs can be transformed into the first form by following the folding procedure; the fore and hind limb portions 131, 141 are stretched or opened to the left and right with the transformable toy 100 turned bottom side up, the locking control projections 163 are shifted to the front in such a state that the tail portion 151 and the lower jaw portion 125 are folded by rotating the tail portion 151 to the front and rotating the lower jaw portion 125 to the rear, the transformable toy 100 is turned upside up and the hind limb portions 141 which are opened to the left and right are rotated to the front and are then folded onto the sides of the trunk portion 111 from the left and right, thereafter, the forelimb portions 131 which are opened to the left and right are rotated to the rear and are folded onto the sides of the trunk portion 111 from the left and right, and the mane portion 123 is rotated to the rear and the upper jaw portion 122 is then rotated to the rear so that the mane portion 123 and the upper jaw portion 122 are folded.

In this folding operation, the character constituting members to be folded are rotated individually to predetermined positions in an ensured fashion without damaging the character constituting members and against the elastic forces of the rotating elastic members so that the character constituting members are locked to each other. Therefore, the skill to fold them quickly is necessary.

When the transformable toy is caused to take the form of the four legged animal standing on four limbs, the invention is not limited to the form shown in figures which allows the player to image an animal which really exists. Four legged animals which are now extinct or imaginary animals can be adopted. In addition, a multi-legged animal such as a six-legged animal or eight-legged animal can be adopted by attaching rotatably auxiliary limbs to the side trunk portions 115 between the forelimb portions 131 and the hind limb portions 141 by rotational shafts including rotating elastic members, and as this occurs, the multi-legged animal stands on four limbs such as foremost limbs and hindmost limbs.

Figure 2:
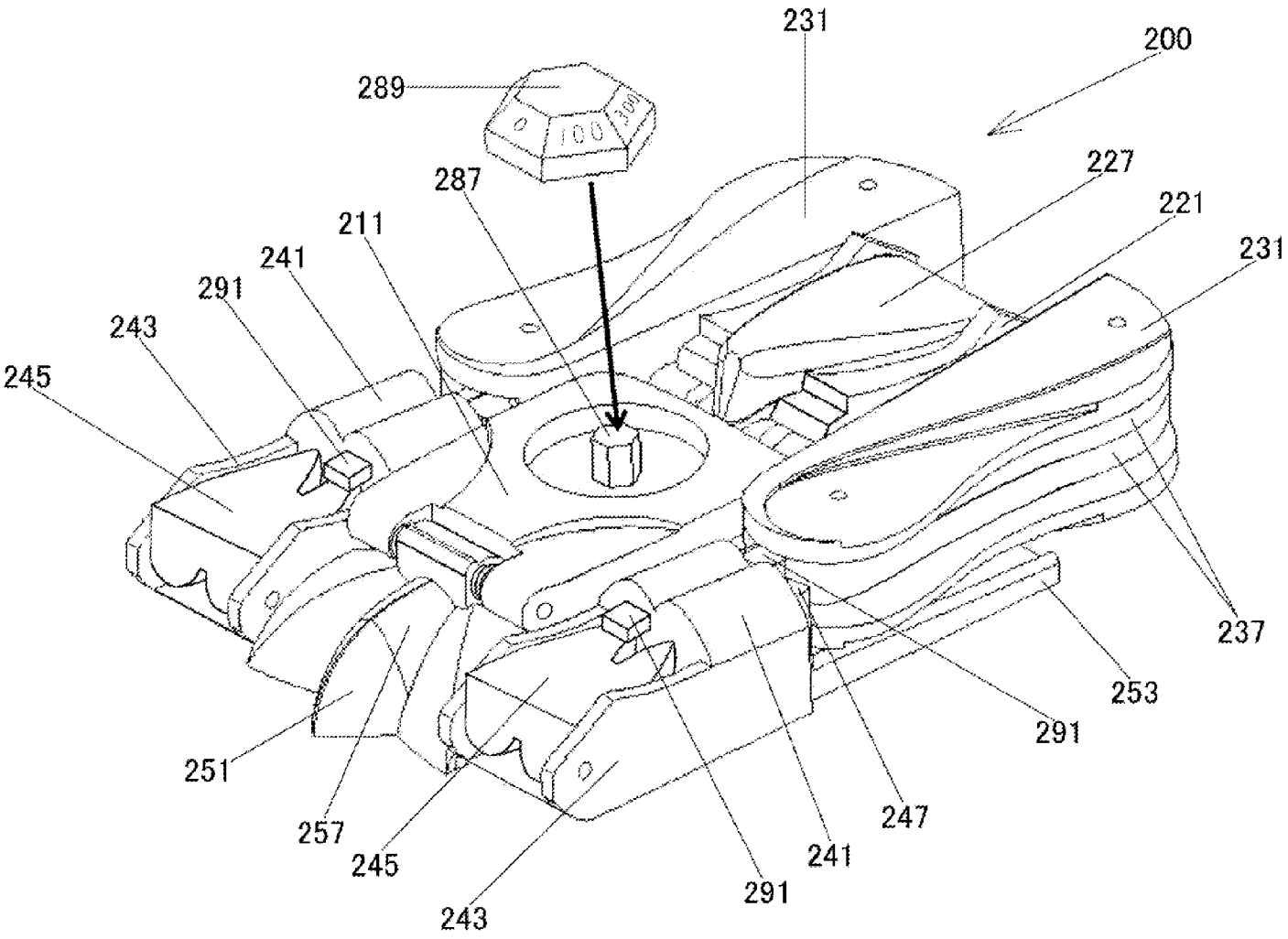
FIG. 2 is a perspective view showing a first form of a second embodiment of a transformable toy according to the invention.
Figure 16:
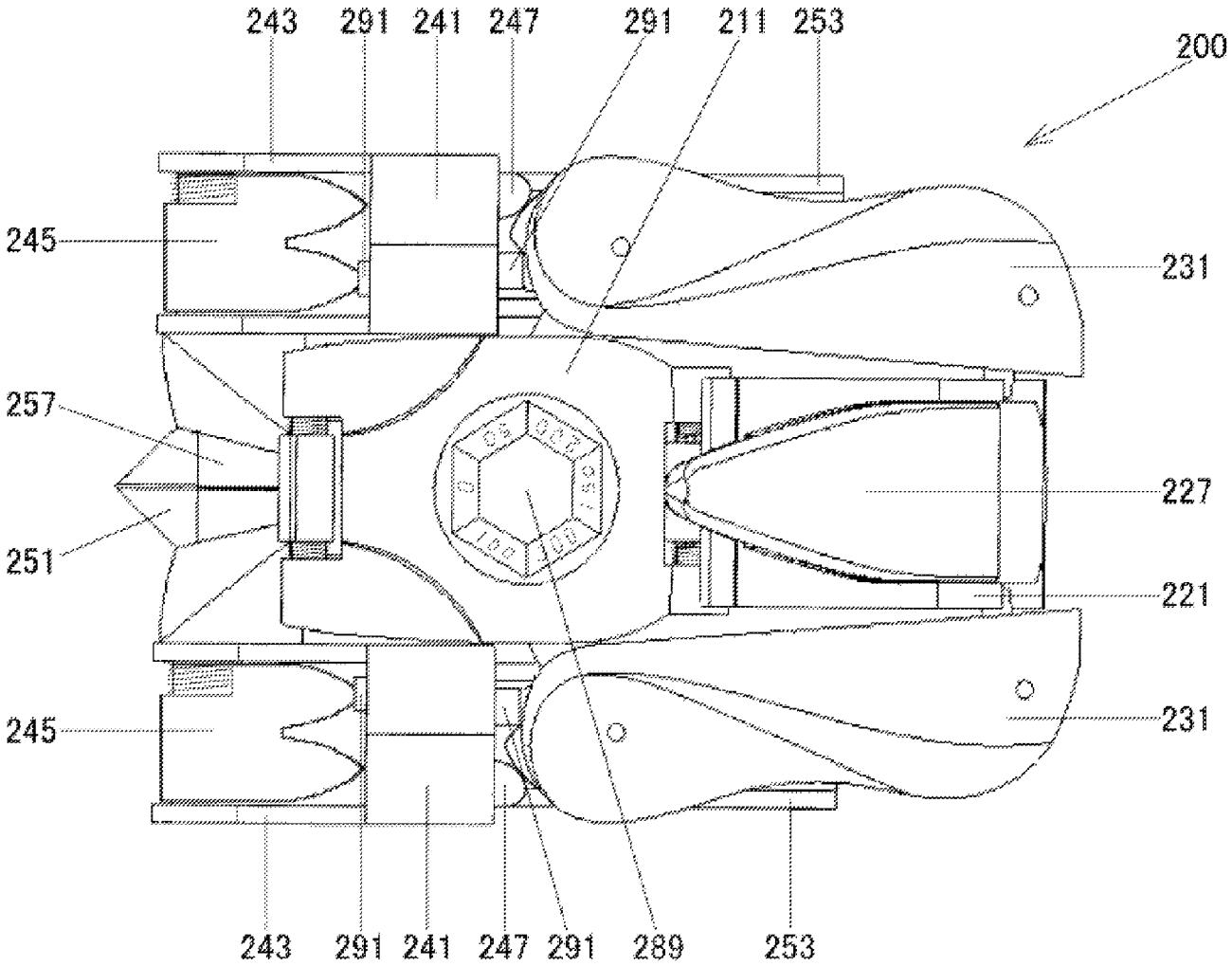
FIG. 16 is a top view of the first form of the second embodiment of the transformable toy according to the invention.

A transformable toy 200 shown in FIG. 2 can be transformed into a second form which imitates a winged animal. As is shown in FIG. 16, this transformable toy 200 has a hexagonal roulette pan 289 of a roulette wheel at a chest portion lying at the center of a substantially rectangular trunk portion 211, and this roulette pan 289 is detachably installed on a roulette wheel spindle 287. A lower end of the trunk portion 211 is attached to a rump portion 251 via a rotational shaft which includes a rotating elastic member, and a lock releasing button which is a release control portion 257 of a locking member 255 (refer to FIG. 20) acting as a locking means is provided at the center of the rump portion 251.

In addition, the trunk portion 211 is attached rotatably to the rump portion 251 by the rotational shaft so that an upper end thereof can be raised relative to the rump portion 251. The rotating elastic member which is wound round the rotational shaft biases the trunk portion 211 so as to be raised relative to the rump portion 251 and foot portions which are provided on left- and right-hand sides of the rump portion 251.

The transformable toy 200 has as character constituting members the trunk portion 211, the rump portion 251, foot main body portions 241 and tow portions 243 which constitute foot portions, wing portions 231 and flight feather portions 237 which constitute wing portions and further a head portion 221 and a beak portion 227. The head portion 221 is attached to an upper end of the trunk portion 211 via a rotational shaft including a rotating elastic member so as to be situated on an extension of the trunk portion 211. The beak portion 227 is provided to an upper end of the head portion 211 via a rotational shaft including a rotating elastic member so as to be superposed onto the head portion 221.

This head portion 221 is made to rotate on the rotational shaft and is biased by the rotating elastic member which is wound round the rotational shaft so that the upper end of the head portion 221 is raised. The beak portion 227 is made to rotate about the rotational shaft at the upper end of the head portion 221 and is biased by the rotating elastic member which is wound round the rotational shaft so that a distal end of the beak portion 227 is moved away from the head portion 221.

The transformable toy 200 has the foot main body portions 241 and the toe portions 243 which form the foot portions on left- and right-hand sides of the rump portion 251. A claw portion 245 is attached to a distal end of the toe portion 243 via a rotational shaft including a rotating elastic member. The claw portion 245 is accommodated in the toe portion 243 so as to be brought into engagement with an arm fixing member 291 which is allowed to project slightly from the foot main body portion 241 at a distal end thereof and is biased by the rotating elastic member which is wound round the rotational shaft so that the distal end thereof is rotated about the rotational shaft, enabling the claw portion 245 to be rotated to the front of the toe portion 243.

Figure 19:
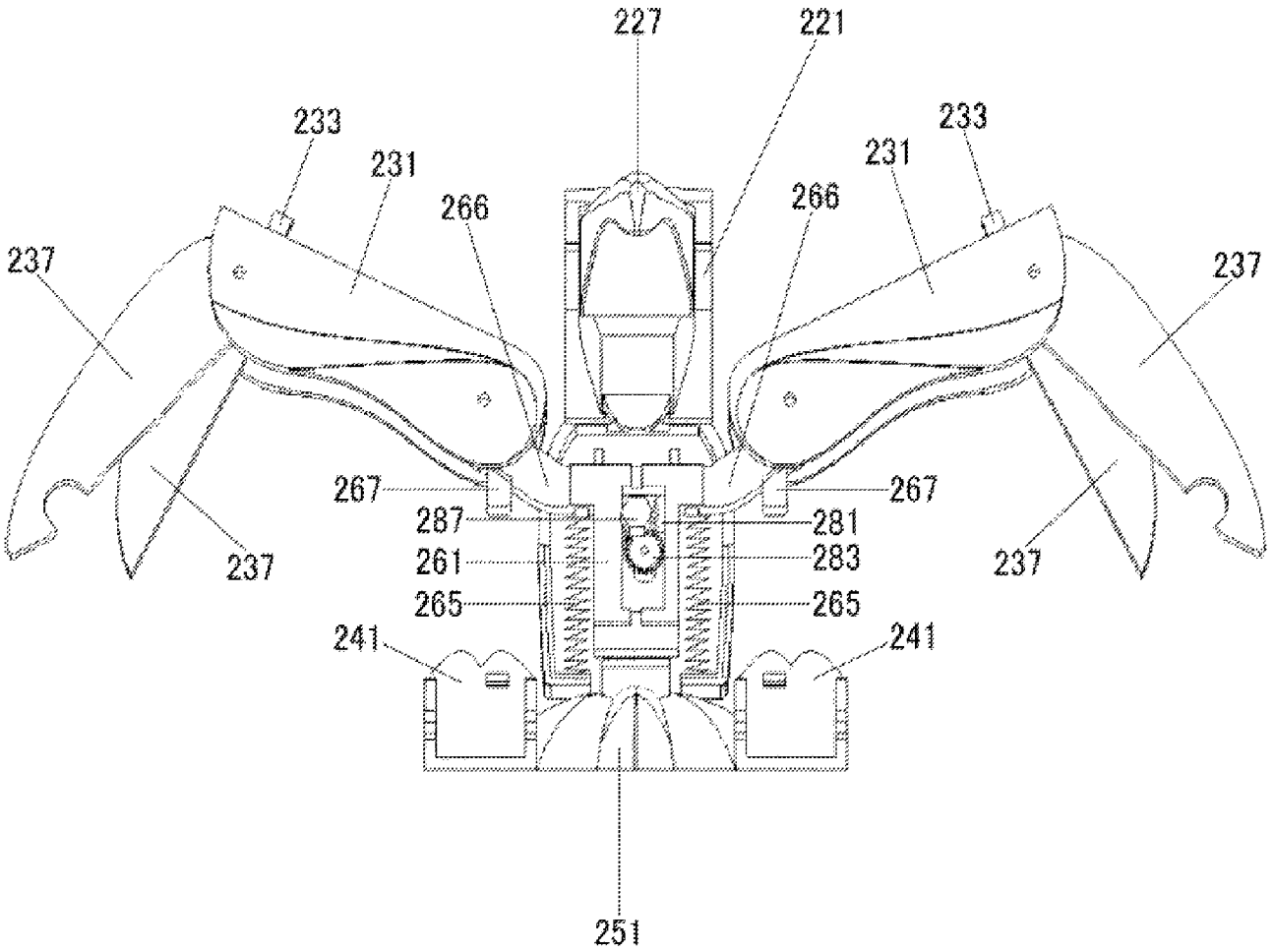
FIG. 19 is a front view showing an interior of a trunk portion of the second embodiment of the transformable toy according to the invention.

Further, the wing portions 231 which constitute the wing portions are provided on left- and right-hand sides of the head portion 221. The wing portion 231 is attached to a rod-like wing supporting arm 266, which will be described later, via a rotational shaft including a rotating elastic member in a position lying in the vicinity of a lower end thereof. As is shown in FIG. 19, the wing supporting arm 266 is formed integrally with a sliding member 261 which is accommodated in an interior of the trunk portion 211. The wing supporting arm 266 has a trunk portion fixing projection 267 which projects towards the foot main body portion 261 at a distal end thereof.

Each of the wing portions 231 has two flight feather portions 237 (refer to FIGS. 17 and 18) via a rotational shaft including a rotating elastic member which is provided in the vicinity of an upper end thereof. These two flight feather portions 237 are accommodated in an interior of the corresponding wing portion 231. The flight feather portions 237 are biased so as to be exposed to the outside of the wing portion 231 by the rotating elastic member which is wound round the rotational shaft attached to the wing portion 231, and flight feather portions 237 are fixed rotatably at proximal portions thereby by the rotational shaft at the distal end of the wing portion 231. The wing portion 231 is also biased so that the distal end is opened laterally by the rotating elastic member which is wound round the rotational shaft which is attached to the wing supporting arm 266.

Figure 17:
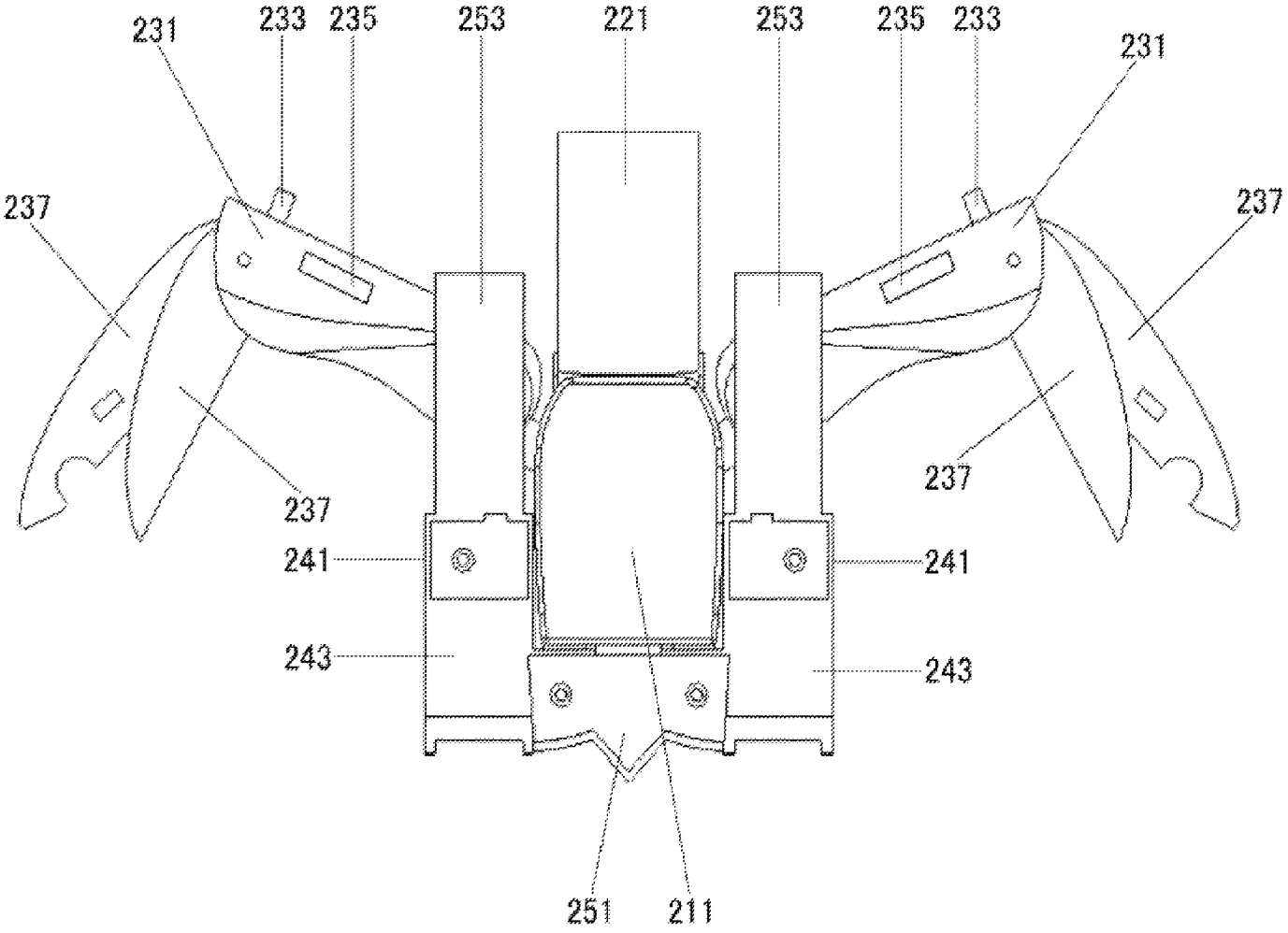
FIG. 17 is a back side view showing an initial state of a lock release of the first form of the second embodiment of the transformable toy according to the invention.

Further, as is shown in FIG. 17, The transformable toy 200 has the tail feather portions 253 extended rearwards respectively from the foot main body portions as foot portions which are positioned each at the left side and right side of the trunk portion 211, and also at the rear surface of the wing portions 231, the opening preventive projections 235 which lock the wing portions 231 to open by bringing into contact with the inside of the wing portions 253 in the first form shown in FIG. 1 or FIG. 16, and further the head portion fixing projections 233, which are brought into engagement with the upper end of the beak portion, provided inside of the wing portions 231 which are positioned respectively in the left and right sides of the head portion 221.

When the transformable toy 200 is placed on a flat surface such as a base table or a desk with the roulette pan 289 oriented upwards and the lock releasing button which is the release control portion 257 of the locking means is pushed in by the finger tip or the like, as will be described later, the wing supporting arms 266 rise together with the sliding member 261 in the direction of the head portion 221 relative to the trunk portion 211, whereby the left and right wind portions 231 are shifted upwards.

As a result of the wing portions 231 rising in the way described above, the engagement between the head portion fixing projections 233 provided inside the wing portions 231 and the upper end of the beak portion 227 is disengaged, whereby the distal end of the beak portion 227 is rotated to the front about the upper end as the rotation center relative to the head portion 221 by the elastic force of the rotating elastic member, and the upper end of the head portion 221 is rotated to the front relative to the trunk portion 211 about the lower end thereof as the rotation center by the elastic force of the rotating elastic member.

In addition, the arm fixing members 291, which are brought into engagement with wing tip fixing projections 247 and the trunk portion fixing projections 267, are provided at rear end faces of the foot main body portions 241. As a result of the wing portions 231 rising, the engagement between the wing tip fixing projections 247 with distal ends of the flight feather portions 237 is disengaged, whereby the flight feather portions 237 rotate about the upper ends of the wing portions 231 as rotation centers so as to be exposed from the wing portions 231, and the engagement between the arm fixing members 291 and the trunk portion fixing projections 267 of the wing supporting arms 266 is disengaged. Then, the wing supporting arms 266 are released from the foot main body portions 241, and the trunk portion 211 is rotated to the front about the lower end thereof as the rotation center so as to rise.

This arm fixing member 291 is a rod-like member which is accommodated within the foot main body portion 241 and can slide in an axial direction. The arm fixing member 291 projects from a rear end face of the foot main body portion 241 at one end so as to be brought into engagement with the trunk portion fixing projection 267 and projects towards the toe portion 243 from the foot main body portion 241 at the other end. The arm fixing member 291 is biased in the direction of the rear end face of the foot main body portion 241 by an auxiliary locking releasing elastic member which is accommodated in the foot main body portion 241. When the trunk portion fixing projection 267 is in engagement with the one end of the arm fixing member 291, the other end of the arm fixing member 291 is caused to project slightly towards the toe portion 243 so as to lock a distal end of the claw portion 245. When the engagement with the trunk fixing projection 267 is disengaged, the distal end which is caused to project towards the toe portion 243 is accommodated by the stretching force of the auxiliary locking releasing elastic member so as to release the locking of the claw portion 245.

When the wing supporting arms 266 and the wing portions 231 rise relative to the trunk portion 211 so as to be shifted in the direction of the head portion 221, opening preventive portions 235 which are provided on rear surfaces of the wing portions 231 are released from tail feather portions 253 by the rise of the wing portions 231, whereby the wing portions 231 rotate about lower ends thereof which constitute connecting points with distal ends of the wing supporting arms 266 so as to be opened horizontally at upper ends thereof.

Then, since the engagement between the trunk portion fixing projections 267 and the arm fixing members 291 is disengaged and the arm fixing members 291 withdraw their distal ends which are caused to project slightly from the toe portions 243 by the auxiliary locking releasing elastic members, the claw portions 245 project to the front from the corresponding toe portions 243 so as to rotate tips of claws to the front as a result of the engagement with the arm fixing members 291 being disengaged.

Figure 6:
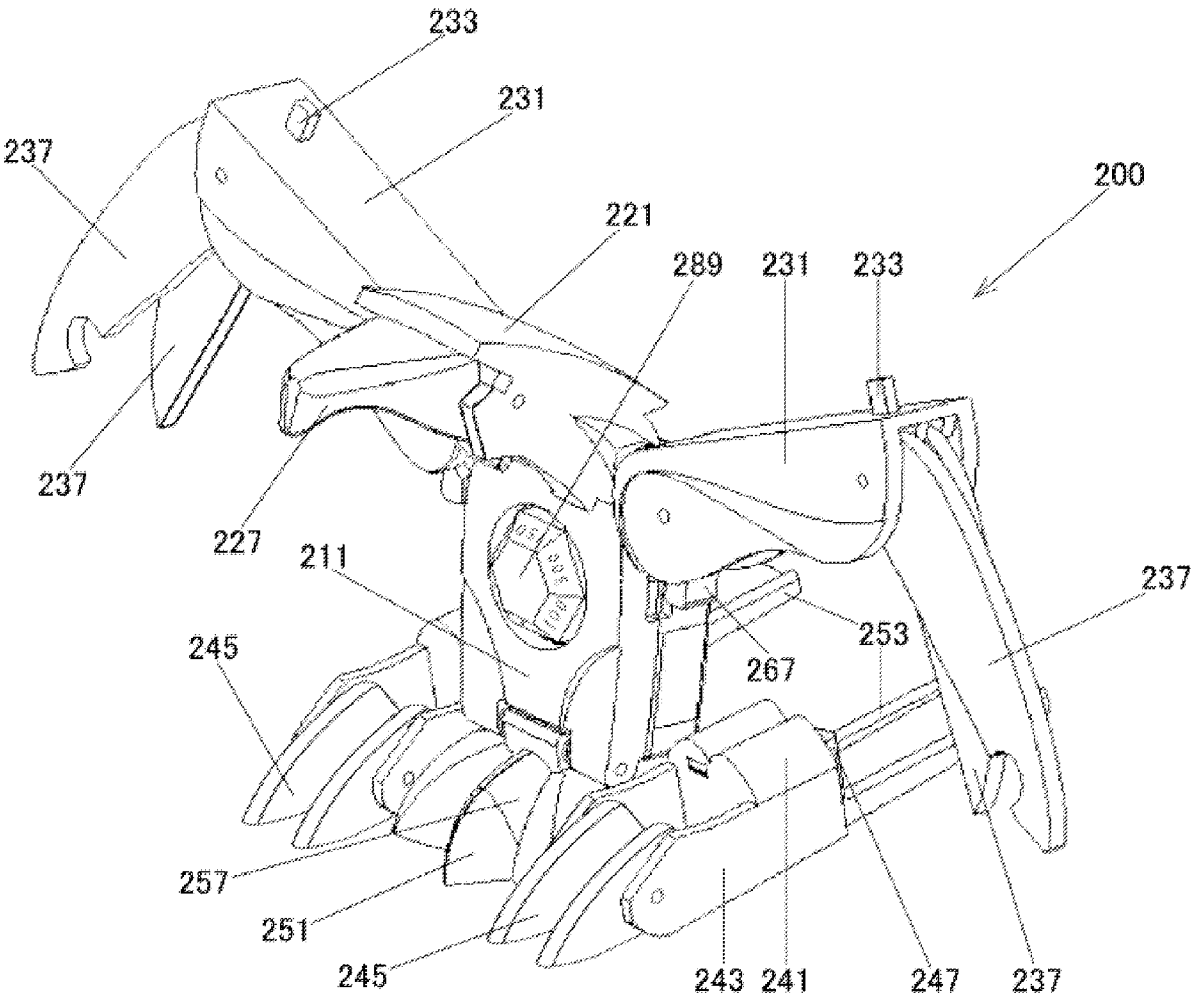
FIG. 6 is a perspective view showing a second form of the second embodiment of the transformable toy according to the invention.
Figure 18:
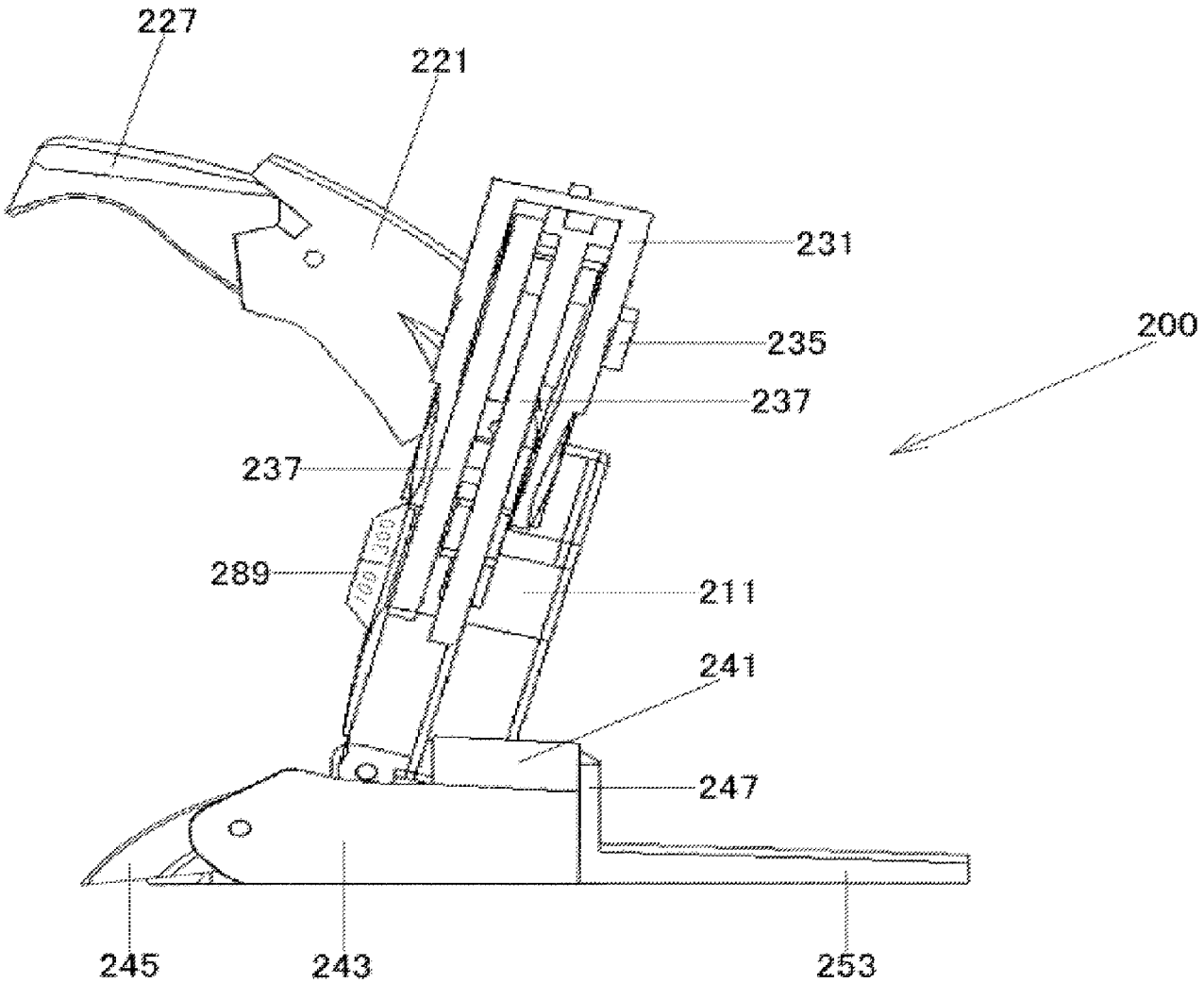
FIG. 18 is a side view showing the second form of the second embodiment of the transformable toy according to the invention.

Consequently, the transformable toy 200 is transformed from the first form in which the character constituting members are disposed in a planar fashion so that the head portion 221 and the beak portion 227 are positioned on the extension of the trunk portion 211 which is positioned between the toe portions 243 and the foot main body portions 241 which constitute the foot portions and the wing portions 231 which accommodate therein the flight feather portions 237 are positioned on the left- and right-hand sides of the head portion 221 to the three-dimensional second form shown in FIGS. 6 and 18.

The sliding member 261 is provided in the interior of the trunk portion 211, as is shown in FIG. 19, which constitutes a rotating mechanism which can be shifted in a vertical direction with respect to the trunk portion 211.

This sliding member 261 constitutes the rotating mechanism together with a rack 281, a pinion 285 and locking releasing elastic members 265 and is formed into a rectangular frame shape. The sliding member 261 has the wing supporting arms 266 which extend outwards from sides of an upper portion thereof. These wing supporting arms 266 are caused to extend outwards of the trunk portion 211. Proximal portions of the wing portions 231 are supported at distal ends of the wing supporting arms 266 via rotational shafts including rotating elastic members. Further, the sliding member 261 has the trunk portion fixing projections 267 which project downwards from distal ends of the wing supporting arms 266.

Figure 20:
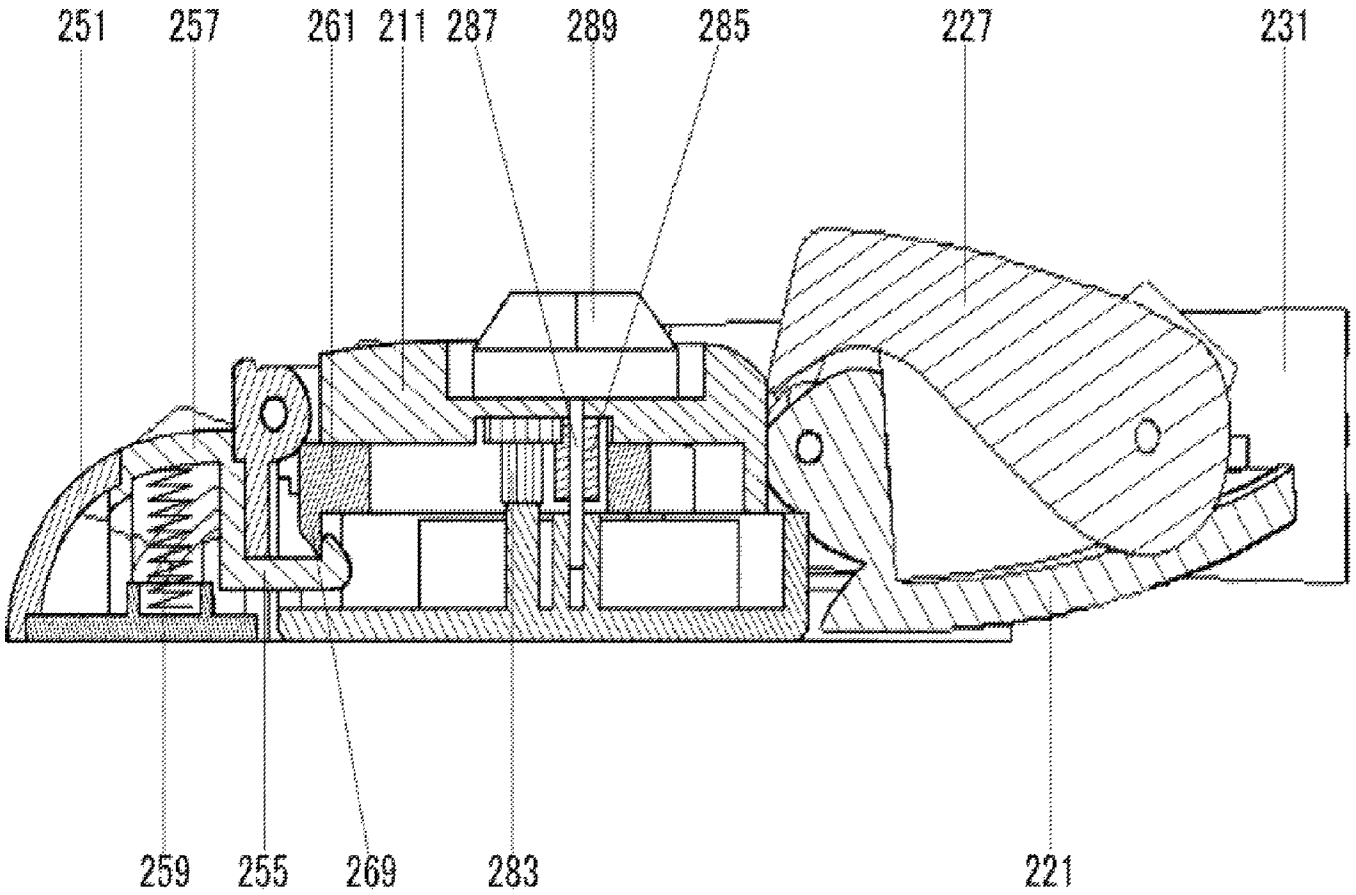
FIG. 20 is a sectional view showing the interior of the trunk portion of the second embodiment of the transformable toy according to the invention.

The sliding member 261 has the rack 281 on an inner side of one of upper and lower direction sides of the frame shape. The locking releasing elastic members 265 in a compressional sate are disposed on both outer sides of the sliding member 261, whereby the sliding member 261 is biased upwards. As is shown in FIG. 20, the sliding member 261 has an engagement piece 269 which projects towards a back side thereof on the lower side, so as to be brought into engagement with a locking member 255 acting as a locking means which is incorporated in an interior of the rump portion 251 when the character constituting members are folded.

Further, an acceleration gearwheel 283 which is mounted in the trunk portion 211 and the pinion 285 which is fixed to the roulette wheel spindle 287 are provided inside the sliding member 261. The rack 281 of the sliding member 261 and a small gearwheel of the acceleration gearwheel 283 can mesh with each other, while a large gearwheel of the acceleration gearwheel 283 meshes with the pinion 285 which is fixed to the roulette wheel spindle 287. The rack 281 provided in the sliding member 261 has such a length that it meshes with the small gearwheel of the acceleration gearwheel 283 when the sliding member 261 is lowered, whereas when the sliding member 261 is raised as is shown in FIG. 19, the mesh engagement with the small gearwheel of the acceleration gearwheel 283 is released.

In addition, the locking member 255 which is incorporated in the rump portion 251 is formed integrally with the lock releasing button acting as the release control portion 257 and is biased upwards by a locking elastic member 259 so that the lock releasing button which is the release control portion 257 becomes level with a surface of the rump portion 251. When the lock releasing button is pushed, the locking member 255 is lowered together with the release control portion 257, whereby an engagement portion provided on the side of the trunk portion 211 is lowered so as to release the engagement with the engagement piece 269 of the sliding member 261.

Consequently, when the wing portions 231 are lowered in the direction of the rump portion 251 with the trunk portion 211 caused to lie so that the upper end of the trunk portion 211 which is biased so as to raise the trunk portion 211 by the rotating elastic member becomes parallel with the foot main body portions 241 and the tail feather portion 253, the sliding member 261 which is integral with the wing supporting arms 266 is translated towards the rump portion 251, whereby the engagement piece 269 of the sliding member 261 can be brought into engagement with the distal end of the locking member, and this engagement enables the sliding member 261 to be maintained in a position lying close to the rump portion 251.

Because of this, from the second form shown in FIG. 6 and the like, by folding the trunk portion 211 downwards to the rear so as to lie parallel with the foot portions and folding the beak portion to the front so as to be superposed on the head portion 221, the beak portion 227 and the head portion 221 are made parallel with the foot main body portions 241 and the tail feather portion 253 so as to be positioned on the extension of the trunk portion 211. Then, the wing portions 231 are shifted in the direction of the foot main body portions 241 by folding the flight feather portions 237 from the left and right so as to be accommodated in the wing portions 231 and folding the left and right wing portions from the left and right so as to be closed parallel with the head portion 221 held by the left and right wing portions 231. Then, the sliding member 261 is pushed in downwards or in the direction of the rump portion 251 via the wing supporting arms 266 so as to compress strongly the locking releasing elastic members 265 to thereby bring the engagement piece 269 into engagement with the distal end of the locking member. Thus, the head fixing projections 233 provided on the inner sides of the wing portions 231 can be brought into engagement with the upper end of the beak portion 227 so as not only to prevent the beak portion 227 from being opened from the head portion 221 but also to prevent the head portion 221 from being rotated to the front relative to the trunk portion 211.

As this occurs, the trunk portion fixing projections 267 which are provided at the distal ends of the wing supporting arms 266 are brought into engagement with the arm fixing members 291 which are provided at the foot main body portions 241, whereby the trunk portion 111 can be prevented from rising from the foot portions, and the state in which the flight feather portions 237 are accommodated in the wing portions 231 by the wing tip fixing projections 247 of the foot main body portions 241 is kept. Further, the opening preventive projections 235 of the wing portions 231 are positioned inside the tail feather portion 253 so as to prevent the opening of the wing portions 231, and the engagement piece 269 of the sliding member 261 is brought into engagement with the locking member 255, thereby making it possible to maintain the first form in which the character constituting members are folded.

In addition, by bringing the distal ends of the claw portions 245 into engagement with the arm fixing members 291 which project from the foot main body portions 241 to the toe portions 243 by rotating the claw portions 245 so as to be accommodated in the toe portions 243, the transformable toy 200 can be restored to the first form shown in FIG. 2 and the like.

In this way, the transformable toy 200 having the form in which the wings are opened laterally can be transformed into the first form by following the folding procedure of rotating the trunk portion 211 downwards to the rear, rotating the head portion 221 to the rear, thereafter, folding the beak portion 227 so that the beak portion 227 is rotated to the front, folding the left and right flight feather portions 237 from the left and right so as to be accommodated in the corresponding wing portions 231, folding the wing portions 231 which accommodate therein the flight feather portions 237 from the left and right to the sides of the head portion 221 so that the wing portions 231 are rotated to the rear, pushing in the wing portions 231 in the direction of the foot main body portions 241, and folding the claw portions 245 so as to be rotated to the rear before or after the wing portions 231 are so pushed in.

In this folding operation, the character constituting members to be folded are rotated individually to predetermined positions in an ensured fashion without damaging the character constituting members and against the elastic forces of the rotating elastic members so that the character constituting members are locked to each other. Therefore, the skill to fold them quickly is necessary.

When the transformable toy 200 is transformed from the first form to the second form by pressing down the lock releasing button by the finger tip or the like, the pinion 285 rotates via the acceleration gearwheel 283 by the shifting of the rack 281 as a result of the rise of the sliding member 261, which rotates the roulette pan 289 mounted on the roulette wheel spindle 287. Then, the mesh engagement between the rack 285 and the acceleration gearwheel 283 is disengaged and the roulette pan 289 continues to rotate. Thereafter, the roulette pan 289 stops in a position which is not determined.

Further, the player can be surprised at a large change in form which results when the wing portions 231 and the flight feather portions 237 which are folded laterally symmetrically are wide opened in the lateral direction.

The invention is not limited to the case where the rack 281 and the pinion 285 mesh with each other via the acceleration gearwheel 283. Hence, there may be adopted a case where the rack 281 is brought into direct mesh engagement with the pinion 285 with the acceleration gearwheel 283 omitted or a case where the rack 281 and the pinion 285 are brought into mesh engagement with each other while adjusting the positions of the rack 281 and the roulette wheel spindle 287 to which the pinion 285 is fixed by using a spur gear as an intermediate gearwheel.

For a transformable toy having members associated with wing portions such as the wing portions 231 and the flight feather portions 237, various forms can be adopted which imitate not only forms of birds currently existing but also forms of extinct creatures such as pterodactyl, imaginary birds or winged animals.

Figure 3:
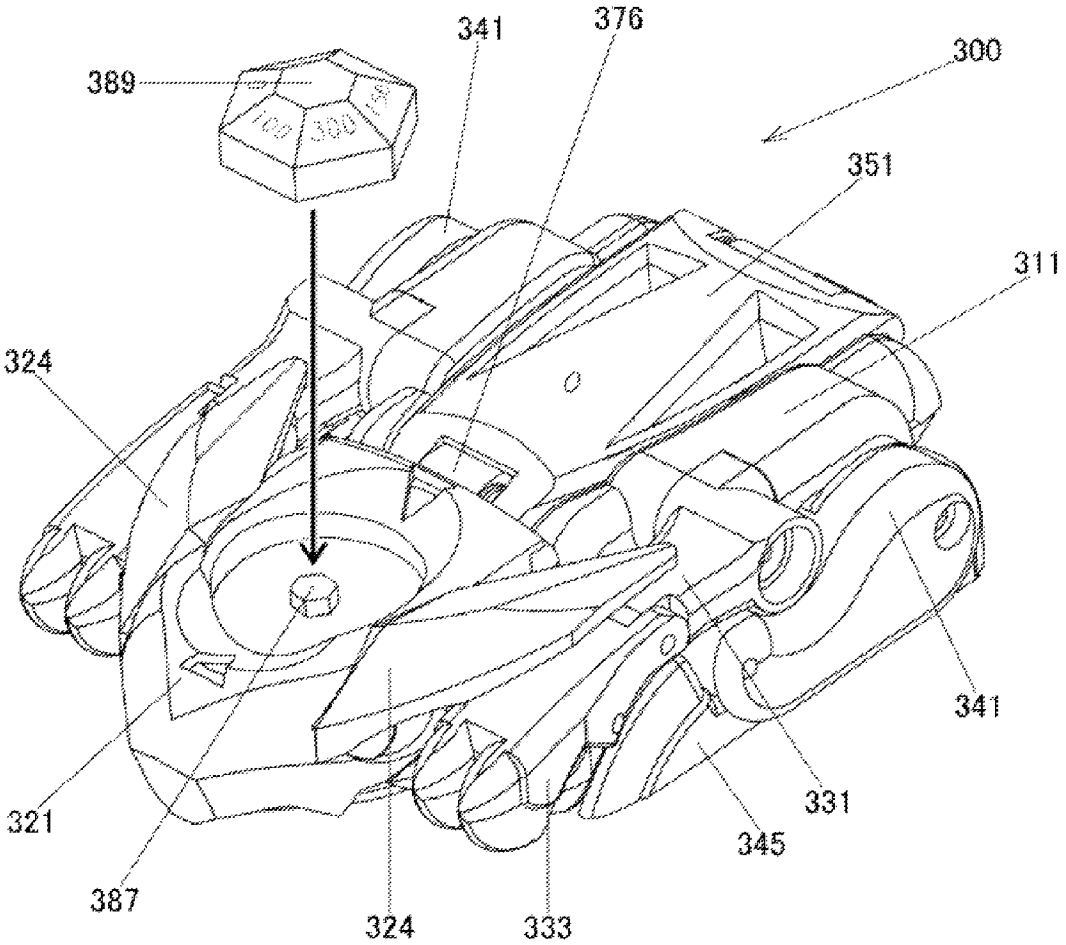
FIG. 3 is a perspective view showing a first form of a third embodiment of a transformable toy according to the invention.
Figure 7:
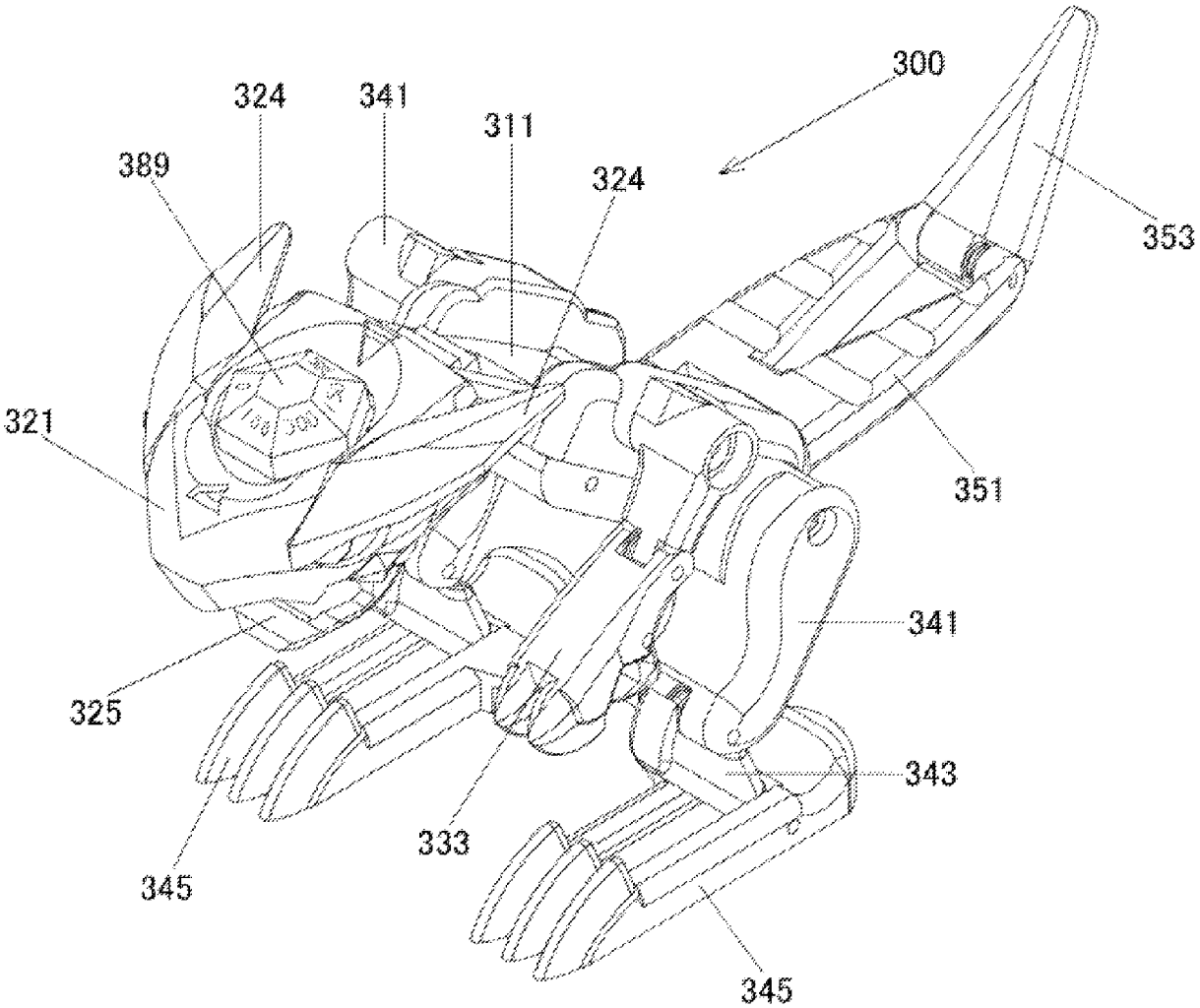
FIG. 7 is a perspective view showing a second form of the third embodiment of the transformable toy according to the invention.
Figure 21:
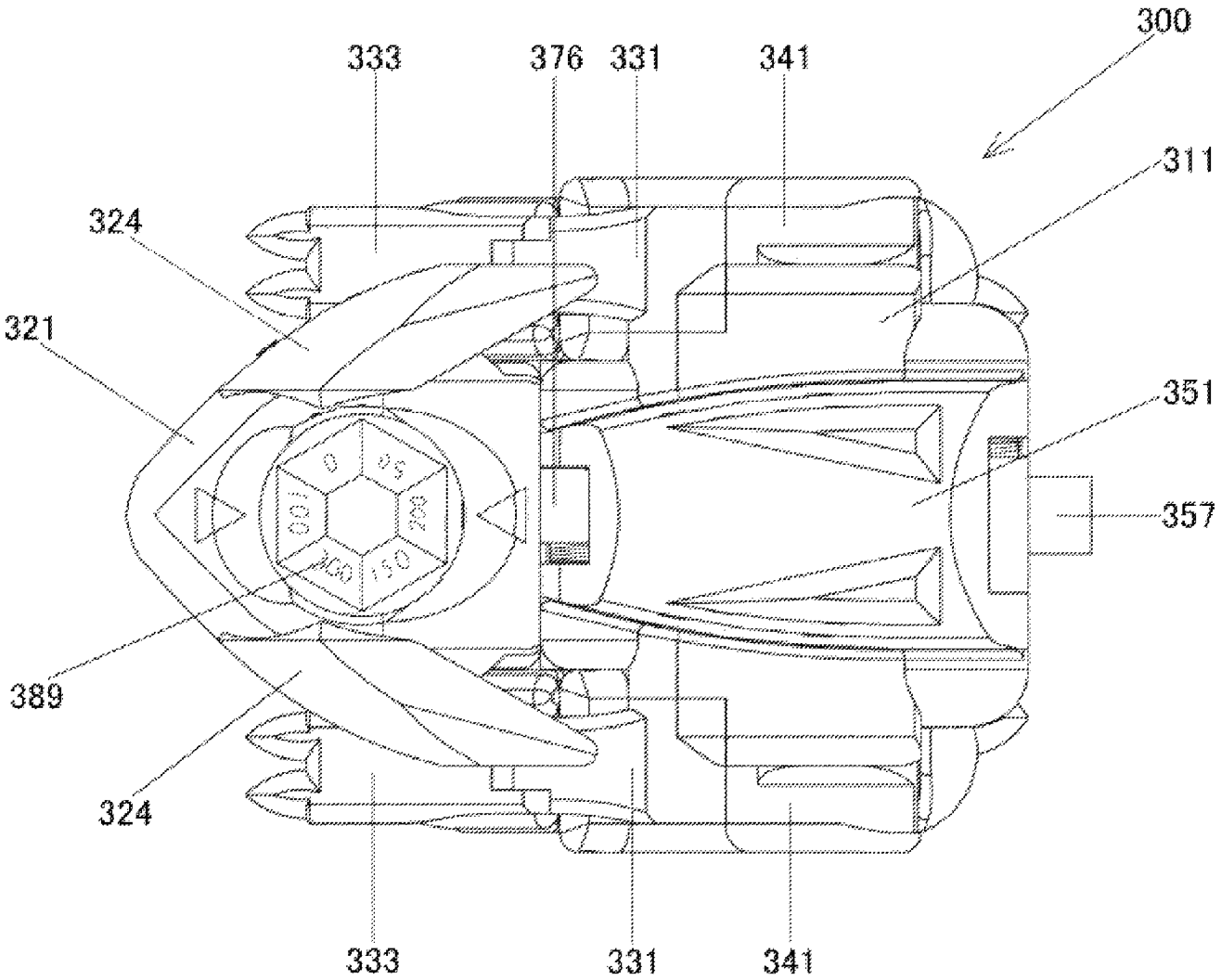
FIG. 21 is a top view showing the first form of the third embodiment of the transformable toy according to the invention.

A transformable toy 300 shown in FIG. 3 can be transformed into a second form which imitates a two-legged animal standing on two hind limbs as is shown in FIG. 7. As is shown in FIGS. 3 and 21, the transformable toy 300 has a head portion 321 having a substantially pentagonal shape like a home plate in baseball at the front of a substantially rectangular trunk portion 311. A hexagonal roulette pan 389 as a roulette wheel is provided in this head portion 321 so as to be detachably installed on a roulette wheel spindle 387. The transformable toy 300 has ear flap portions 324 which protrude to the left and right of the head portion 321 and upper arm portions 331 and forearm portions 333 below the ear flap portions 324, the upper arm portions 331 and the forearm portions 333 forming arm portions. The head portion 321 is locked substantially close to a distal end of the trunk portion 311 by a head portion locking piece 376 acting as a locking means.

The locking means of this transformable toy 300 has a lock releasing lever acting as a release control portion 357 which projects from a rear end of the trunk portion 311. A rear end of the lock releasing lever and a projecting distal end of the head portion locking piece 376 are pivotally supported in an interior of the trunk portion 311 so as to oscillate vertically, so as to transmit vertical motions at a front end of the lock releasing lever acting as the release control portion 357 to the head portion locking piece 376. The locking means is a link mechanism which incorporates a locking elastic member, and the rear end of the lock release lever and the distal end of the head portion locking piece 376 are biased upwards and downwards, respectively, by the locking elastic member.

The transformable toy 300 imitating the two-legged animal has as character constituting members the trunk portion 311, the head portion 321 and the upper arm portions 331 and the forearm portions 333 which form the arm portions, upper leg portions 341 and lower leg portions 343 which form leg portions, further, foot portions 345 which are provided at distal ends of the lower leg portions 343 and a tail portion 351. In the arm portions which are provided on the left- and right-hand sides of the trunk portion 311, upper arm portions 331 and the forearm portions 333 are stretched, and the upper leg portions 341 and the lower leg portions 343 which form the leg portions are folded. Further, the tail portion 351 is superposed on an upper surface of the trunk portion 311.

The tail portion 351 is fixed to the rear end of the trunk portion 311 on a proximal portion side (a right-hand side in the figure) via a rotational shaft which includes a rotating elastic member. A tail end portion 353 is attached to a distal end side (a left-hand side in the figure) of the tail portion 351 via rotational shaft which includes a rotating elastic member. This tail end portion 353 is folded inwards of the tail portion 351 so as to be superposed on the trunk portion 311, and a distal end of the tail portion 351 is slightly inserted below a proximal portion side of the head portion 321.

The rotating elastic member which is wound round the rotational shaft lying on the proximal portion side of the tail portion 351 biases the tail portion 351 in a direction in which the tail portion 351 is rotated so as to be spaced away from the trunk portion 311, and the rotating elastic member which is wound round the rotational shaft lying on the distal end side of the tail portion 351 biases the tail end portion 353 in a direction in which the tail end portion 353 is rotated so as to be spaced away from the tail portion 351.

Figure 22:
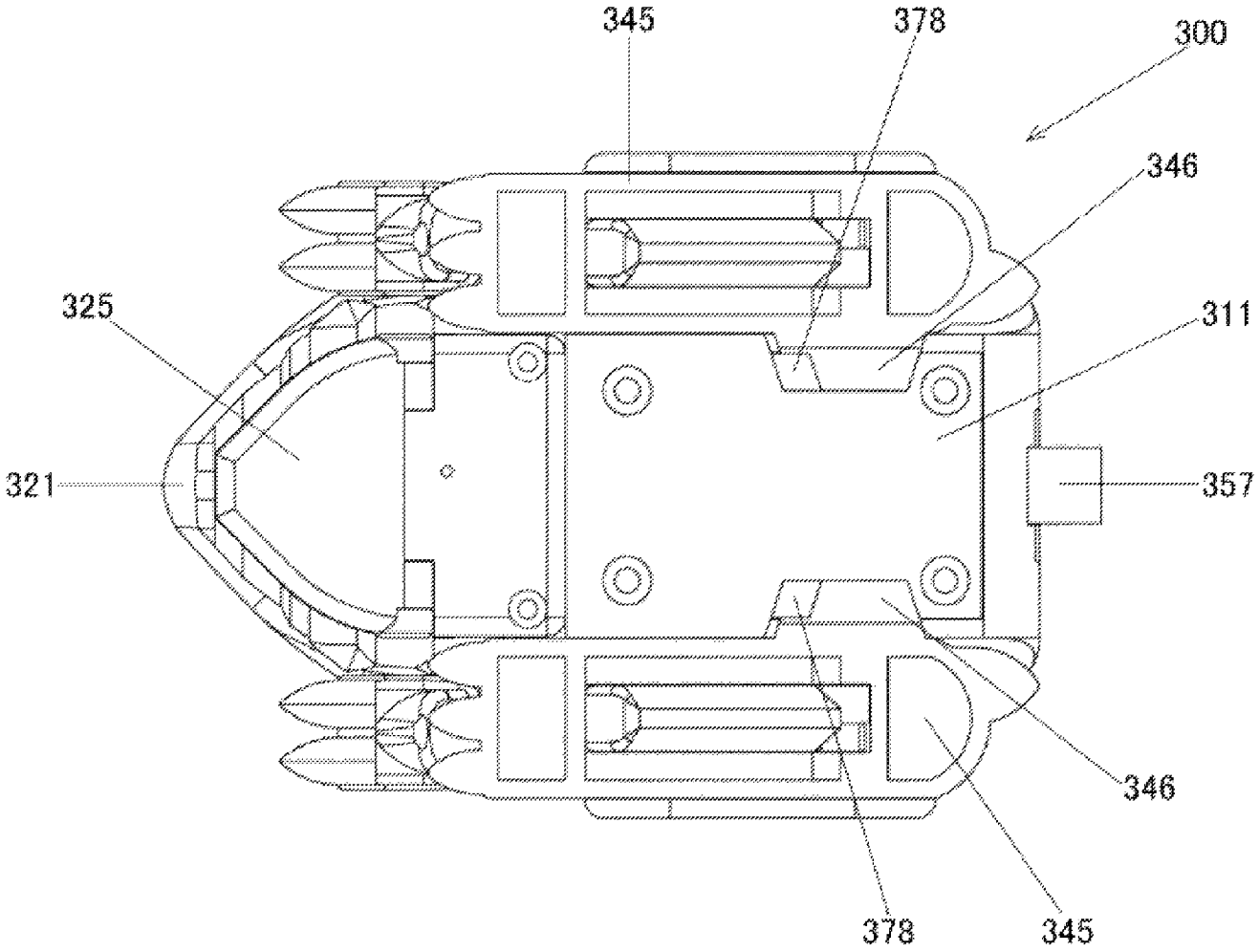
FIG. 22 is a bottom view showing the first form of the third embodiment of the transformable toy according to the invention.

As is shown in FIG. 22, the transformable toy 300 has a lower jaw portion 325 on a lower surface of the head portion 321, and this lower jaw portion 325 is attached rotatably to the head portion 321 at a proximal portion side thereof (a right-hand side in the figure) by a rotational shaft.

Further, the transformable toy 300 has the foot portions 345 on the left- and right-hand sides of the trunk portion 311 (upper and lower sides in the figure), and these foot portions 345 are fixed to distal ends of the leg portions which are made up of the upper leg portions 341 and the lower leg portions 343 via rotational shafts which each include a rotating elastic member. An engagement projecting piece 346 which projects below from the trunk portion 311 is provided on an inner side of the foot portion 345, and a front portion of this engagement projecting piece 346 is locked by a foot fixing piece 378 which is exposed on a lower surface of the trunk portion 311, whereby the foot portion 345 is prevented from being detached from the trunk portion 311. A plate-like lock release lever which is the release control portion 357 of the locking means which is accommodated in the trunk portion 311 projects from the rear end of the trunk portion 311.

Figure 24:
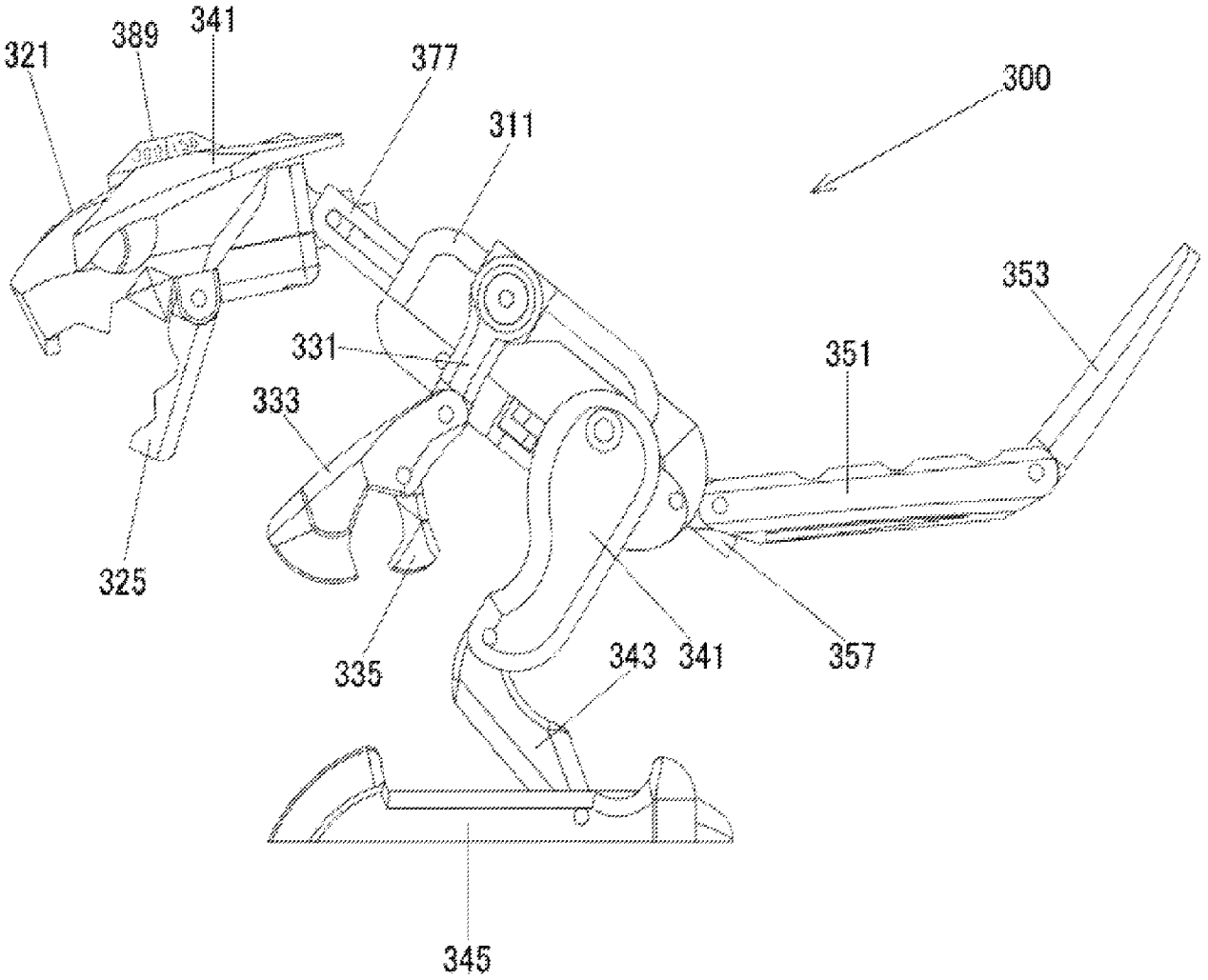
FIG. 24 is a side view showing the second form of the third embodiment of the transformable toy according to the invention.

As is shown in FIG. 24, the upper leg portion 341 is attached to a side of the trunk portion 311 in a position lying in the vicinity of the rear end thereof via rotational shaft which includes a rotating elastic member at a portion lying in the vicinity of a proximal end portion thereof, and the upper leg portion 341 is also attached to an upper end of the lower leg portion 343 via a rotational shaft which includes a rotating elastic member at a portion lying in the vicinity of a front end thereof. The lower leg portion 343 is folded inwards of the upper leg portion 341, and a distal end of the lower leg portion 343 is fixed to a substantially center of the foot portion 345 via a rotational shaft which includes a rotating elastic member.

The rotating elastic member which is wound round the rotational shaft lying on the proximal portion side of the upper leg 341 biases the upper leg portion 341 in a direction in which the upper leg portion 341 is rotated in a direction in which a distal end of the upper leg portion 341 is lowered relative to the trunk portion 311. The rotating elastic member which is wound round the rotational shaft lying on the distal end side of the upper leg portion 341 biases the lower leg portion 343 in a direction in which the lower leg portion 343 is rotated so that the distal end of the lower leg portion 343, that is, the foot portion 345 is shifted downwards so as to be spaced away from a proximal portion of the upper leg 341.

In addition, the upper arm portion 331 is attached to the side of the trunk portion 311 in a position lying on a distal end side by a rotational shaft at a portion lying in the vicinity of the proximal side end portion thereof. The forearm portion 333 is attached to a distal end side end portion of the upper arm portion 331 via a rotational shaft which includes a rotating elastic member. The arm portion is held by the foot portion 345 and the ear flap portion 324 with the upper arm portion 331 and the forearm portion 333 stretched. The rotating elastic member which is wound round the rotational shaft provided at the distal end portion of the upper arm portion 331 biases the forearm portion 333 in a direction in which a distal end of the forearm portion 333 is raised relative to the upper arm portion 331.

Figure 23:
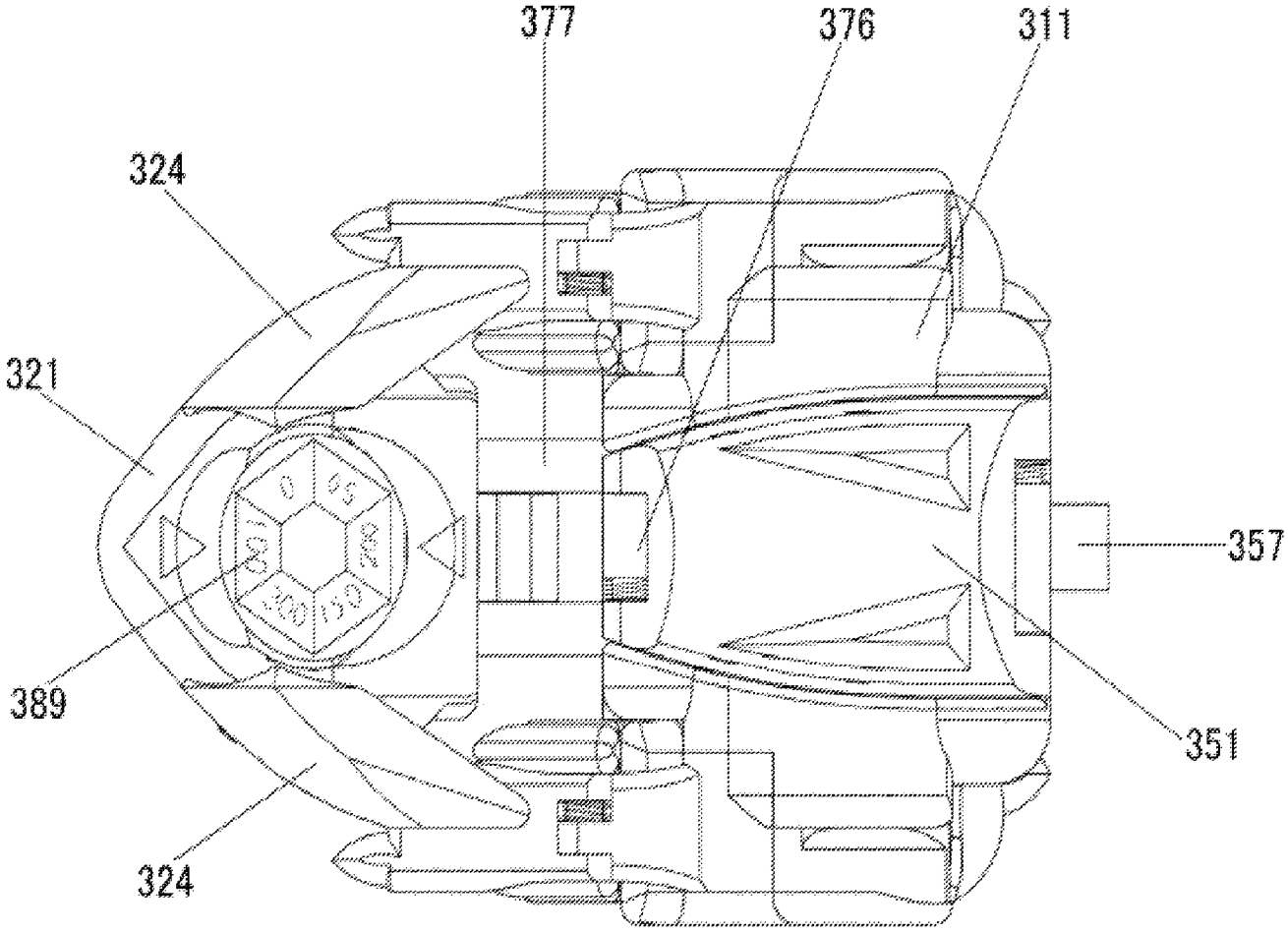
FIG. 23 is a top view showing an initial state of a lock release of the first form of the third embodiment of the transformable toy according to the invention.

Consequently, with the transformable toy 300 placed on a flat surface such as a base table or a desk, when the lock releasing lever which is the release control portion 357 of the locking means is pressed down with the finger tip or the like, the head locking piece 376 which is provided at the front end of the trunk portion 311 via the link mechanism as the locking means incorporated in the trunk portion 311 oscillates, whereby the engagement between the trunk portion 311 and the head portion 321 is disengaged, and the head portion 321 and the trunk portion 311 are separated from each other as is shown in FIG. 23, with the head portion 321 connected to the trunk portion 311 by a neck member 377.

This neck member 377 is biased to the front by a locking releasing elastic member, not shown, in an interior of the trunk portion 311, and both sides of a rear end of the neck member 377 can be exposed to the lower surface of the trunk portion 311 as foot fixing pieces 378. When the head portion 321 is released from the trunk portion 311, the neck member 377 is shifted to the front so as to be exposed from the distal end of the trunk portion 311, while the foot fixing pieces 378 are shifted to the front so as to be accommodated in the interior of the trunk portion 311, whereby the foot portion 345 is released from the trunk portion 311.

Further, as will be described later, the head portion 321 incorporates a sliding member 361 which constitutes a rotating mechanism, and a rear end of the sliding member 361 is connected to the neck member 377 via a rotational shaft, whereby the head portion 321 is attached to the neck member 377. The head portion 321 is shifted to the front relative to the sliding member 361, and a rear end of the sliding member 361 is exposed slightly from a rear end of the head portion 321.

In this way, when the engagement between the head portion 321 and the trunk portion 311 is released and the head portion 321 and the neck member 377 advance relative to the trunk portion 311 to thereby accommodate the foot fixing pieces 378 in the trunk portion 311, the foot portions 345 are released from the trunk portion 311, and the lower leg portions 343 are raised relative to the foot portions 345 by the rotating elastic members. In addition, the upper leg portions 341 are also raised by the rotating elastic members so that the lower leg portions 343 are stretched, and the upper leg portions 341 are also stretched from the trunk portion 311 by the rotating elastic members, whereby the transformable toy 300 can be transformed into a posture in which the toy stands on the two hind legs as is shown in FIG. 24.

In addition, as this occurs, the head portion 321 is separated from the trunk portion 311, whereby the tail portion 351 which is locked at the distal end by the head portion 321 is also released, and the tail portion 351 is opened from the trunk portion 311 by the rotating elastic member. Then, the tail end portion 353 is also released by the release of the tail portion 351 and is rotated to a position lying on an extension of the tail portion 351 by the rotating elastic member.

Further, when the trunk portion 311 rises, the upper arm portions 331 and the forearm portions 333 which are held by the foot portions 345 and the ear flap portions 324 are also released, the upper arm portions 331 are lowered at distal ends thereof by gravity, and the forearm portions 333 are rotated by the rotating elastic members so that distal ends of the forearm portions 333 are raised higher than extended positions of the upper arm portions 331.

In addition, the head portion 321 is shifted to the front relative to the sliding member 361. Since this shift of the head portion 321 exposes a connecting portion with the neck member 377 which lies at the rear end of the sliding member 361 at the rear of the head portion 321, the connecting portion between the neck member 377 and the rear end of the sliding member 361 is made free, whereby the neck member 377 is lowered by gravity, and the head portion 321 advances relative to the sliding member 361. As a result of this, a rear end of the lower jaw portion 325 is disengaged from a lower surface of the sliding member 361, and a distal end of the lower jaw portion 325 is lowered by gravity so that a rear end of the lower jaw portion 325 is raised, resulting in a state in which the transformable toy 300 opens its mouth.

Figure 25:
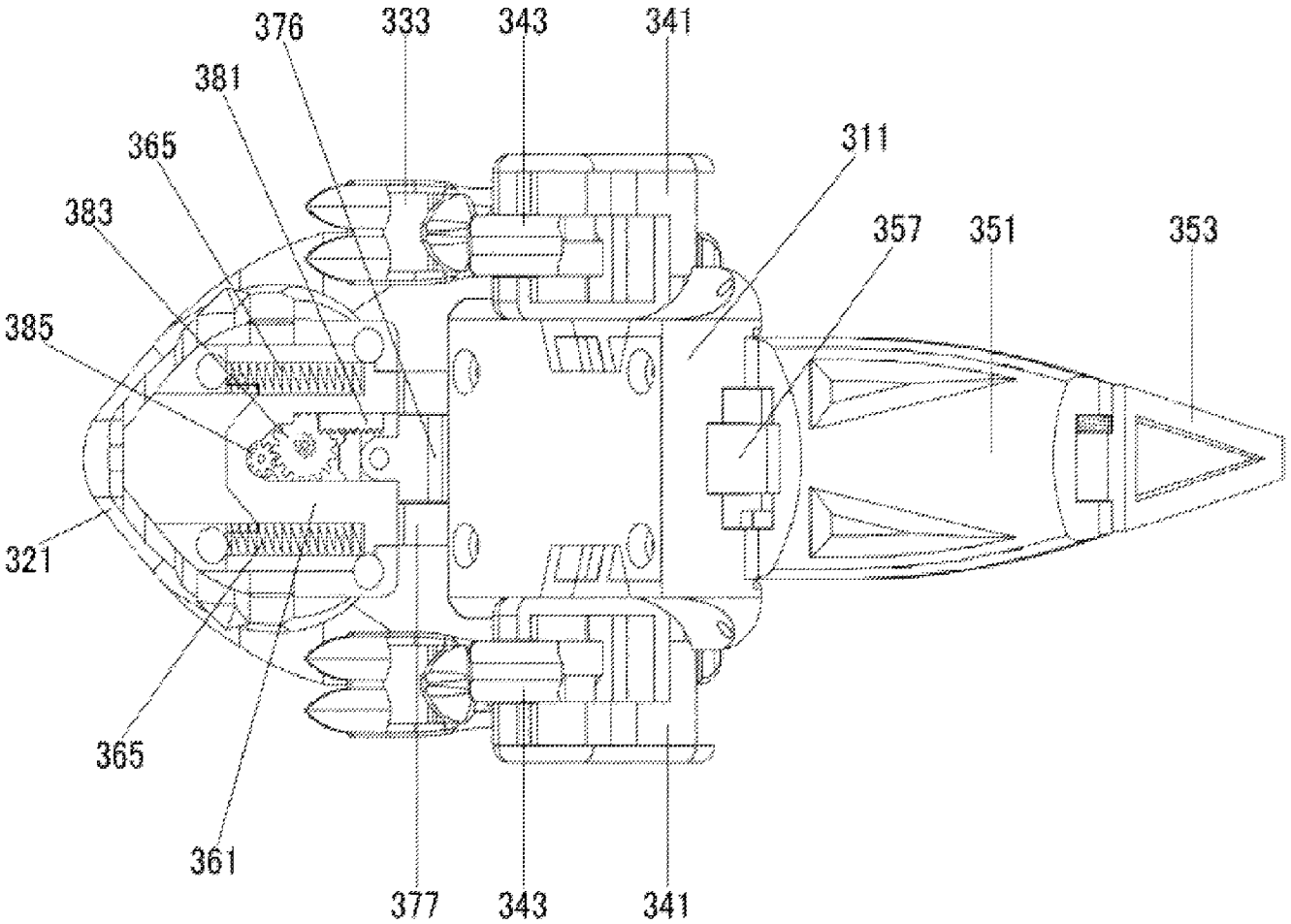
FIG. 25 is a view showing an interior of a head portion of the third embodiment of the transformable toy according to the invention.

The head portion 321 incorporates the sliding member 361 as the rotating mechanism, a rack 381 and a pinion 385, and locking releasing elastic members 365. As is shown in FIG. 25, the sliding member 361 provided has a substantially U-shape and is connected to the neck member 377 by a rotational shaft at the rear end thereof. The locking releasing elastic members 365 are provided on outer sides of the sliding member 361, so as to bias the head portion 321 to the front relative to the sliding member 361. Additionally, guide walls are provided on outer sides of the locking releasing elastic members 365, so that the sliding member 361 is allowed to be translated only in one direction with respect to the front-to-rear direction relative to the head portion 321.

Further, the rack 381 is provided on an inner side of one of front and rear sides of the sliding member 361, and an acceleration gearwheel 383 and the pinion 385 which is fixed to the roulette wheel spindle 387 are provided rotatably in the head portion 321 inside the sliding member 361. As is shown in FIGS. 23 and 25, although a small gearwheel of the acceleration gearwheel 383 is away from the rack 385, when the head portion 321 is positioned at the front, in such a state that the head portion 321 is withdrawn so that the head portion 321 is brought into engagement with the trunk portion 311, the rack 385 and the small gearwheel are disposed to mesh with each other.

In addition, with a large gearwheel of the acceleration gearwheel 383 caused to mesh with the pinion 385 which is fixed to the roulette wheel spindle 387, when the engaged state between the head portion 321 and the trunk portion 311 is released and the head portion advances relative to the sliding member 361 by the locking releasing elastic members 365, the pinion 385 is rotated by the rack 381 via the acceleration gearwheel 383 so as to rotate the roulette pan 389 which is mounted on the roulette wheel spindle 387.

Then, when the head portion 321 is positioned on an extension of the trunk portion 311 so as to raise the distal end of the head portion 321 and the head portion 321 is pushed in the direction of the trunk portion 311 so that the head portion 321 is withdrawn relative to the sliding member 361, the head portion 321 is withdrawn relative to the sliding member 361 so as to compress the locking releasing elastic members 365. When the head portion 321 is withdrawn to a position where the connecting portion between the sliding member 361 and the neck member 377 is accommodated in the head portion 321, the distal end of the sliding member 361 comes into contact with a front wall of an inner cavity in the head portion 321, and the sliding member 361 and the neck member 377 are withdrawn together with the head portion 321. Then, when the rear end of the head portion 321 approaches the front end of the trunk portion 311, the head portion locking piece 376 comes into engagement with the rear end of the head portion 321 so as to lock the head portion 321. As this occurs, the foot fixing pieces 378 which are formed at the rear of the neck member 377 are exposed to the lower surface of the trunk portion 311 by the withdrawal of the neck member 377.

Consequently, the transformable toy 300 can be transformed from the second form in which the toy stands on the two hind legs as is shown in FIG. 24 into the first form as is shown in FIG. 3 and the like by folding the lower leg portions 343 and the upper leg portions 341 onto the foot portions 345 while fastening the trunk portion 311 downwards, pressing the trunk portion 311 against the flat plane so as to fold the trunk portion 311 to the front horizontally so that the engagement projecting pieces of the foot portions 345 are positioned on a lower side of the trunk portion 311, placing the head portion 321 in the extended position of the trunk portion 311 so that the lower jaw portion 353 is closed on the flat plane, further, superposing the tail portion 351 on the upper surface of the trunk portion 311 by folding the tail end portion 353 to the front so that the tail end portion 353 is wound into the inside of the tail portion 351 and as in the form shown in FIG. 23, pushing the head portion 321 in the direction of the trunk portion 311 so as to push the sliding member 361 and the neck member 377 in the direction of the trunk portion 311 while compressing the locking releasing elastic members 365 so that the head portion 321 is brought into engagement with the trunk portion 311.

In this way, the transformable toy 300 standing on the two hind limbs can be transformed into the first form by folding the lower leg portions 343 and the upper leg portions 341 downwards so that with the trunk portion 311 pressed downwards, the lower leg portions 343 are rotated downwards to the front and the upper leg portions 341 are rotated downwards to the rear so as to be superposed on the lower leg portions 343, rotating the trunk portion 311 to the front so as to cause it to lie between the upper leg portions 341, rotating the tail end portion 353 to the front, further, rotating the tail portion 351 to the front and folding the tail end portion 353 and the tail portion 351, and pushing the head portion 321 into the trunk portion 311.

In this folding operation, the character constituting members to be folded are rotated individually to predetermined positions in an ensured fashion without damaging the character constituting members and against the elastic forces of the rotating elastic members so that the character constituting members are locked to each other. Therefore, the skill to fold them quickly is necessary. Once getting used to folding the character constituting members, a quick folding operation can be attained in which a plurality of character constituting members can be rotated through a single folding step.

Additionally, the form of the two-legged animal is not limited to the form of past extinct animals such as the dinosaurs shown in the figures. Forms can be adopted which imitate currently existing animals or imaginary animals or an animal standing on its two hind limbs which usually stands on four limbs. Further, character constituting members can be combined so as to realize forms which imitate real multi-legged animals or imaginary animals having four or six hands (arms) rather than having two hands, and a trunk portion is raised by foots (legs) lying closest to a rump portion or foots (legs) lying closest to the rump and the rump. Thus, character constituting members can be combined to realize various forms.

As the two-legged animal standing on the two hind legs, the form of a human being or person can also be adopted who wears gears such as armor on his or her whole body. Additionally, the form of a robot standing on two legs can also be adopted which imitates the form of a human being as is shown in FIGS. 4 and 8.

Figure 8:
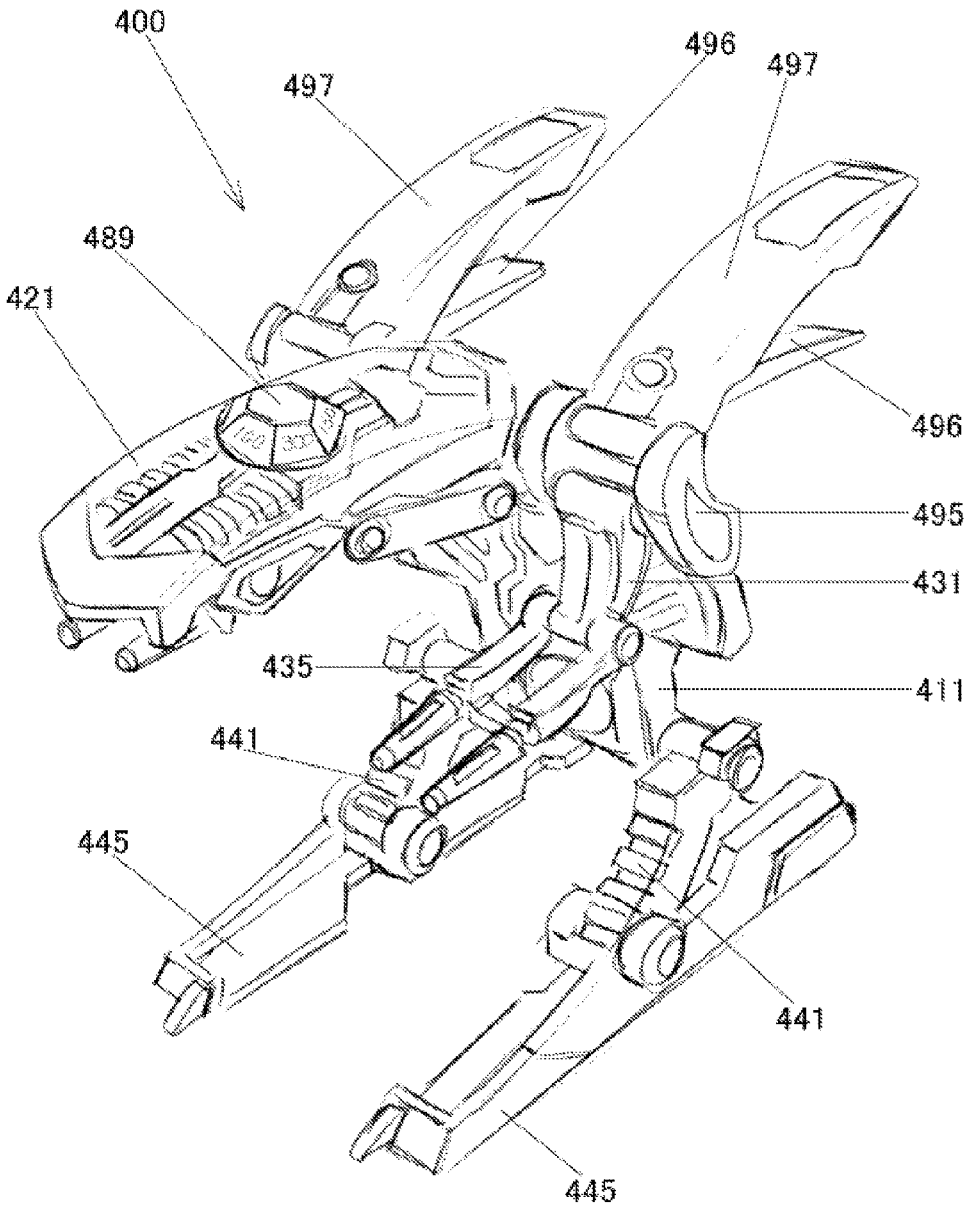
FIG. 8 is a perspective view showing a second form of the third embodiment of the transformable toy according to the invention with constituting members changed.

When the form of robot is adopted, as is shown in FIG. 8, a head portion 421 which includes a roulette pan 489 is provided at an upper end of a trunk portion 411 via a neck portion. Leg portions 441 are provided on left- and right-hand sides of a lower end of the trunk portion 411 via rotational shafts which each include a rotating elastic member. Foot portions 445 are provided at lower ends of the leg portions 441 via rotational shafts which each include a rotating elastic member, so that the foot portions 445 are connected to the lower ends of the leg portions 441 in substantially central positions of the foot portions 445.

Shoulder armor portions 495 are provided on sides of the trunk portion 411 so as to extend therefrom, and upper arm portions 431 are provided on front sides of upper ends of the shoulder armor portions 495 via rotational shafts which each include a rotating elastic member. Then, forearm portions 435 are provided at distal ends of the upper arm portions 431 via rotational shafts which each include a rotating elastic member. Inner armor portions 496 and outer armor portions 497 are provided on rear sides of the upper ends of the shoulder armor portions via rotational shafts which each include a rotating elastic member.

Figure 4:
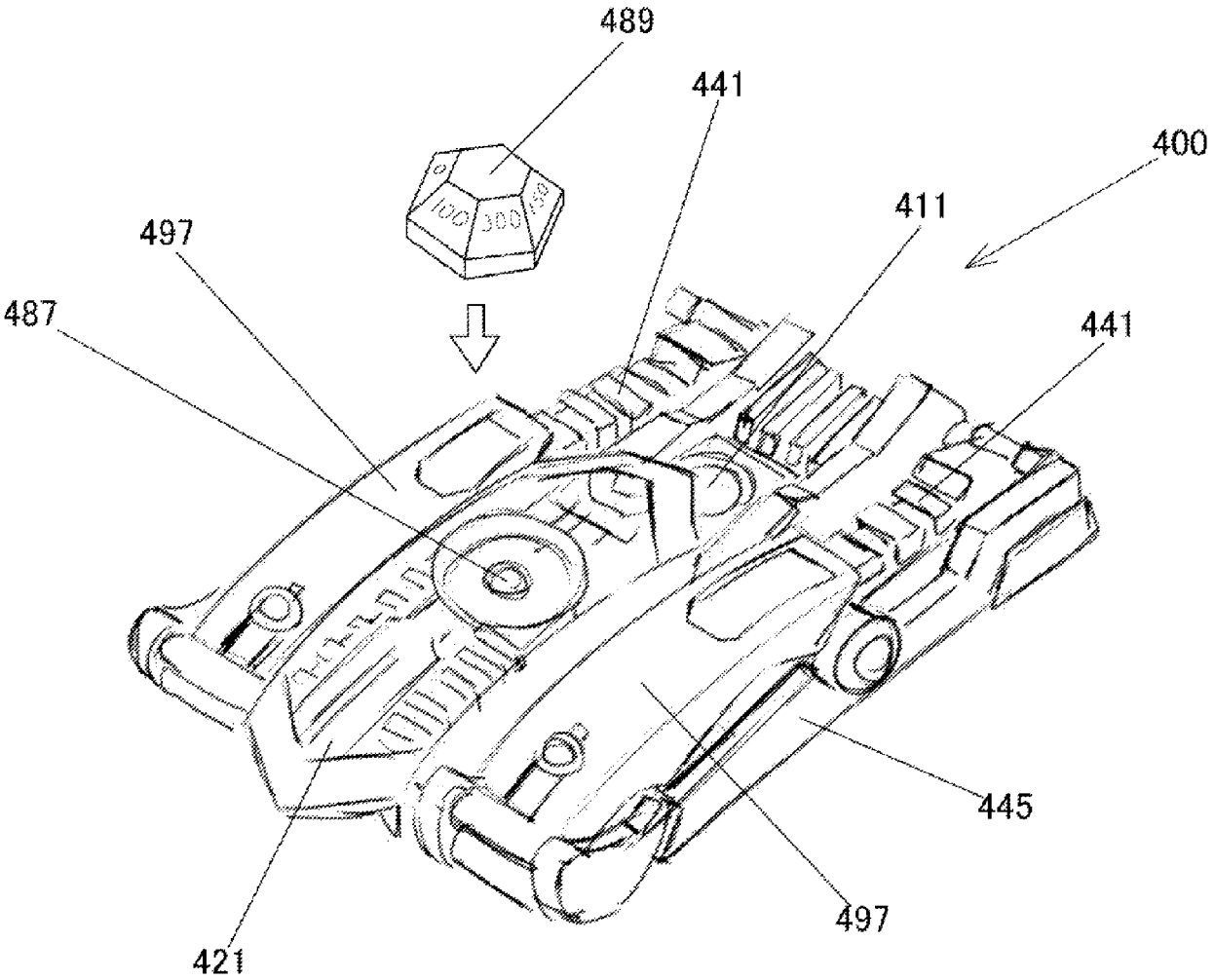
FIG. 4 is a perspective view showing a first form of the third embodiment of the transformable toy according to the invention with constituting members changed.

Consequently, this transformable toy also can be transformed into a first form shown in FIG. 4 by folding the leg portions 441 downwards to the rear so as to be superposed on rear half portions of the foot portions 445 against the elastic forces of the rotating elastic members thereof, folding the upper arm portions 431 and the forearm portions 435 so as to be superposed one on the other to thereby be folded onto front surfaces of the shoulder armor portions 495, causing the trunk portion 411 to lie to the front and folding the shoulder armor portions 495 so as to be superposed on front half portions of the foot portions 445 and folding the inner armor portions 496 and the outer armor portions 497 downwards to the rear so as to be superposed on the shoulder armor portions 495, and bringing the head portion 421 into engagement with the distal end of the trunk portion 411 so as to push the neck portion into the trunk portion 411.

In this way, this transformable toy 400 which stands on the two hind legs can be transformed into the first form by following the folding procedure of folding so as to rotate the leg portions 441 downwards with the trunk portion 411 pressed downwards, rotating the trunk portion 411 and the shoulder armor portions 495 to the front so as to be folded and rotating the inner armor portions 496 and the outer armor portions 497 downwards to the rear.

In this folding operation, the character constituting members to be folded are rotated individually to predetermined positions in an ensured fashion without damaging the character constituting members and against the elastic forces of the rotating elastic members so that the character constituting members are locked to each other. Therefore, skill is necessary to fold them quickly. Once getting used to folding the character constituting members, a quick folding operation can be attained in which a plurality of character constituting members can be rotated through a single folding step.

In these transformable toys 100, 200, 300, 400, although the roulette pan can detachably be mounted on the roulette wheel spindle, there may be adopted a case where a roulette wheel is used in which a roulette pan is fixed to a roulette wheel spindle. In addition, the invention is not limited to the case where the hexagonal disc-like roulette pan is used which rotates along the surface of the character constituting members such as the trunk portion, the head portion and the like shown in the figures. Thus, there may be adopted a case where a cylindrical roulette drum is used which has a rotational shaft which is substantially parallel to an outer surface of the character constituting members.

Further, the invention is not limited to the roulette pan on which numerals are shown at random. Hence, there may be adopted a case where a roulette pan is used on which characters or symbols are written which denote "wood," "fire," "earth," "metal," and "water" which represent attributes of the creation based on the idea of five natural elements or a roulette pan is used on which characters or symbols are written which denote different types of jewels. In addition, there may also be adopted a case where the roulette pans described above are prepared so that the roulette pans can be replaced with one another for use.

In this way, the transformable toys 100, 200, 300, 400 according to the embodiments of the invention adopt the substantially flat plate-like shape as the first form. For example, two players place their own transformable toys which are folded so as to confront each other. Then, the players press the lock releasing buttons of the lock releasing levers which act as the release control portions of their own transformable toys at the same time so that the transformable toys folded are transformed into the second forms which are the three-dimensional forms of the characters. Then, the players can play be competing against each other to win or lose a game by scores obtained by attack or defense based on positions where the roulette pans stop when the characters stand on their feet (legs) or for superiority or inferiority based on kinds or attributes shown on the roulette pans. Thus, with the transformable toys of the embodiments, plays or games can be played which involve lots of changes.

In addition, as has been described heretofore, the character constituting members of the transformable toys 100, 200, 300, 400 described in the embodiments have the complex configurations, and the required skill and the folding operations according to the appropriate folding procedure are necessary to fold the character constituting members which are deployed. Thus, by making use of this aspect, a play or a game can be played in which the players can compete against each other for time spent folding the character constituting members. Alternatively, the release control portion for releasing locking is positioned at the end portion of the substantially flat plate-like shape into which the character constituting members are folded and the position where the release control portion is provided is slightly unstable. In addition, the opening operation from the biased state by the elastic forces is involved. Therefore, in case a proper operation fails to be performed on the release control portion, there is a possibility that the transformable toy loses its balance to fall. By making use of difficulties involved in the operation of the transformable toy, the players can play a game in which they compete against each other for a successful standing of the transformable toy on the four or two legs without falling. In playing these plays, the players can enjoy the plays even in the event that a configuration is adopted in which the roulette wheel is made unnecessary with the roulette pan as the roulette wheel and the rack and the pinion removed.

In addition, in the transformable toy 100 having the form imitating the four-legged animal standing on four limbs shown in FIGS. 5 and 11, a cam projection is provided at an end portion of the tail portion 151 which lies in the interior of the trunk portion 111. In the second form in which the character appears, the sliding member is caused to slide so that the sliding member 161 is pushed to the front in response to the lowering of the tail portion 151, whereby the elastic members 165 are compressed, whereas when the lowering operation of the tail portion 151 is stopped to release the tail portion 151, the roulette pan 189 starts to rotate. Thus, in this configuration, the players can also compete against each other to win or lose a game based on the roulette wheel in the state where the character appears by manipulating the tail portion 151.

Figure 26:
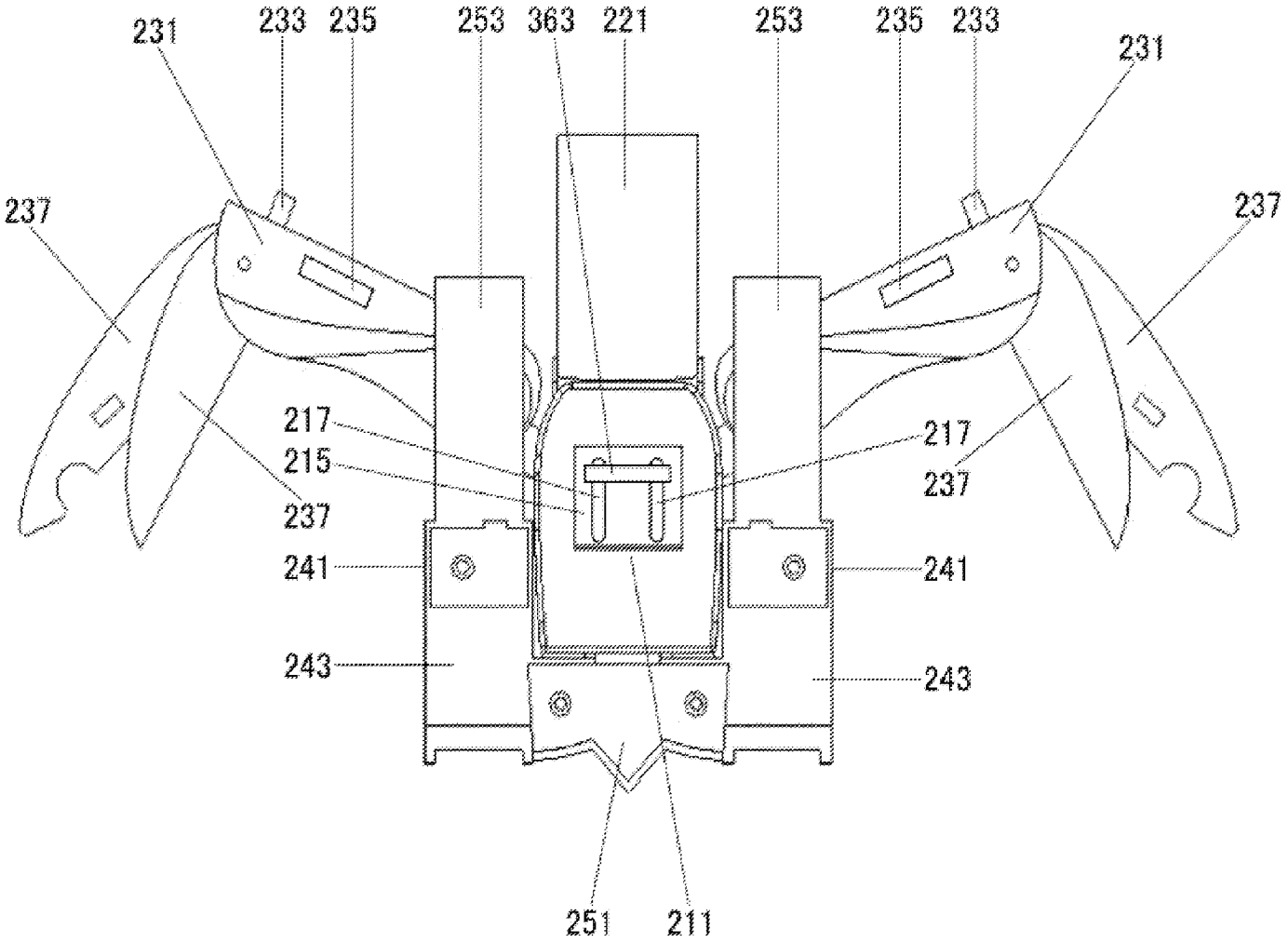
FIG. 26 is a back side view showing a modified example of the second embodiment of the transformable toy according to the invention.

Similarly, in the transformable toy 200 shown in FIGS. 17 and 18, as is shown in FIG. 26, a rectangular recess portion 215 is provided in the back side of the trunk portion 211, and two through grooves 217 are formed in an interior of the recess portion 215. Then, a plate-like control member 263 is disposed so as to be accommodated in the recess portion 215. Projecting portions, not shown, which are formed on an inner surface of the control member 263 are put through the through grooves 217 so as to be fixedly connected to the sliding member 261 which is disposed within the trunk portion 211, so that the control member 263 is made integral with the sliding member 261. The control member 263 is lowered and the sliding member 261 is shifted so as to compress the elastic members. Then, when the pressure with which the control member 263 is lowered is released, the roulette pan 289 starts to rotate by the elastic forces of the elastic members which are released from the compressing operation, whereby the players can also compete against each other to win or lose a game based on the roulette wheel in the state where the character appears.

Figure 27:
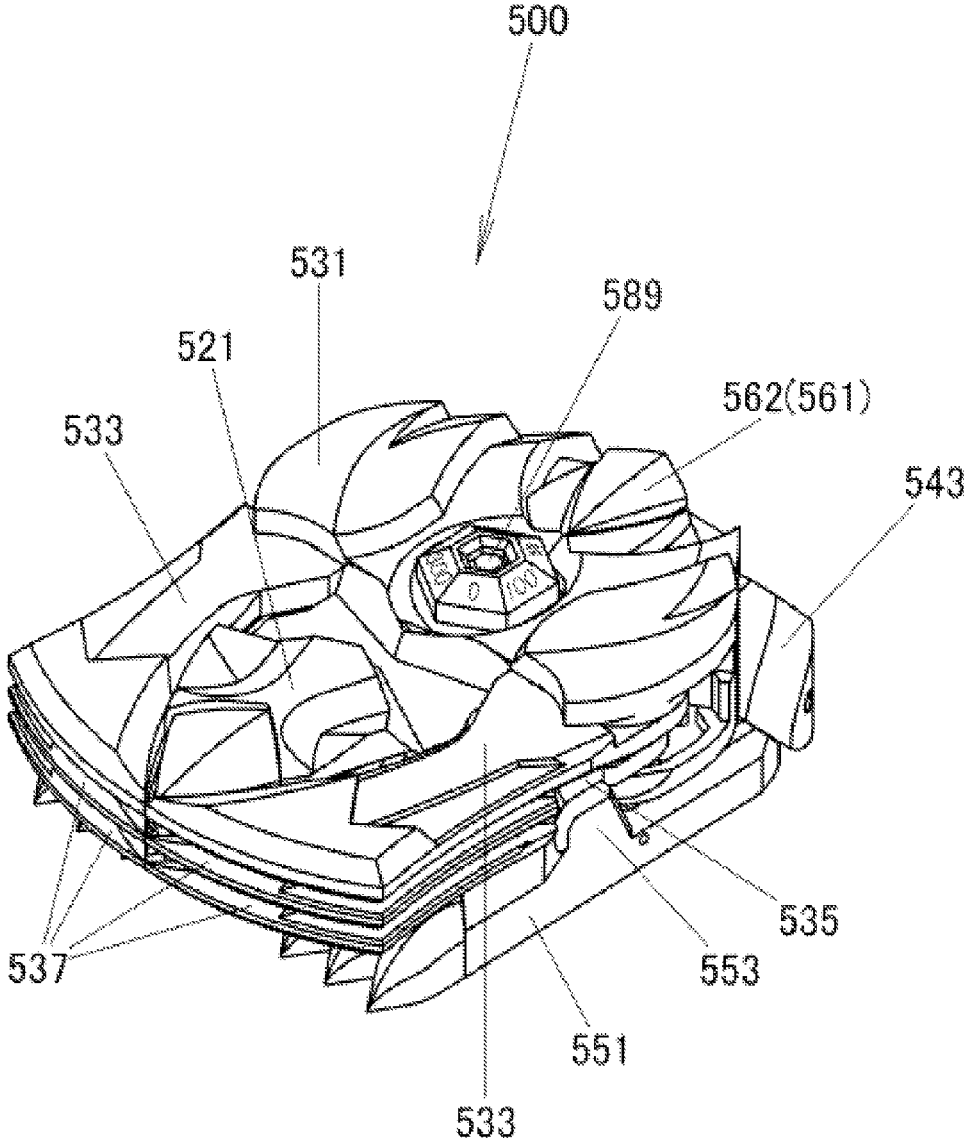
FIG. 27 is a perspective view showing a first form of a fifth embodiment of a transformable toy according to the invention.
Figure 28:
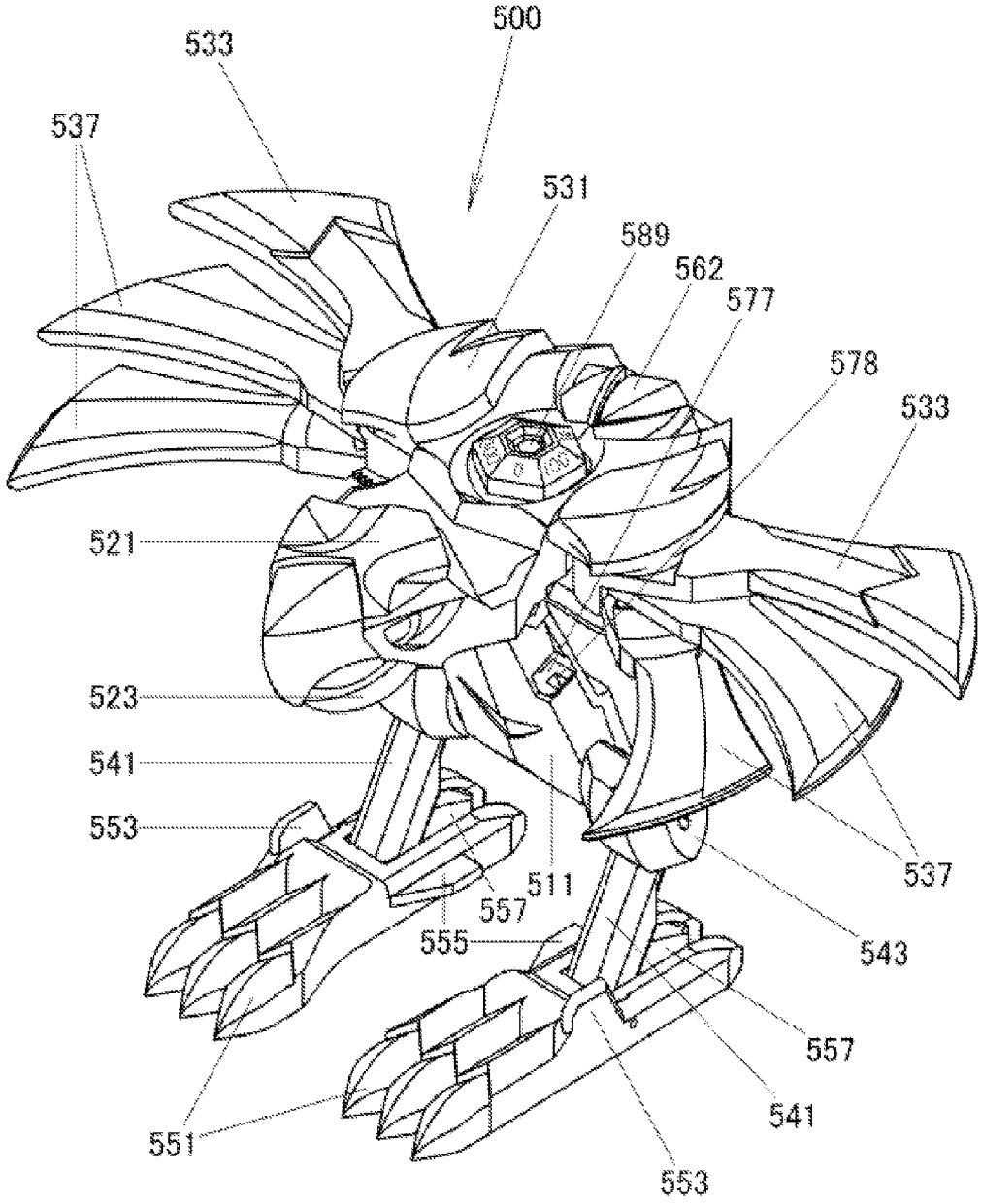
FIG. 28 is a forward perspective view of a second form of the fifth embodiment of the transformable toy according to the invention.

In addition, as is shown in FIGS. 27 and 28, a transformable toy 500 can be provided in which character constituting members 533 having a rotational shaft parallel to a rotational shaft of a roulette pan 589 are provided on a character constituting member 531 on which the roulette pan 589 is detachably provided.

In this transformable toy 500, as a rotating mechanism, a large gearwheel is provided, in place of the rack, on the character members 533 which rotate on substantially the same plane as a rotational plane of a pinion, so that the pinion is rotated directly or via an acceleration gearwheel by the large gearwheel, whereby the roulette pan 589 is rotated while being linked with the movements of the character members 533.

As is shown in FIGS. 27 and 28, this transformable toy 500 has the roulette pan 589 on the back portion 531. The transformable toy 500 has main movable wings 537 and auxiliary movable wings 537 which are provided rotatably on the back portion 531. As is shown in FIG. 27, these main movable wings 533 and the auxiliary movable wings 537 are folded to left- and right-hand sides of a head portion 521, and the movable wings are fastened by locking projections 553 on foot portions 551, whereby the transformable toy 500 is folded into a substantially flat plate-like first form. Then, when a control button 562 of a release control portion provided at the rear of the back portion 531 is pressed down, as is shown in FIG. 28, the transformable toy 500 is transformed into a second form in which the form of a character appears.

Figure 29:
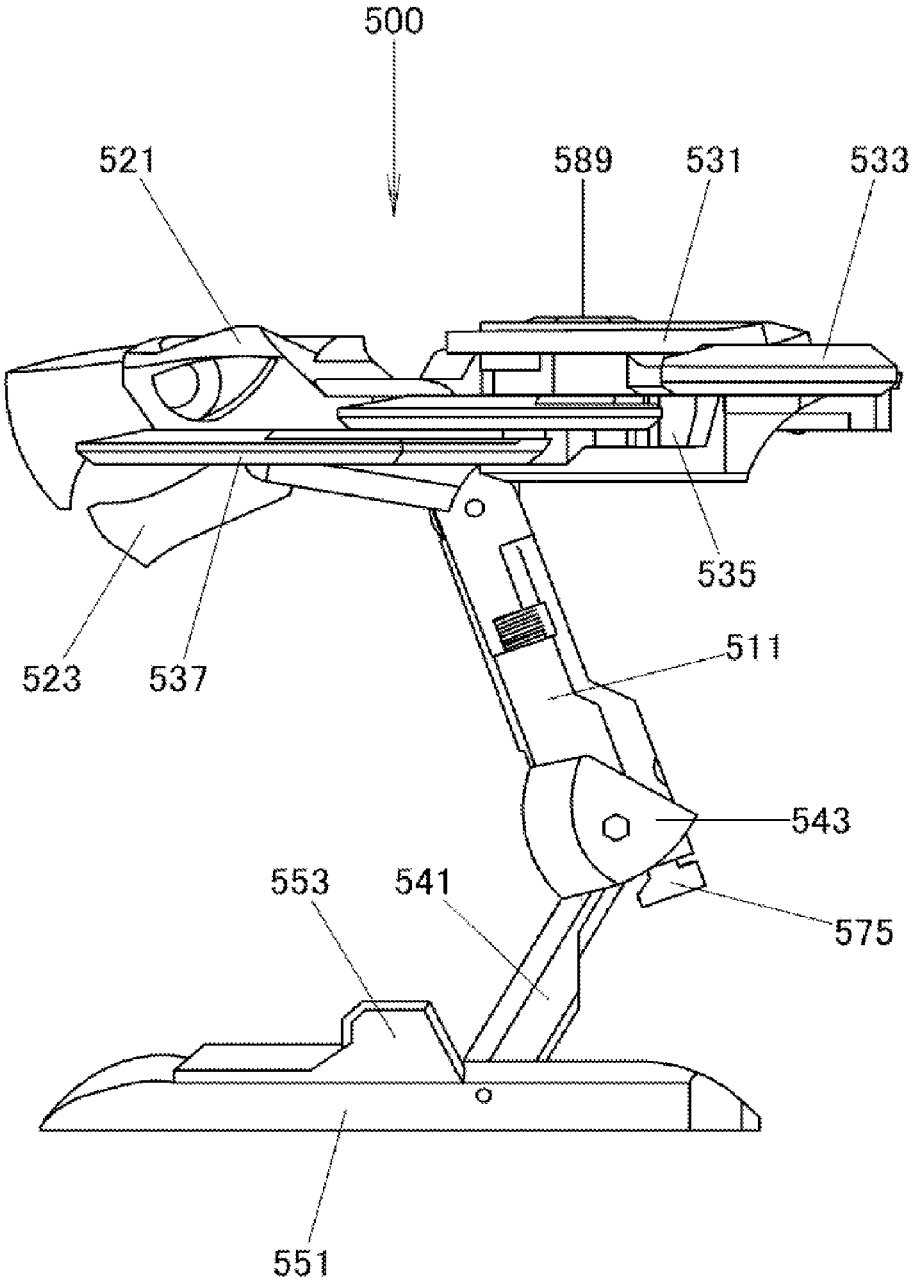
FIG. 29 is a side view showing the second form of the fifth embodiment of the transformable toy according to the invention.

As is shown in FIGS. 28 and 29, this transformable toy 500 has a lower jaw portion 523 on a lower surface of a front of the head portion 521 and the back portion 531 which is integrated with the head portion 521 at the rear of the head portion 521. An upper end of a trunk portion 511 is attached to a rear end of the head portion 521 by a rotational shaft which includes a rotating elastic member, and leg portions 541 are attached to a lower end of the trunk portion 521 with leg proximal portions 543 positioned on left- and right-hand sides of the lower end of the trunk portion 511 by rotational shafts which each include a rotating elastic member.

Then, a distal end of the leg portion 541 is attached to substantially a center of the foot portion 551 by a rotational shaft which includes a rotating elastic member. The foot portion 551 has a groove-like accommodation recess portion 557 which can accommodate the leg portion 541 in a position lying further rearwards than the portion where the leg portion 541 is attached, a locking projection 553 which projects upwards from an outer surface of a portion of the foot portion 551 which lies slightly further forwards than a center thereof and a fixing projection 555 which projects laterally inwards from an inner surface of a portion of the foot portion 551 which lies slightly further rearwards than the center thereof towards an inner surface of the corresponding foot portion.

Figure 33:
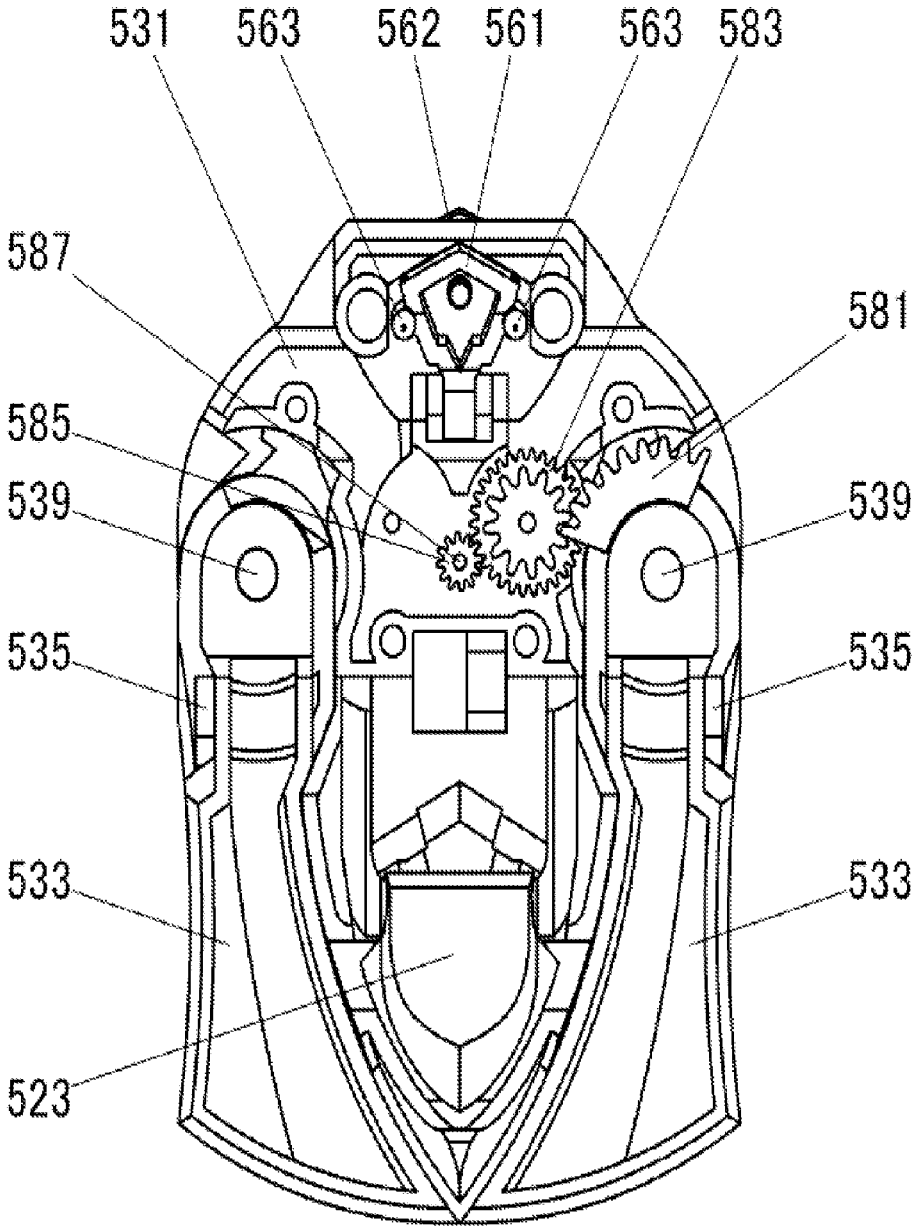
FIG. 33 is a view showing interiors of a head portion and a back portion of the fifth embodiment of the transformable toy according to the invention.

The main movable wings 533 are attached to sides of the back portion 531 in positions lying in the vicinity of a front thereof. In an interior of the back portion 531, as is shown in FIG. 33, the main movable wings 533 are fixed rotatably to the back portion 531 by wing rotating shafts 539. The auxiliary movable wings 537 are also attached rotatably to the wing rotating shafts 539. The respective movable wings of the main movable wings 533 and the auxiliary movable wings 537 are biased so that the movable wings are opened at respective distal ends thereof by rotating elastic members which are wound round the wing rotating shafts 539.

Then, the left and right main movable wings 533 which are superposed on the auxiliary movable wings 537 have wing locking projections 535 which project downwards on portions of outer edges which lie in the vicinity of proximal portions thereof. As is shown in FIG. 27, these wing locking projections 535 are positioned laterally inwards of the locking projections 553 of the foot portions 551, and in the first form, the main movable wings 533 are prevented from being opened by the wing locking projections 535, and the auxiliary movable wings 537 are also prevented from being opened by the wing locking projections 535.

In addition, a fan-shaped large gearwheel 581 which rotates about the wing rotating shaft 539 is provided inside the back portion 531 at a proximal portion of one of the main movable wings 533. This large gearwheel 581 can mesh with a small gearwheel of an acceleration gearwheel 583, and a large gearwheel of the acceleration gearwheel 583 meshes with a pinion 585 on a roulette wheel spindle 587.

Figure 31:
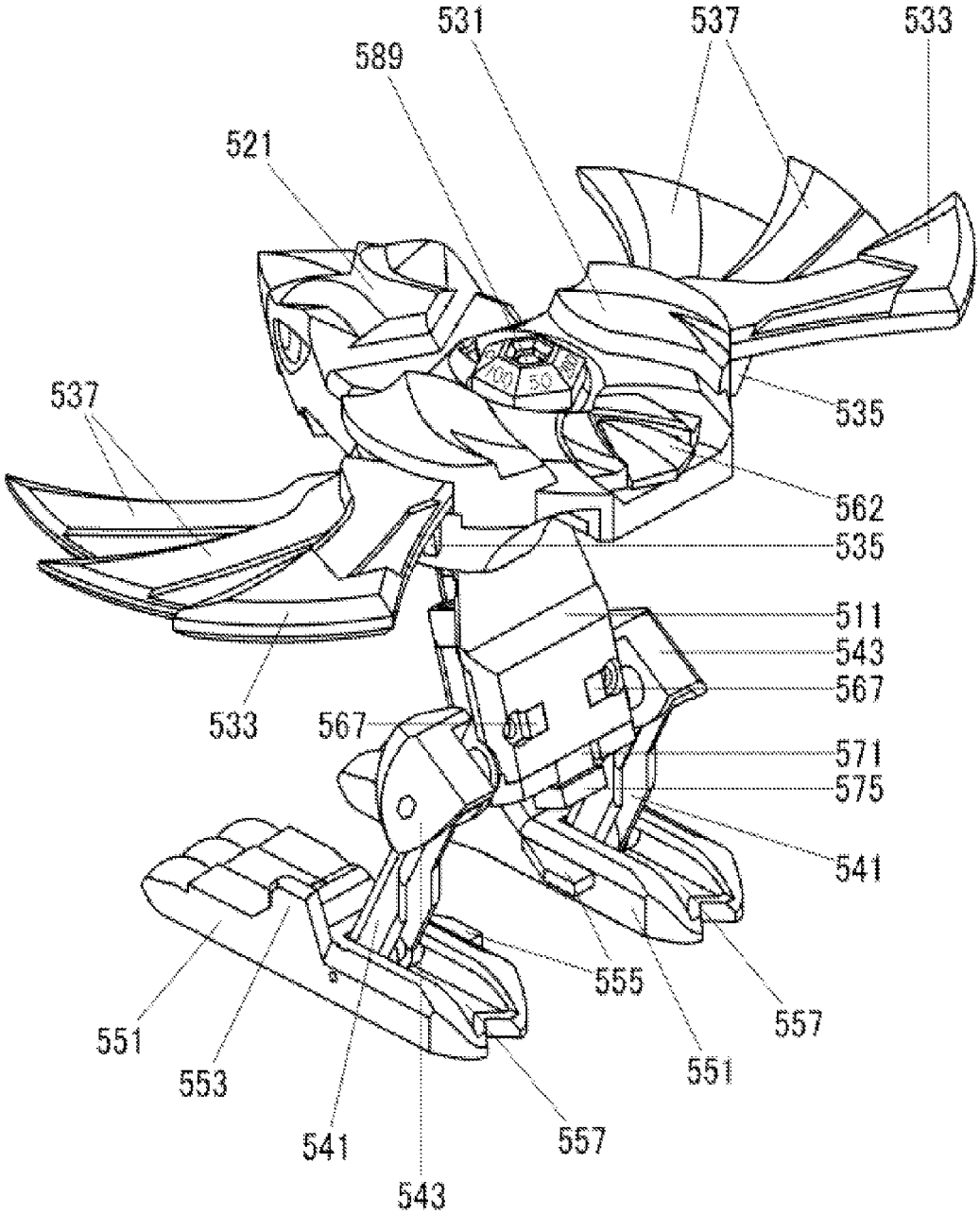
FIG. 31 is a rearward perspective view showing the second form of the fifth embodiment of the transformable toy according to the invention.

Then, this transformable toy 500 has a locking member 571 as a locking means and release members 567 in an interior of the back portion 531. As is shown in FIG. 32, the locking member 571 is biased to the rear (downwards in FIG. 32) by a locking releasing elastic member 565 which is disposed at a front end thereof, and in the second form in which the form of the character appears, a flat plate-like locking control portion 575 which is formed at a rear end of the locking member 571 is caused to project to the rear (downwards in the figure) of the trunk portion 511 as is shown in FIG. 31.

In addition, the locking member 571 has a substantially prism-shaped main body portion 573 and is accommodated in the interior of the trunk portion 511 so as to slide in a front-to-rear direction. The locking control portion 575 as has been described above is provided at a rear end of the main body portion 573, and fixing and locking portions 577, which include groove-like locking grooves 578 which extend in the front-to-rear direction in outer sides thereof, are provided on left- and right-hand sides of a front end of the main body portion 573.

Then, releasing members 567 are disposed on left- and right-hand sides of a portion of the main body portion 573 of the locking member 571 which lies substantially further rearwards than a center thereof, and these releasing members 567 are connected together by a connecting rod, not shown, on a lower surface side of the main body portion 573. The releasing members 567 are biased upwards by elastic members which are accommodated in interiors of the releasing members 567, whereby the connecting rod is in press contact with a lower surface of the main body portion 573.

Figure 32:
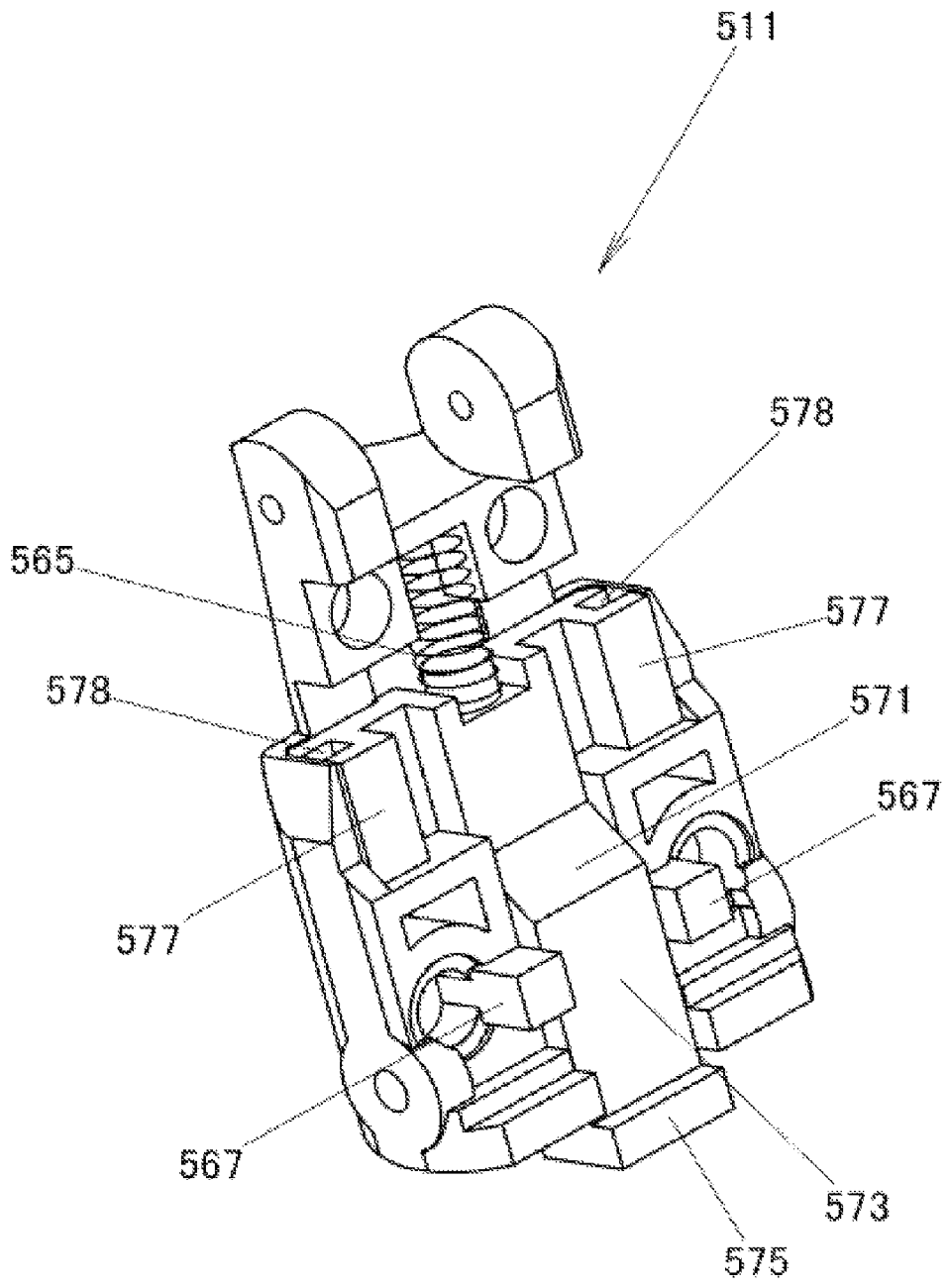
FIG. 32 is a perspective view showing an interior of a trunk portion of the fifth embodiment of the transformable toy according to the invention.

The main body portion 573 of the locking member 571 has a groove reaching left and right ends of the main body portion 573 and being able to accommodate the connecting rod at a portion lying further rearwards (downwards in FIG. 32) than the connecting rod of the releasing members 567 in a state in which the locking member 571 is withdrawn as is shown in FIG. 32. When the locking member 571 is shifted to the front so as to compress the locking releasing elastic member 565, the connecting rod is accommodated in the groove so as to prevent the withdrawal of the main body portion 573.

Then, when the locking member 571 is positioned at the front and the connecting rod is accommodated in the groove, distal ends of the fixing and locking portions 577 provided on the left- and right-hand sides of the front end of the main body portion 573 are exposed on both sides of the trunk portion 511.

When the connecting rod is removed from the groove, allowing the locking member 571 to be withdrawn and the locking control portion 575 is caused to project from the rear end of the back portion 531, the distal ends of the releasing members 567 which are disposed on the sides of the locking member 571, as is shown in FIG. 31, are made substantially level with an upper surface of the back portion 531 so that the distal ends are exposed to the upper surface of the back portion 531. The distal ends of the releasing members 567 project slightly from the upper surface of the back portion 531 to thereby prevent the withdrawal of the locking member 571 when the connecting rod is accommodated in the groove.

Consequently, the transformable toy 500 can be transformed from the second form in which the form of the character shown in FIG. 28 and the like appears to the first form in which the character constituting members are caused to approach each other so as to be folded together so that the head portion 521 and the trunk portion 511 are placed between the foot portions 551 in such a manner that the auxiliary movable wings 537 and the main movable wings 533 rest on the foot portions 551 and that the back portion 531 rests on the rear half portions of the foot portions 551 as is shown in FIG. 27 by performing the folding operation of rotating the main movable wings 533 and the auxiliary movable to the front so as to be positioned on the left- and right-hand sides of the head portion 521 and folding the whole of the trunk portion 511 downwards to cause the trunk portion 511 to approach the foot portions 551 to thereby enable the leg portions 541 to be accommodated in the accommodation recess portions 557 in the foot portions 551 against the forces of the rotating elastic members provided on the rotational shafts which connect the trunk portion 511 and the leg portions 541 and the rotating elastic members provided on the rotational shafts which connect the leg portions 541 and the foot portions 551 while performing the folding operation of superposing the back portion 531 and the trunk portion 511 one on the other against the force of the rotating elastic member provided on the rotational shaft which connects the back portion 531 and the trunk portion 511 with the rear of the back portion 531 fastened from thereabove.

Figure 30:
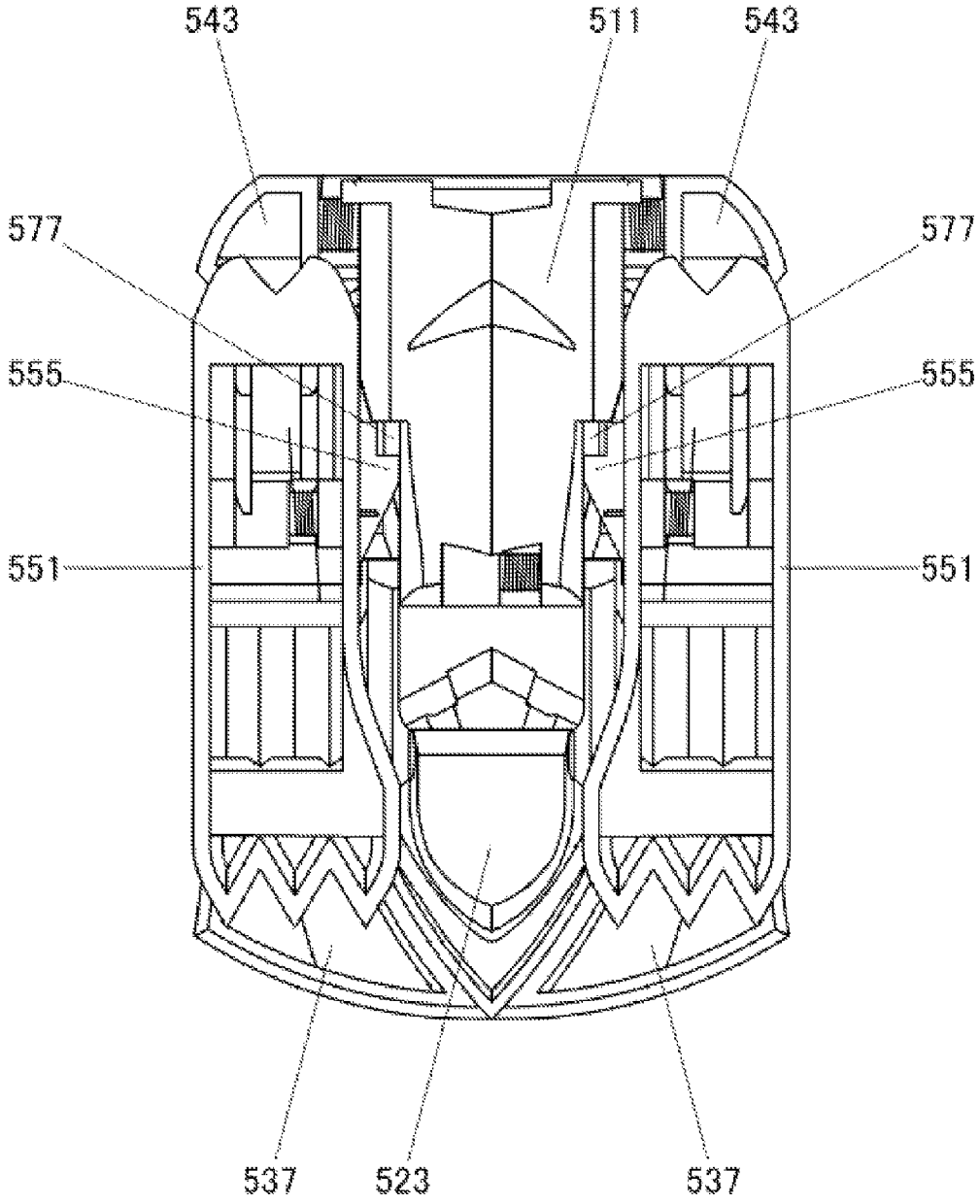
FIG. 30 is a bottom view showing the first form of the fifth embodiment of the transformable toy according to the invention.

Then, in this state, when the locking control portion 575 which projects from the rear end of the trunk portion 511 is pushed into the interior of the trunk portion 511, the locking member 571 advances in the interior of the trunk portion 511, causing the distal ends of the fixing and locking portions 577 to project to the sides of the trunk portion 511 and bringing the distal ends of the fixing and locking portions 577 into engagement with the fixing projections 555 as is shown in FIG. 30 so that inner distal edges of the fixing projections 555 which are provided on the inner sides of the foot portions 551 are held in the locking grooves 578 in the fixing and locking portions 577, whereby the separation of the trunk portion 511 from the foot portions 551 is prevented.

Because of this, the state in which the head portion 521 rests on the foot portions 551 can be maintained by positioning the trunk portion 511 between the rear half portions of the foot portions 551 with the leg portions 541 accommodated within the accommodation recess portions 557 and placing the movable wing portions on the front half portions of the foot portions 551 while placing the back portion 531 on the rear half portions of the foot portions 551.

In this way, the transformable toy 500 which opens the wings laterally widely can be transformed into the first form by folding the left and right main movable wings 533 and auxiliary movable wings 537 to the sides of the head portion 521 from the left and right so as to rotate them to the front, rotating the leg portions 541 downwards to the rear by pressing downwards the head portion 521 and the back portion 531 while maintaining them horizontal, folding the leg portions 541 and the trunk portion 511 so as to rotate the trunk portion 511 downwards to the front, superposing the back portion 531 on the foot portions 551 and pushing the locking control portion 575 into the trunk portion 511.

In this folding operation, the character constituting members to be folded are rotated individually to predetermined positions in an ensured fashion without damaging the character constituting members and against the elastic forces of the rotating elastic members so that the character constituting members are locked to each other. Therefore, skill is necessary to fold them quickly. Once getting used to folding the character constituting members, a quick folding operation can be attained in which a plurality of character constituting members can be rotated through a single folding step.

When the control button 562 of the release control portion 561 provided at the rear end of the back portion 531 is pressed down, since this release control portion 561 has the control button 562 on the upper surface of the back portion 531 and two cylindrical releasing projections 563 in the interior of the back portion 531 as is shown in FIG. 33 and distal ends of both the releasing projections 563 are in contact with upper surfaces of the releasing members 567 which project slightly from the upper surface of the trunk portion 511 in the first form in which the character constituting members are folded, the releasing members 567 are pressed downwards due to the control button 562 being pressed downwards, whereby the connecting rod of the releasing members 567 is removed from the groove, allowing the locking member 571 to be withdrawn.

Consequently, the fixing projections 555 which are provided on the foot portions 551 are removed from the locking groove 578 in the fixing and locking portions 577 by the withdrawal of the locking member 571, and the leg portions 541 are raised by the rotating elastic members so as to raise the leg proximal portions 543. Similarly, the trunk portion 511 also rises so as to be separated from the leg portions 541 so that the head portion 521 and the back portion 531 are raised. When the back portion 531 is separated from the foot portions 551, the main movable wings 533 and the auxiliary movable wings 537 rotate so as to expand laterally, providing a large change in form.

In addition, when the main movable wings 533 and the auxiliary movable wings 537 expands in the way described above, the large gearwheel 581 which is provided at the proximal portion of the main movable wing 533 meshes with the acceleration gearwheel 583 which is incorporated in the interior of the back portion 531 so as to rotate the acceleration gearwheel 583. Thereafter, in such a state that the main movable wings 533 are opened as is shown in FIG. 28, the large gearwheel 581 is separated from the acceleration gearwheel 583, whereby the roulette wheel spindle 587 and the roulette pan 589 stop in a position which is not determined.

Further, in such a state as left and right main movable wings 533 being opened, when the left and right main movable wings 533 are caused to approach the left- and right-hand sides of the head portion 521 so as to close them with the fingers and the fingers are removed from the main movable wings 533 thereafter, the player can play by rotating the roulette pan 589 again.

In place of providing the large gearwheel 581 at the proximal portion of the main movable wing 533, a rack which can mesh with the small gearwheel of the acceleration gearwheel 583 is incorporated slidably in the back portion 531, and a slide button is provided in the back portion 531 or the head portion 521 which enables the rack acting as a sliding member to be translated back and forth while incorporating together an elastic member which biases the rack as the sliding member in one direction. When the transformable toy 500 is transformed from the first form to the second form, without the rotation of the roulette pan 589, the rack as the sliding member is shifted together with the slide button so as to compress the elastic member by pressing sideways the slide button with the finger tip in the first form or the second form. Then, the roulette pan 589 starts to rotate when the finger is removed from the slide button. Thus, the player can play by rotating the roulette pan 589 in that way.

Further, as has been described heretofore, the character constituting members of the transformable toys 100, 200, 300, 400, 500 that have been described in the embodiments above have the complex configurations in which the axes of the rotational shafts are oriented in the left-to-right direction, the vertical direction or the front-to-rear direction in the first form. Also, in the folding operation of folding the character constituting members which are deployed, the character constituting members need to be folded with required skill and an appropriate folding procedure in which the front-to-rear, left-to-right and vertical folding operations and pushing operation are combined, and therefore, the players can play by competing against each other for time spent folding the character constituting members.

In addition, the release control portion for releasing locking is positioned at the end portion of the substantially flat plate-like shape into which the character constituting members are folded and the position where the release control portion is provided is slightly unstable. In addition, the opening operation from the biased state by the elastic forces is involved. Therefore, in case a proper operation fails to be performed on the release control portion, there is a possibility that the transformable toy loses its balance to fall. By making use of difficulties involved in the operation of the transformable toy, the players can play a game in which they compete against each other for a successful standing of the transformable toy on the four or two legs without falling. In playing these plays in which the players compete for the folding time or successful appearance of the character which stands on the four or two limbs, the players can enjoy the plays even in the event that a configuration is adopted in which the roulette wheel is made unnecessary with the roulette pan as the roulette wheel and the rack and the pinion removed.

The invention claimed is:

1. A transformable toy that is transformable from a first form which represents a folded state to a second form in which the form of a character appears from the first form, the transformable toy comprising:

a plurality of character constituting members that are connected rotatably to one another at a plurality of rotatable portions;

elastic members that are disposed individually between the character constituting members which correspond to the plurality of rotatable portions so as to impart a biasing force in rotational direction individually to the character constituting members;

a roulette pan installation portion that is disposed on any of the character constituting members and on which a roulette pan is detachably installed;

a rotating mechanism that includes an acceleration means for applying a rotational force to rotate drastically the roulette pan which is installed on the roulette pan installation portion and a rotation maintaining mechanism that disconnects the application of the rotational force so as to keep the roulette pan rotating;

locking means for maintaining a state in which the plurality of character constituting members are folded; and a release control portion operated by a lock-releasing button that releases the locking by the locking means;

wherein the character appearing in the second form takes a form imitating a multi-legged animal, wherein the plurality of character constituting members include a trunk portion, a plurality of leg portions that are attached rotatably to the trunk portion and a head portion that is attached to a front of the trunk portion so as to be situated on a front side of the trunk portion, wherein the plurality of leg portions are disposed so as to be folded individually on to a lower surface side of the trunk portion against the elastic forces of the elastic members which are disposed between the head portion and themselves, whereby when folded, the leg portions are transformed into the flat plate-shaped first form in which the form imitating the multi-legged animal is compressed in the vertical direction, wherein the plurality of character constituting members are configured so as to be folded into the first form when folding operations are performed in accordance with a folding procedure, wherein the folding operations performed on the plurality of character constituting members are performed individually against respective elastic forces of the corresponding elastic members which are disposed at the plurality of rotatable portions and compressed states of the elastic members are maintained by the locking means, wherein when the folding operations are performed in accordance with the folding procedure, the plurality of character constituting members and the rotating member are folded into a substantially flat plate-shaped form in which the form of the character is compressed in a vertical direction with the elastic members individually kept in a compressed state and the substantially flat plate-shaped form into which the plurality of character constituting members are folded is maintained by the locking means, wherein the roulette pan is disposed on an upper surface of the head portion or the trunk portion, the rotating mechanism is disposed within the head portion or the trunk portion where the roulette pan is disposed and the elastic member of the rotating mechanism is compressed in the folded state, wherein the rotating mechanism comprises an elastic member that is compressed in any of steps of the folding procedure, the acceleration means which is driven by an elastic force generated when the elastic member is released from the compressed state, means for transmitting a rotational force applied by the acceleration means to the roulette pan and the rotation maintaining mechanism which disconnects the rotational force transmitted from the acceleration means so as to make the rotating motion of the roulette pan continue, wherein when operation for pushing down the lock-releasing button is performed, the plurality of character constituting members are allowed to rotate to pop up altogether by elastic forces of the elastic members which are released then, whereby the plurality of leg portions rotate relative to the trunk portion so that an external appearance of the multi-legged animal rises to pop up as if by the action of a spring from the substantially flat plate-shaped form, whereby the transformable toy rises from the substantially flat plate-shaped form and is then transformed into the second form in which the form of the character can appear as if by the action of a spring, and wherein the roulette pan is driven to rotate by the elastic force of the elastic member which is released from the compressed state in accordance with the timing at which the form of the character so appears and an indication on the roulette pan when the roulette pan comes to stay still is compared with an indication on a roulette pan of another transformable toy to win or lose a game.

2. The transformable toy according to claims 1, wherein the compression of the elastic member of the rotating mechanism is performed while being linked with the folding operation of any of the plurality of character constituting members.

3. The transformable toy according to claims 1, wherein the rotating mechanism comprises further a pinion which transmits rotational motion to the roulette pan, a rack which meshes with the pinion and a sliding member which translates the rack in a straight line, and wherein the elastic member of the rotating mechanism is compressed by the rack which translates in a straight line while being linked with the translation of the sliding member in any of steps of the folding procedure.

4. The transformable toy according to claim 3, wherein the straight-line translated motion of the sliding member is performed while being linked with the folding operation of any of the plurality of character constituting member.

5. The transformable toy according to claim 3, further comprising a control member that is disposed so as to slide the sliding member independently of the folding operation.

6. The transformable toy according to claim 5, wherein the control member is operated in the second form in which the form of the character appears so as to compress the elastic member of the rotating mechanism, and thereafter, the operation of the control member is released so as to rotate the roulette pan.

7. The transformable toy according to claims 1, wherein the rotating mechanism further includes control means for rotating the roulette pan in such a state that the form of the character appears.

8. The transformable toy according to claim 1, wherein the character appearing in the second form takes a form imitating a four-legged animal standing on four limbs, and wherein the head portion, the forelimbs and the hind limbs are individually disposed in a foldable fashion so that the head portion can be folded on to an upper surface side and a lower surface side of the trunk portion against the elastic force of the elastic member which is disposed to correspond to the head portion and the forelimbs and the hind limbs can be folded onto sides of the trunk portion against the elastic forces of the elastic members which are disposed to correspond individually thereto, whereby when so folded, the head portion, the forelimbs and the hind limbs are transformed into the flat plate-shaped first form in which the form imitating the four-legged animal standing is compressed in the vertical direction, wherein the roulette pan is disposed at a rear portion on an upper surface of the trunk portion and the rotating mechanism is disposed within the trunk portion, and wherein when the release control portion is operated, an external appearance of the four-legged animal rises so as to appear as if by the action of a spring from the substantially flat plate-shaped form with the forelimbs and the hind limbs stretched downwards.

9. The transformable toy according to claim 1, wherein the character of the multi-legged animal appearing in the second form takes a form imitating a winged animal such as a bird, wherein the plurality of character constituting members include a trunk portion, a pair of foot portions that are attached rotatably to a lower position of the trunk portion, a pair of wing portions that are attached rotatably to side portions of the trunk portion, and a head portion attached rotatably to an upper portion of the trunk portion, wherein the head portion, the trunk portion and the pair of wing portions are individually disposed in a foldable fashion so that the head portion can be folded on to an extension of the trunk portion against the elastic force of the elastic member which is disposed to correspond to the head portion, the trunk portion can be folded in between the pair of foot portions against the elastic forces of the elastic members which are disposed individually between the pair of foot portions and the pair of wing portions can be folded on to corresponding side portions of the trunk portion against the elastic forces of the elastic members which are disposed to correspond individually to the wing portions, whereby when so folded, the head portion, the trunk portion and the pair of wing portions are transformed into the flat plate-shaped first form in which the form imitating the winged animal is compressed in the vertical direction, wherein the rotating mechanism is disposed within the trunk portion, wherein a rod-like member is disposed on the trunk portion so as to move in a vertical direction and of which one end is exposed from the trunk portion and support the wing portion and the roulette pan is disposed at a belly portion of the trunk portion, so that the elastic member which drives to rotate the roulette pan is compressed by pushing the wing portions and the rod-like portion downwards from above, and wherein when the release control portion is operated, the trunk portion rotates upwards so as to rise from the pair of foot portions and the wing portions and the head portion rotate individually relative to the trunk portion, so that the form of the winged animal rises from the flat plate-shaped form so as to pop up as if by the action of a spring and the roulette pan starts to rotate.

10. The transformable toy according to claim 1, wherein the character appearing in the second form takes a form imitating a two-legged animal standing on two hind limbs, wherein the plurality of character constituting members include a trunk portion, arm portions that are attached rotatably to a front of the trunk portion, leg portions that are attached rotatably to a rear of the trunk portion and are folded against the elastic forces of the elastic members, foot portions that are attached rotatably to distal ends of the leg portions and are superposed on the leg portions against the elastic forces of the elastic members and a head portion attached rotatably to the front of the trunk portion so as to move away from or close to a distal end of the trunk portion, wherein the character constituting members are disposed in a foldable fashion so that the head portion is locked in a position lying close to the trunk portion against the elastic force of the locking releasing elastic member and the arm portions are held by ear flap portions on both sides of the head portion and the foot portions therebetween, whereby when so folded, the character constituting members are transformed into the flat plate-shaped first form in which the form imitating the two-legged animal is compressed in the vertical direction, wherein the roulette pan is disposed at the head portion and the rotating mechanism is disposed within the head portion, and wherein when the release control portion is operated, the arm portions, the leg portions and the head portion rotate relative to the trunk portion so that an external appearance of the two-legged animal rises to pop up as if by the action of a spring from the substantially flat plate-shaped form with the folded leg portions stretched so as to allow the two-legged animal to rise by the foot portions and the roulette pan starts to rotate.

* * * * *